US009512619B2

(12) United States Patent
Winter

(10) Patent No.: US 9,512,619 B2
(45) Date of Patent: Dec. 6, 2016

(54) DECK SYSTEM AND COMPONENTS THEREOF, AND METHODS OF ASSEMBLING AND DISASSEMBLING DECK SYSTEMS AND COMPONENTS

(71) Applicant: Roger Winter, St. John, IN (US)

(72) Inventor: Roger Winter, St. John, IN (US)

( * ) Notice: Subject to any disclaimer, the term of this patent is extended or adjusted under 35 U.S.C. 154(b) by 0 days.

(21) Appl. No.: 14/738,319

(22) Filed: Jun. 12, 2015

(65) Prior Publication Data

US 2015/0354215 A1 Dec. 10, 2015

Related U.S. Application Data

(63) Continuation of application No. 14/598,539, filed on Jan. 16, 2015, now Pat. No. 9,057,190, which is a (Continued)

(51) Int. Cl.
*E04B 1/00* (2006.01)
*E04B 5/10* (2006.01)

(Continued)

(52) U.S. Cl.
CPC ..... *E04C 3/06* (2013.01); *E04B 1/003* (2013.01); *E04B 1/185* (2013.01); *E04B 1/24* (2013.01);

(Continued)

(58) Field of Classification Search
CPC ..... E04B 1/003; E04B 5/10; E04B 1/24; E04B 1/2403; E04B 2001/2457; E04B 2001/2466; E04B 2001/2436; E04B 2001/2415

(Continued)

(56) References Cited

U.S. PATENT DOCUMENTS 2,964,807 A * 12/1960 Kennedy ..... E04C 3/02 52/693
3,529,274 A * 9/1970 Routh ..... F21V 21/35 439/118

(Continued)

OTHER PUBLICATIONS

Kawneer Company, Inc, Parwall Features, EC 96253-15, 6 pages, May 2011.

(Continued)

*Primary Examiner* — Joshua J Michener
*Assistant Examiner* — Keith Minter
(74) *Attorney, Agent, or Firm* — McDonnell Boehnen Hulbert & Berghoff LLP

(57) ABSTRACT

Deck systems, deck system components making up the deck systems, and methods of assembling and disassembling deck system components and the deck systems are described herein. A box-frame can be assembled from box-frame-segments, angle clips, and fasteners. A box-frame can be supported by posts attached to the box-frame using post brackets and fasteners. Joist assemblies can be assembled using joist segments, joist spacers, and fasteners. Joist assemblies can be positioned within the box-frame. The joist assemblies can be secured to box-frame-segments or another joist assembly using roll-lock tabs and roll-lock tab receivers and locking tabs and locking tab retainers that are part of extrusions making up the box-frame-segments, joist spacers, or joist segments. Deck boards can be secured to the joist assemblies using deck screws or deck-clips. The post brackets can accommodate support posts below deck boards and railing posts extending above deck boards.

14 Claims, 45 Drawing Sheets

Related U.S. Application Data continuation-in-part of application No. 14/517,408, filed on Oct. 17, 2014, now Pat. No. 8,997,431, which is a continuation of application No. 13/973,757, filed on Aug. 22, 2013, now Pat. No. 8,863,466.

(51) Int. Cl.

| | |
|---|---|
| ***E04B 1/24*** | (2006.01) |
| ***E04C 3/06*** | (2006.01) |
| ***E04F 15/02*** | (2006.01) |
| ***E04F 15/04*** | (2006.01) |
| ***E04B 5/02*** | (2006.01) |
| ***E04B 1/18*** | (2006.01) |
| *E04C 3/04* | (2006.01) |

(52) U.S. Cl.

CPC ..... *E04B 1/2403* (2013.01); *E04B 5/023* (2013.01); *E04B 5/10* (2013.01); *E04F 15/02044* (2013.01); *E04F 15/02183* (2013.01); *E04F 15/04* (2013.01); *E04B 2001/2415* (2013.01); *E04B 2001/2421* (2013.01); *E04B 2001/2436* (2013.01); *E04B 2001/2457* (2013.01); *E04B 2001/2466* (2013.01); *E04B 2103/06* (2013.01); *E04C 2003/0417* (2013.01); *E04C 2003/0465* (2013.01); *E04F 2015/02094* (2013.01)

(58) Field of Classification Search

USPC ..... 52/634, 635, 650.1, 650.3, 648.1

See application file for complete search history.

(56) References Cited

U.S. PATENT DOCUMENTS

| | | | | |
|---|---|---|---|---|
| 3,713,261 | A * | 1/1973 | Landis | E04B 2/58 52/289 |
| 4,572,694 | A | 2/1986 | Hoeksema | |
| 4,622,792 | A | 11/1986 | Betts | |
| 4,823,529 | A | 4/1989 | Canfield et al. | |
| 4,833,842 | A | 5/1989 | Anastasio | |
| 5,201,546 | A | 4/1993 | Lindsay | |
| 5,313,756 | A | 5/1994 | Ways et al. | |
| 5,412,915 | A | 5/1995 | Johnson | |
| 5,469,678 | A * | 11/1995 | Zamerovsky | E04B 1/003 403/217 |
| 5,483,773 | A | 1/1996 | Parisien | |
| 5,746,958 | A * | 5/1998 | Gustafsson | B27N 3/007 264/115 |
| 5,851,469 | A * | 12/1998 | Muller | B27N 3/28 264/177.11 |
| 6,226,941 | B1 | 5/2001 | Stevens | |
| 6,237,299 | B1 | 5/2001 | Gortan | |
| 6,250,037 | B1 | 6/2001 | Ezumi et al. | |
| 6,385,858 | B1 * | 5/2002 | Muller | G01B 3/30 33/526 |
| 6,427,403 | B1 | 8/2002 | Tambakis | |
| 6,527,532 | B1 | 3/2003 | Muller et al. | |
| 6,651,398 | B2 | 11/2003 | Gregori | |
| 6,872,434 | B2 | 3/2005 | Zen | |
| 6,941,715 | B2 | 9/2005 | Potter | |
| D537,537 | S | 2/2007 | Antonic | |
| D540,479 | S | 4/2007 | Antonic | |
| 7,334,372 | B2 | 2/2008 | Evans et al. | |
| 7,353,639 | B2 | 4/2008 | Carson | |
| 7,434,358 | B2 | 10/2008 | Smith | |
| 8,166,901 | B2 | 5/2012 | Gerst et al. | |
| 8,245,481 | B1 | 8/2012 | Flynn | |
| 8,397,441 | B2 | 3/2013 | Wallance | |
| 8,668,407 | B2 | 3/2014 | Hawkins et al. | |
| 8,863,466 | B1 * | 10/2014 | Winter | E04F 15/02 52/634 |
| 8,997,431 | B2 * | 4/2015 | Winter | E04F 15/02 52/634 |
| 9,057,190 | B1 * | 6/2015 | Winter | E04F 15/02044 |
| 2002/0059766 | A1 | 5/2002 | Gregori | |
| 2003/0014935 | A1 | 1/2003 | Bodnar | |
| 2004/0255551 | A1 | 12/2004 | Fuhr | |
| 2007/0163205 | A1 * | 7/2007 | Johns | E02D 27/01 52/745.05 |
| 2011/0072744 | A1 | 3/2011 | Maley | |
| 2011/0203215 | A1 | 8/2011 | McNamee | |
| 2011/0225923 | A1 | 9/2011 | Dueker | |
| 2011/0283643 | A1 | 11/2011 | Rubel et al. | |
| 2012/0031017 | A1 | 2/2012 | Stroyer | |
| 2012/0311950 | A1 | 12/2012 | Rubel et al. | |
| 2013/0198978 | A1 * | 8/2013 | Pohlman | E01D 1/00 14/69.5 |

OTHER PUBLICATIONS

Tubelite Inc., 200 Series Curtainwall Description, 36 pages, 2007.
Tubelite, Inc., Storefronts and Entrances, 12 pages, Oct. 11, 2012.
Tubelite, Inc., Sunshades by Tubelite, 4 pages, Nov. 7, 2011.
Tubelite, Inc., Standard and Custom Entrances, 2 pages, Jan. 22, 2013.
Tubelite, Inc., Curtainwall, 4 pages, Apr. 23, 2013.
Wikipedia, Deck (building), 4 pages, downloaded from the World Wide Web at http://en.wikipedia.org/wiki/Deck_(building) on Jul. 30, 2013.
Tubelite, Inc., Standard Entrances Description, 47 pages, 2007.
International Searching Authority, Form PCT/ISA/220, Patent Cooperation Treaty, PCT, International Search Report regarding International Application No. PCT/US2014/049692, 4 pages, Oct. 15, 2014.
International Searching Authority, Form PCT/ISA/237, Written Opinion of the International Searching Authority regarding International Application No. PCT/US2014/049692, 6 pages, Oct. 15, 2014.

* cited by examiner

DECK SYSTEM AND COMPONENTS THEREOF, AND METHODS OF ASSEMBLING AND DISASSEMBLING DECK SYSTEMS AND COMPONENTS

REFERENCE TO PRIOR APPLICATIONS

This application is a continuation application of U.S. patent application Ser. No. 14/598,539 filed on Jan. 16, 2015. U.S. patent application Ser. No. 14/598,539 is a continuation-in-part application of U.S. patent application Ser. No. 14/517,408 filed on Oct. 17, 2014, which issued as U.S. Pat. No. 8,997,431 on Apr. 7, 2015. U.S. patent application Ser. No. 14/517,408 is a continuation application of U.S. patent application Ser. No. 13/973,757 filed Aug. 22, 2013, which issued as U.S. Pat. No. 8,863,466 on Oct. 21, 2014. U.S. patent application Ser. No. 14/598,539, U.S. patent application Ser. No. 13/973,757, and U.S. patent application Ser. No. 14/517,408 are incorporated by herein by reference.

BACKGROUND

A deck is a structure typically built outdoors and typically connected to a building. A deck usually has a flat surface similar to a floor and can be built at a given elevation above the ground. A deck can support a load consisting of people, deck furniture, or other items. The supportable load can vary from deck to deck based on such items as the size and type of material used to build the deck.

OVERVIEW

Example embodiments pertaining to deck systems and components thereof, as well as example embodiments of assembling and dissembling deck systems and components are described herein. One or more of the example embodiments can provide for deck system components or deck systems that are easier to assemble, disassemble, and reassemble than prior decks. One or more of the example embodiments provide for disassembling an assembled deck system, moving the disassembled deck system from a first location to a second location, such as a storage building, and subsequently reassembling the deck system at the first location, the second location, or a third location. Disassembly of the deck system can occur for storage of the components within the storage building during an expected timeframe when the deck system will not be used (such as winter time) or for some other reason.

In one respect, an example embodiment can take the form of a deck system comprising: (i) a box-frame including a first box-frame-segment, a second box-frame-segment, a third box-frame-segment, and a fourth box-frame-segment, wherein each of the first box-frame-segment, the second box-frame-segment, the third box-frame-segment, and the fourth box-frame-segment includes a first top horizontal element, a locking tab slot adjacent to the first top horizontal element, a first base horizontal element, and a locking tab extending from and above the first base horizontal element, and (ii) a first joist assembly removably attached to and within the box-frame, wherein the first joist assembly includes a first box-frame-segment attachment having a first locking tab slot adapted for positioning over the locking tab of the first box-frame-segment and a first locking tab for positioning in the locking tab slot of the first box-frame-segment, and wherein the first joist assembly includes a second box-frame-segment attachment having a second locking tab slot adapted for positioning over the locking tab of the second box-frame-segment and a second locking tab for positioning in the locking tab slot of the second box-frame-segment.

These as well as other aspects and advantages will become apparent to those of ordinary skill in the art by reading the following detailed description, with reference where appropriate to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments are described herein with reference to the drawings. The items shown in the figures are not or may not be to scale.

DETAILED DESCRIPTION

I. Introduction

Figure 1:
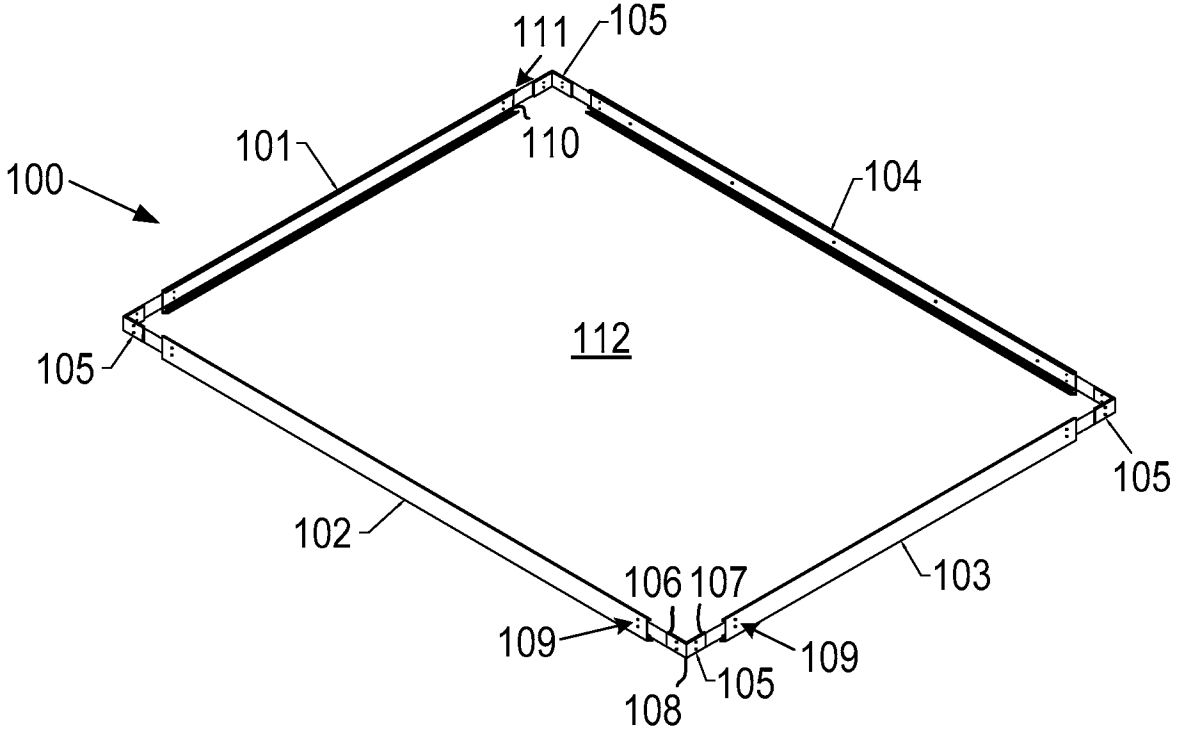
FIG. 1 shows components for assembling a perimeter box-frame of a deck system in accordance with one or more example embodiments.

This description describes several example embodiments including example embodiments regarding deck systems and components thereof. The example deck systems can be used as a free-standing deck positioned on the ground or a deck attached to a structure. As an example, the deck attached to the structure can be attached to a wall or the roof of the structure. As another example, the deck can be placed or set on a roof or other structure. The example deck systems, or portions thereof, can be installed on land or in water. A deck system having at least a portion installed in water can be referred to as a pier. The example deck systems, or portions thereof, can be used as a bridge over a stream, a creek, a ditch, or some other areas of Earth. The example deck systems can be assembled and used at a recreational vehicle (RV) park. The example deck systems can be easily disassembled from one location, moved to another location, and reassembled at the other location.

This description refers to extrusions. The extrusions can be produced by extruding a material through a die. Several of the example embodiments refer to the extrusion material as aluminum. The extrusions of the example embodiments can be a material other than aluminum. Extrusions used within the example deck systems can be cut from a stock length extrusion. One or more of the extrusions can be milled, mitered, punched, drilled, or otherwise prepared to receive one or more fasteners, anchors, or other deck system component.

The components, functions, and various views shown in the figures are provided merely as examples and are not intended to be limiting. Elements shown in the various figures having the same reference number can be the same or a similar element. Many of the components illustrated in the figures or described herein as being attached can be attached using any of a variety of fasteners. Some fasteners used to attach two or more components can be a part of the attachable component. The particular fasteners described herein are provided as examples only. A person having ordinary skill in the art will understand that the fasteners used to attach any two more components can have a different size, thread count, and more or less components (e.g., with or without a washer or nut).

The description identifies particular dimensions of various components. The identified dimensions are provided as examples only. A person having ordinary skill in the art will understand that a dimension of a component described as having a particular dimension can be a different dimension.

In this description, the articles "a," "an," and "the" are used to refer to elements of the example embodiments. The intent of using those articles is that there is one or more of the elements. The intent of using the conjunction "or" within a described list of at least two terms is to indicate any of the listed terms or any combination of the listed terms. The use of ordinal numbers such as "first," "second," "third" and so on is to distinguish respective elements rather than to denote a particular order of those elements.

The term "joist" in this description refers to a horizontal support. A horizontal support (i.e., a joist) can be used in construction of various structures such as, but not limited to, a pier or a deck (e.g., a deck attached to the side of a house or built on a rooftop). A horizontal support can be positioned within or as part of a structure such that the horizontal support is parallel to the Earth's horizon at which the structure is located or such that the horizontal support is not parallel to the Earth's horizon. In the latter case, the non-parallel placement may be used so that rain that falls upon boards positioned on the horizontal support will slide off of the boards, or for some other reason. A horizontal support can include or be referred to as a beam.

Various element names of the example deck systems are modified with the term "vertical" or "horizontal." Those element names are with respect to how the components are oriented in the drawings. A person skilled in the art will understand that an element referred to as a horizontal element may extend horizontally or substantially horizontally. The person skilled in the art will understand that an element referred to as a vertical element may extend vertically or substantially vertically. Any component referred to as a "vertical" element can be referred to as the element preceded by an ordinal number without the vertical descriptor (e.g., a vertical element can be referred to as a first element or a second element, etc.). Similarly, any component referred to as a "horizontal" element can be referred to as the element preceded by an ordinal number without the horizontal descriptor (e.g., a horizontal element can be referred to as a third element or a fourth element, etc.). A person skilled in the art will also understand that that the elements referred to as horizontal may be tilted such that the deck system slopes. As an example, a sloped deck system can be used as lean-to.

II. Example Deck Systems

A. Box-Frames

FIG. 1 shows example components for assembling a perimeter box-frame (or more simply "box-frame" or alternatively, a "box-frame assembly") 100 usable within the example deck systems. As shown in FIG. 1, the box-frame components include box-frame-segments 101, 102, 103, and 104, and angle clips 105. An area surround by a set of connected box-frame-segments can be referred to as a box-frame interior. For example, an area surrounded by the box-frame-segments 101, 102, 103, and 104 is a box-frame interior 112.

Each angle clip 105 can be arranged as an L-shaped clip having angle clip segments 106 and 107 that extend from a joint or bend 108. Each angle clip segment 106 and 107 can include at least one attachment hole, which can be a through-hole. Each attachment hole within angle clip segments 106 and 107 can correspond to a respective attachment hole 109 within the box-frame-segments 101, 102, 103, and 104. As an example, angle clip 105 can include four attachment holes 109 for securing angle clip 105 to two box-frame-segments using four number ten by one inch (i.e., #10×1") flat head sheet metal screws, four lock washers, and four nuts. Angle clips 105 can be made from aluminum or another material. Angle clips installed at corners of a box-frame can be referred to as corner angle clips.

Each angle clip segment 106 and 107 can slide or otherwise be inserted into a respective box-frame-segment. Each box-frame-segment can include an angle clip shelf 110 and an angle clip slot 111 for guiding or supporting the angle clip 105 inserted thereto.

Figure 36:
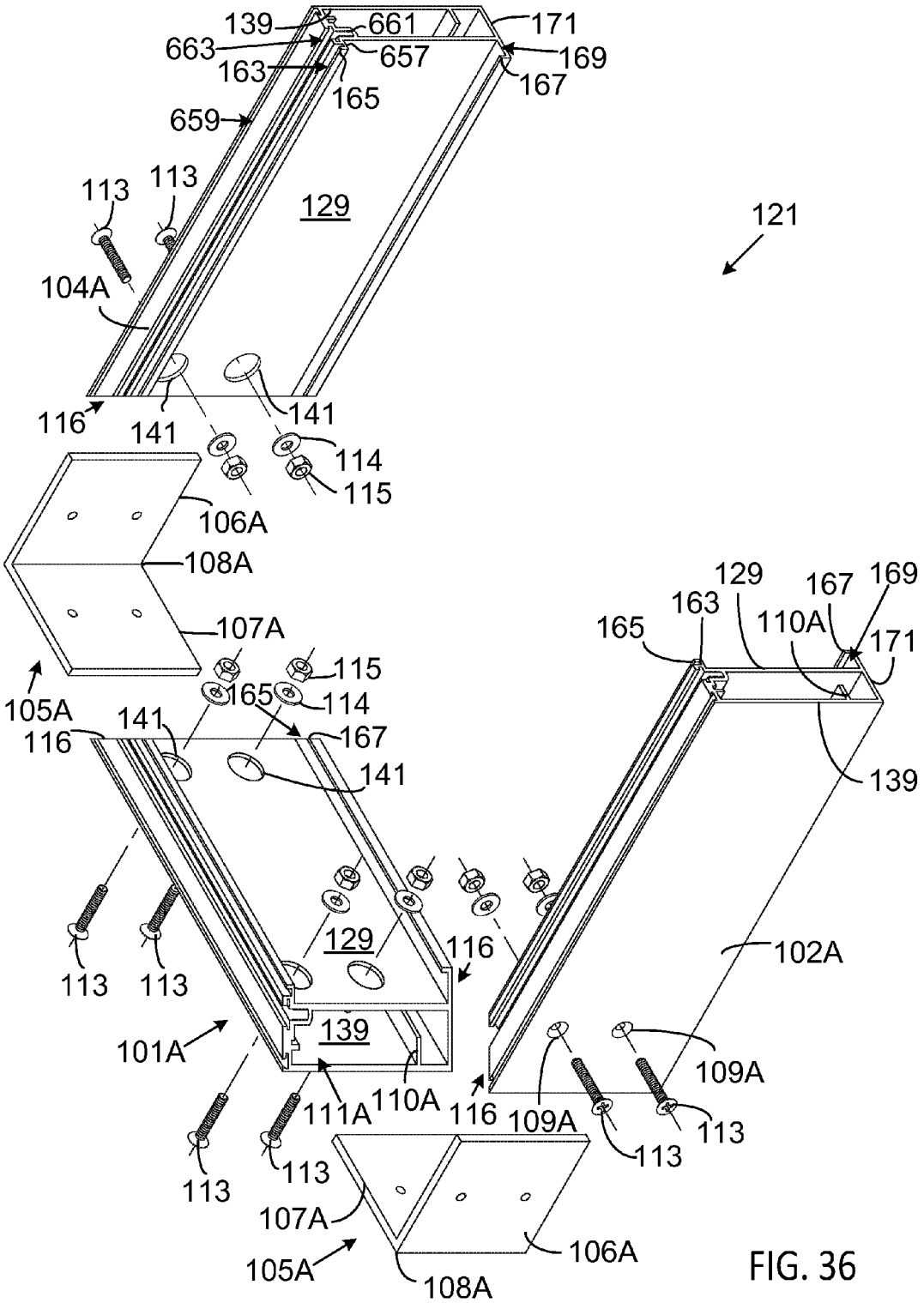
FIGS. 36 and 37 show components of a box-frame.
Figure 37:
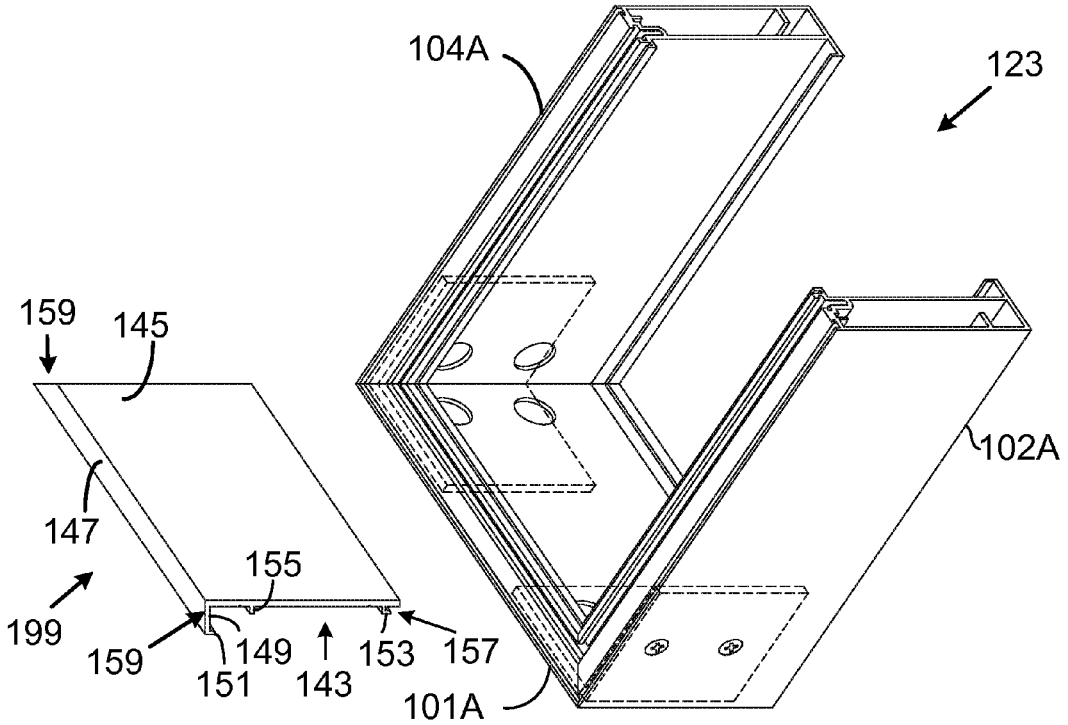
Figure 37:
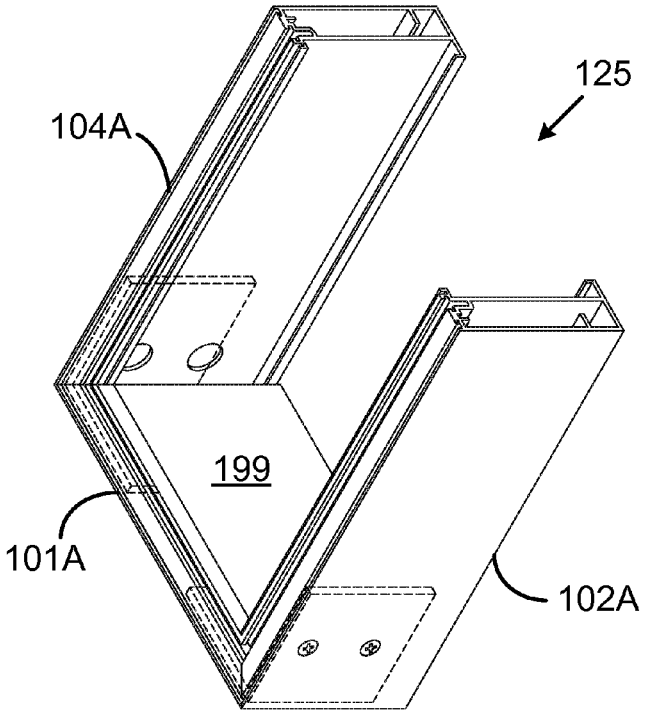

Next, FIG. 36 and FIG. 37 show box-frame component views 121, 123, and 125. In box-frame component view 121, the box-frame components are unattached, whereas in box-frame component views 123 and 125, the box-frame components are attached as part of a box-frame. As an example, the box-frame with the components shown in box-frame component views 121, 123, and 125 can be the box-frame 100 shown in FIG. 1 or a different box-frame.

The box-frame component view 121 shows box-frame-segments 101A, 102A, and 104A. The box-frame-segments 101A, 102A, and 104A are extrusions that can be produced from the same or similar extrusion die(s). Accordingly, any feature described with respect to any of the box-frame-segments 101A, 102A, and 104A can be applicable to the other box-frame-segments and any other box-frame-segment within a box-frame including the box-frame-segments 101A, 102A, and 104A.

The box-frame-segments 101A, 102A, and 104A include a first vertical element 139 and a second vertical element 129. Since the first vertical element 139 is relatively farther from an interior of an assembled box-frame and the second vertical element 129 is relatively closer to an interior of the assembled box-frame, the first vertical element 139 can be referred to an outer vertical element and the second vertical element 129 can be referred to as an inner vertical element. As shown in FIG. 36 and FIG. 37, the box-frame-segments 101A, 102A, and 104A are configured like the box-frame-segment 463 shown in FIG. 26. In an alternative arrangement, the box-frame-segments 101A, 102A, 104A and an box-frame-segment opposite the box-frame-segment 101A can be configured like the box-frame-segment 403 or the box-frame-segment 487 shown in FIG. 26.

The outer vertical element 139 of each box-frame-segment 101A, 102A, and 104A can include attachment holes 109A that align with through-holes in an angle clip 105A. The inner vertical element 129 of each box-frame-segment 101A, 102A, and 104A can include attachment holes 141 that align with a corresponding attachment hole 109A and a through-hole in an angle clip 105A. The box-frame component view 121 shows two instances of angle clips 105A. Each angle clip 105A includes angle clip segments 106A and 107A that extend from a joint or bend 108A. The box-frame-segment 101A includes an angle clip shelf 110A to support the angle clips 105A and an angle clip slot 111A into which the angle clips 105A can be inserted.

A fastener 113 can be positioned through an attachment hole 109A and a through-hole in an angle clip 105A. A washer 114 and a nut 115 can be attached to the fastener 113 so as to keep an angle clip 105A attached to a box-frame-segment. The fasteners 113, the washers 114, and the nuts 115 can be removed from the box-frame-segments 101A, 102A, and 104A and the attachment clips 105A during disassembly of the box-frame. As an example, the fasteners 113 can be #10×1" flat head sheet metal screws and the washers 114 can be lock washers. Other examples of the fasteners 113, 114 and 115 are possible.

The box-frame-segment 104A includes a locking-tab 167 that extends upward from a horizontal element 171. The horizontal element 171 extends from the outer element 139 to the locking-tab 167. A locking-tab slot 169 separates the interior vertical element 129 and the locking-tab 167. The box-frame-segment 104A includes a locking-tab 165 that extends upward from a horizontal element 657 that extends inwardly (towards a box-frame interior) from the interior vertical element 129. A locking-tab slot 163 is adjacent the locking-tab 165. The box-frame-segment 104A includes a perimeter-trip clip slot 659, a deck-clip slot 663, and splines 661 for receiving a deck-clip screw inserted through a deck-clip inserted into the deck-clip slot 663.

Ends 116 of the box-frame-segments 101A, 102A, and 104A can be cut with a bevel so that two of the ends can abut one another to form a bevel or miter joint. Both ends 116 of box-frame-segments 101A are shown in box-frame component view 121, whereas only one end 116 of box-frame-segments 102A and 104A are shown in box-frame component view 121. FIG. 36 shows section views at intermediate points (opposite the displayed ends 116) of the box-frame-segment 102A and 104A. The opposite ends of the box-frame-segments 102A and 104A can be beveled for joining to a box-frame-segment opposite box-frame-segment 101A. The box-frame-segment opposite box-frame-segment 101A can be arranged like the box-frame-segment 101A and corresponds to the box-frame-segment 102 in the box-frame 100.

A component shown in any figure and designated by a reference number followed by the suffix "A" can be a component that is part of the box-frame 100 in place of the component with the similar reference number but without the suffix "A" in FIG. 1. For example, box-frame-segment 101A can take the place of box-frame-segment 101.

Turning to FIG. 37, the box-frame component view 123 shows the box-frame-segment 101A attached to the box-frame-segment 102A and to the box-frame-segment 104A. The box-frame component view 123 also shows a box-frame-segment cover 199 prior to installation onto the box-frame-segment 101A. The box-frame-segment cover 199 includes a vertical element 143 having a first surface 145 and a second surface on the opposing side, a top horizontal element 149, a top surface 147 of the top horizontal element 149, a locking-tab 151, a locking-tab 153, and an uplift-clip shelf 155. The box-frame-segment cover 199 is an example of a box-frame-attachment that is removably attachable to a box-frame-segment.

A locking-tab slot 157 is located between the locking-tab 153 and the vertical element 143. The locking-tab slot 157 can be positioned over the locking-tab 167 when the box-frame-segment cover 199 is attached to the box-frame-segment 101A as shown in the box-frame component view 125. The locking-tab 151 can be positioned within the locking-tab slot 163 and the locking-tab 153 can be positioned within the locking-tab slot 169 when the box-frame-segment cover 199 is attached to the box-frame-segment 101A as shown in the box-frame component view 125. The box-frame-segment cover 199 covers the attachment holes 141 of the box-frame-segment 101A and can reduce environmental exposure to fasteners accessible via those attachment holes. The ends 159 of the box-frame-segment cover 199 can be cut with a bevel for forming bevel or miter joints with joist elements (e.g., joist spacers) having beveled or mitered ends.

The heights and lengths of the extrusions used for the box-frame-segments 101A, 102A, and 104A can be any of a variety of heights and lengths, although for any particular box-frame, the heights of the extrusions can be identical and the lengths of opposing box-frame-segments can be identical. As an example, the height of box-frame-segments 101A, 102A, and 104A can be 5.25 inches (0.13335 meters). As another example, a length of the box-frame-segment 101A can be 10 feet (3.048 meters) long, or 12 feet (3.6576 meters) long, or some other length. As yet another example, a length of the box-frame-segment 102A can be 14 feet (4.2672 meters) long, or 15 feet (4.572 meters) long, or some other length.

Figure 2:
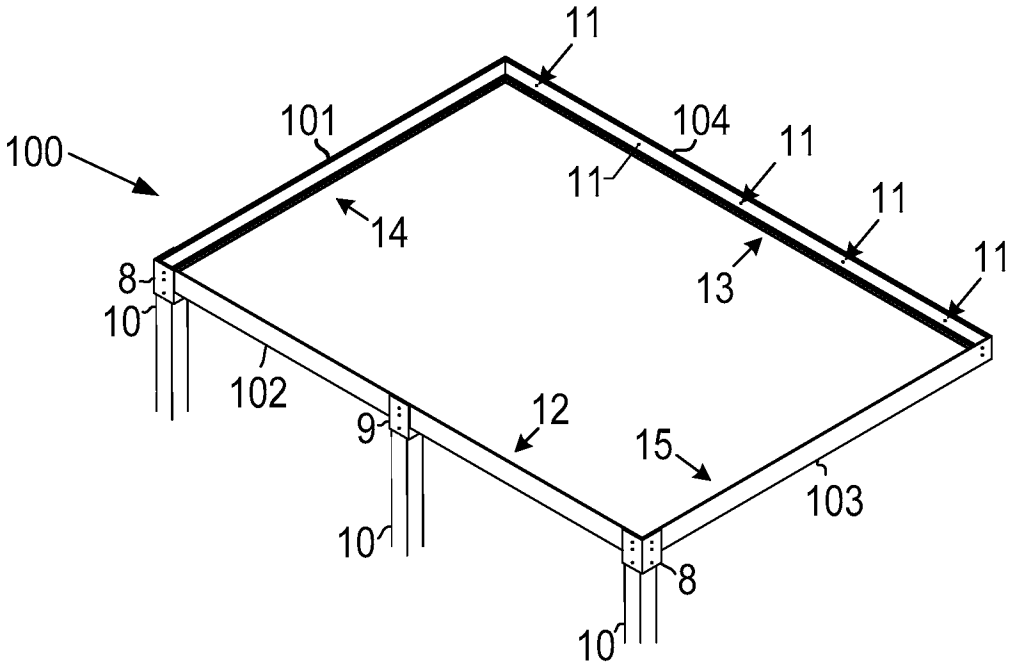
FIG. 2 shows an assembled box-frame in accordance with one or more example embodiments.

Next, FIG. 2 shows the box-frame 100 assembled and attached to support-posts (or more simply "posts") 10 on a first side 12 of the box-frame 100. Corner-post brackets 8 and an intermediate-post bracket 9 can be used for attaching the box-frame 100 to posts 10. Other sides 13, 14, and 15 of the box-frame 100 are identified in FIG. 2. The box-frame-segment 104 on side 13 can include through-holes 11 for attaching the box-frame 100 to another box-frame or to a structure, such as a house or a mobile home. The box-frame-segments 101, 102 and 103 can include through-holes arranged similar to through-holes 11, but those through-holes are not shown for clarity of FIG. 2.

Similar to the box-frame-segments 101A, 102A, and 104A, the lengths of the box-frame-segments 101, 102, 103, and 104 can be any length selected from a plurality of lengths. For a rectangular deck, lengths of opposing box-frame-segments are typically identical. As an example, the length of the box-frame-segment 101 can be six foot, zero inches (i.e., 6'-0") (1.8288 meters). As another example, the box-frame-segment 102 can be 10'-0" (3.048 meters). Other example lengths for a box-frame-segment are also possible.

Figure 8:
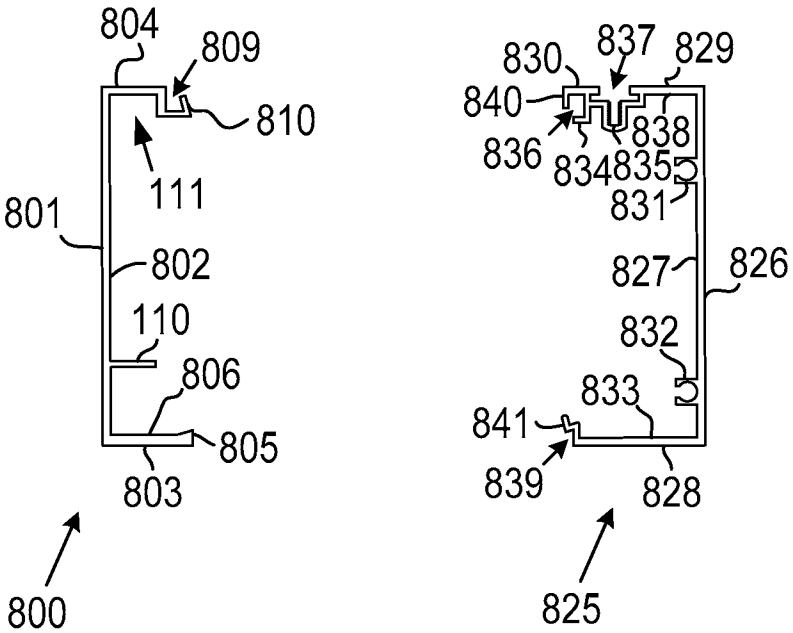
FIG. 8 shows profiles of example extrusions in accordance with one or more example embodiments.
Figure 21:
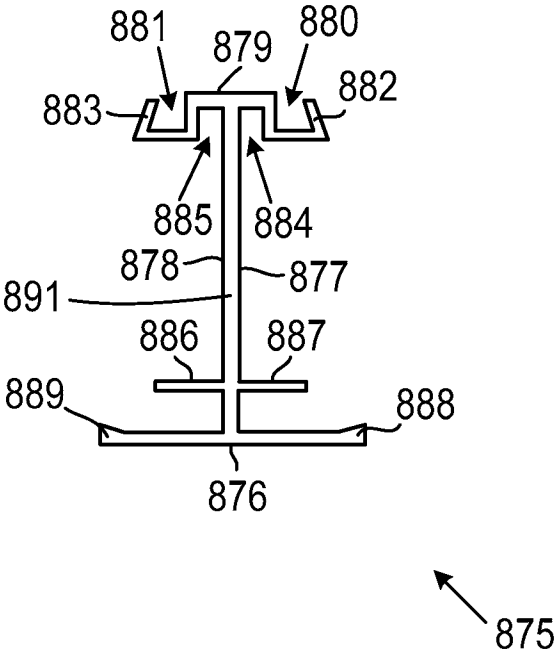
FIG. 21 shows profiles of example extrusions in accordance with one or more example embodiments.
Figure 21:
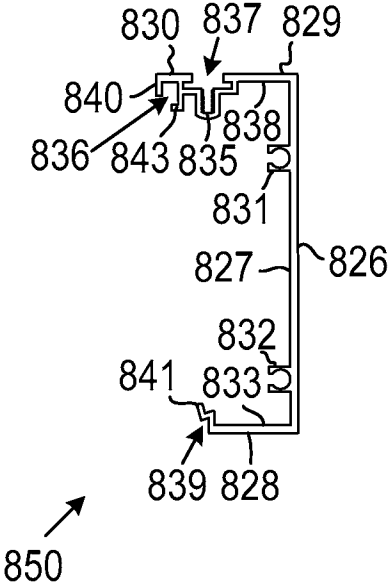

The box-frame-segments 101, 102, 103, and 104 can include or be configured as any of a variety of extrusions. Profiles of example extrusions 800 and 825 are shown in FIG. 8, and profiles of example extrusions 850 and 875 are shown in FIG. 21. For an example deck system comprising a single box-frame, the box-frame-segments 101, 102, 103, and 104 can be configured like the extrusion 800 arranged with their flat vertical sides as the outer edges of the box-frame 100.

In FIG. 2 and in other figures described herein, the posts 10 are shown as being rectangular or rectangular prisms. The posts used with the example embodiments do not have to be rectangular. For instance, one or more posts used with the example embodiments can be cylindrical. Post brackets used with non-rectangular posts, such as cylindrical posts, can have non-rectangular shapes, such as cylindrical shapes, to accommodate the non-rectangular posts.

A deck system can include two or more box-frames. For an example deck system comprising two or more box-frames configured like the box-frame 100, a box-frame-segment configured like the extrusion 800 from two separate box-frames can be bolted together with their flat vertical sides 801 abutting one another.

Figure 29:
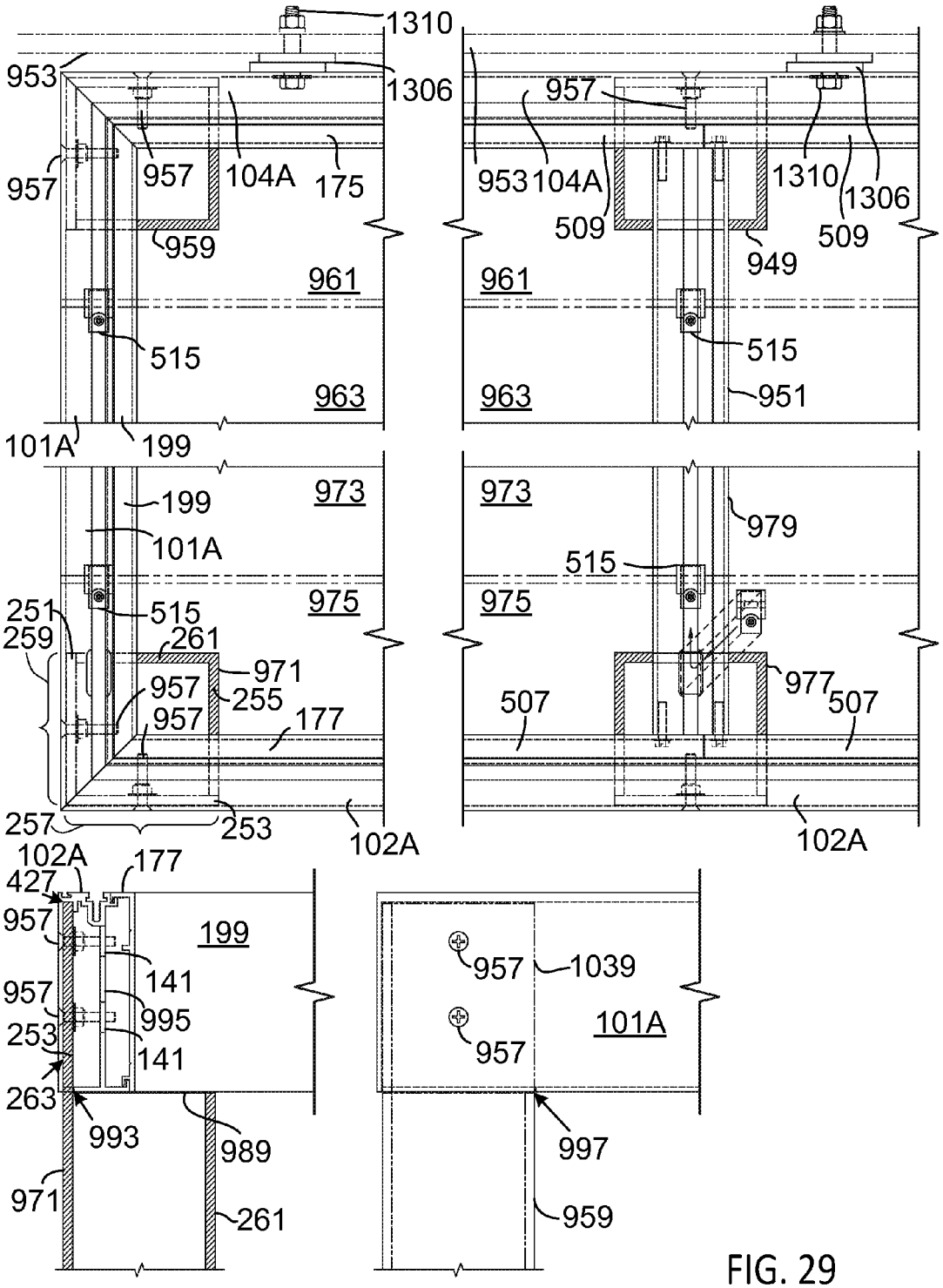
FIGS. 29, 30, 31, 32, 33, and 34 show example post supports for an example deck system.

In FIG. 2, the corner-post brackets 8 and the intermediate-post bracket 9 are shown as abutting an external surface of the box-frame-segment 101, 102, or 103. In an alternative arrangement, an upper portion of the corner-post brackets 8 and the intermediate-post bracket 9 can be positioned within at least one of the box-frame-segments 101, 102, and 103 similar to how corner post (or corner bracket) 971 and intermediate post (or intermediate bracket) 977 are positioned within one or more of box-frame-segments 101A and 102A (as shown in FIG. 29). In this regard, the upper portion of the corner-post brackets 8 and the intermediate-post bracket 9 can be positioned within a reinforcement guide to lock the corner-post brackets 8 and the intermediate-post bracket 9 into the one or more of box-frame-segments 101, 102, and 103.

Figure 22:
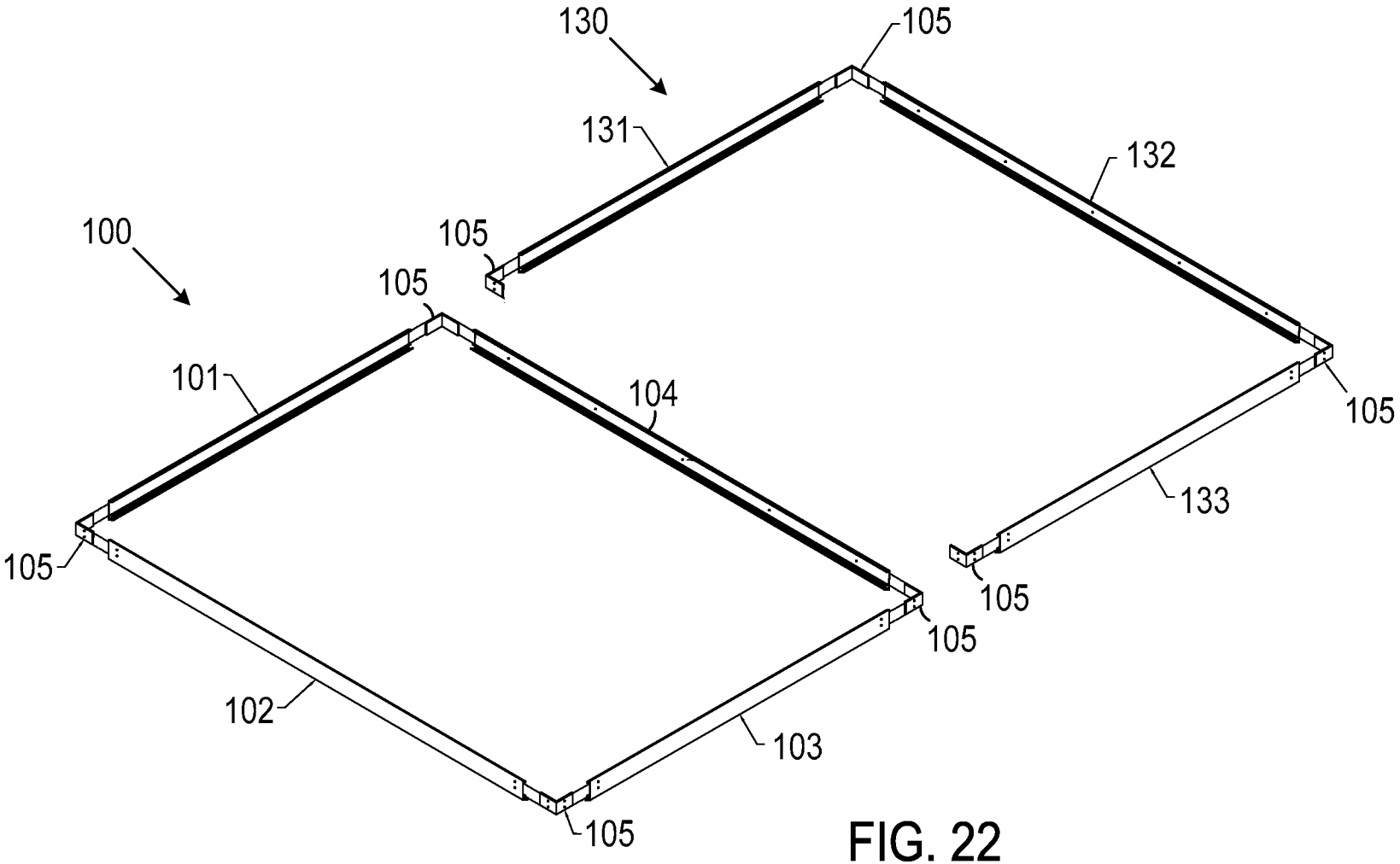
FIG. 22 shows components for assembling a deck system in accordance with one or more example embodiments.

FIG. 22 shows example components for a deck system using two or more box-frame-segments. In particular, FIG. 22 shows the box-frame-segment 100 and a box-frame-segment attachment 130 that when connected to another box-frame-segment, such as box-frame-segment 100, forms another box-frame, such as the box-frame of the deck system 705 shown in FIG. 7. The box-frame-segment attachment 130 includes box-frame-segments 131, 132, and 133. For these example embodiments, the box-frame-segments 101, 102, 103, 131, 132, and 133 can be configured like the extrusion 800, and the box-frame-segment 104 can be configured like the extrusion 875. The box-frame-segment attachment 130 can include angle clips 105, two of which can be used for attaching the box-frame-segment attachment 130 to the box-frame 100.

B. Joists and Joist Assemblies

Figure 38:
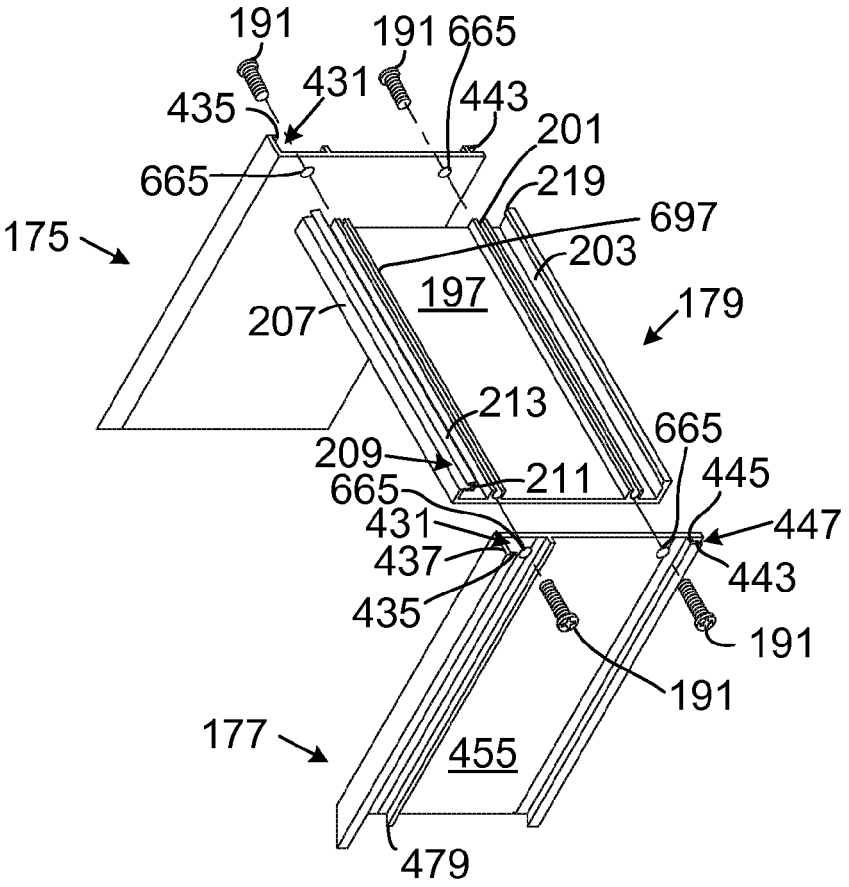
FIGS. 38, 39, 40, and 41 show example joist assemblies.
Figure 38:
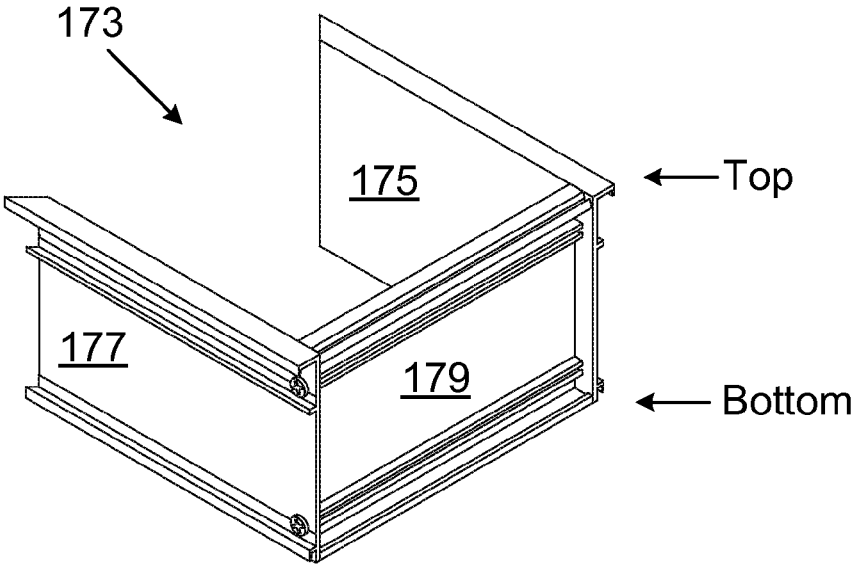

Next, FIG. 38 shows a joist assembly 173 and the components of the joist assembly 173 prior to assembly of the joist assembly 173. The joist assembly 173 includes three extrusions that can be referred to as a joist spacer 175, a joist spacer 177, and a joist segment 179. The joist spacers 175 and 177 can be produced from the same or similar extrusion die(s) and, therefore, the joist spacers 175 and 177 can have identical features. The joist segment 179 can produced from another extrusion die from which a joist segment 433 shown in FIG. 26 can be produced.

Figure 26:
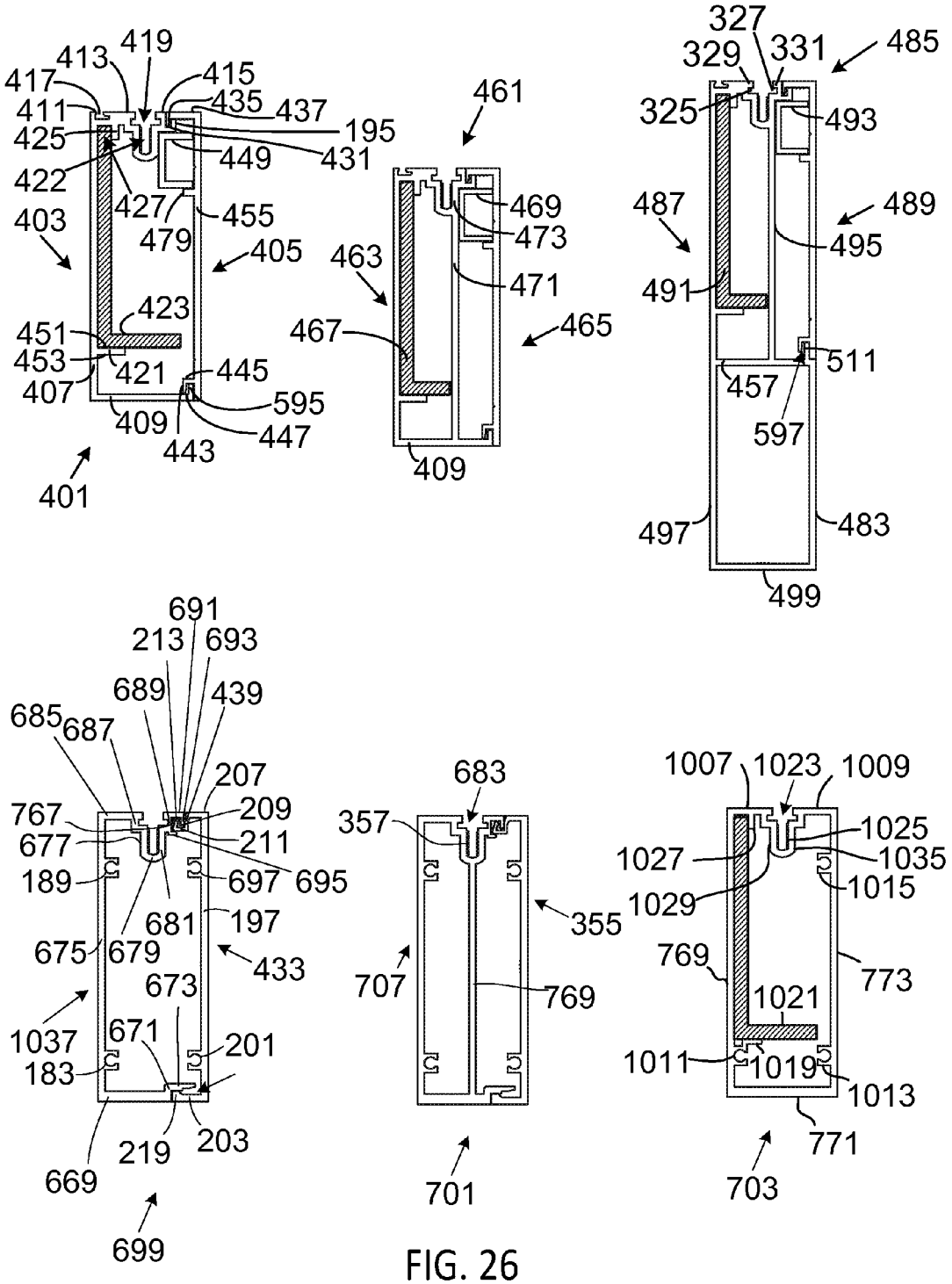
FIG. 26 shows example extrusions for box-frames, joists, and joist assemblies.

The joist spacer 175 and the joist spacer 177 can include the features of the box-frame-segment attachment 405 shown in FIG. 26. Some of those features are identified in FIG. 26. For example, the joist spacer 177 includes the vertical element 455, the horizontal element 437, the locking-tab 435, the uplift-clip shelf 479, the horizontal element 445, and the locking-tab 443. For attachment to the box-frame-segment 102A, the locking-tab 435 extends downward from the horizontal element 437 and the locking-tab 443 extends downward from the horizontal element 445. A locking-tab slot 431 is formed by the vertical element 455, the horizontal element 437, and the locking-tab 435. A locking-tab slot 447 is formed by the vertical element 455, the horizontal element 445, and the locking-tab 443.

The joist segment 179 includes a vertical element 197, a horizontal element 203, a top horizontal element 207, a horizontal element 211, a roll-lock tab 213, and a roll-lock slot 209 for positioning a roll-lock tab of a corresponding joist segment attachable to the joist segment 179 to form a joist. The horizontal element 203 extends from the vertical element 197 to a locking-tab 219. The locking-tab 219 can include a flange extending above the horizontal element 203. A joist assembly including the joist segment 179 can be formed by attaching the joist segment 1037 shown in FIG. 26 to the joist segment 179.

The joist segment 179 includes screw spline 201 (i.e., a lower screw spline), and a screw spline 697 (i.e., an upper screw spline). The joist spacers 175 and 177 can include through-holes 665 for passing fasteners 191 and into the screw splines 201 and 697. As an example, the fasteners 191 can include a flat head screw, such as any flat head screw described herein.

Figure 25:
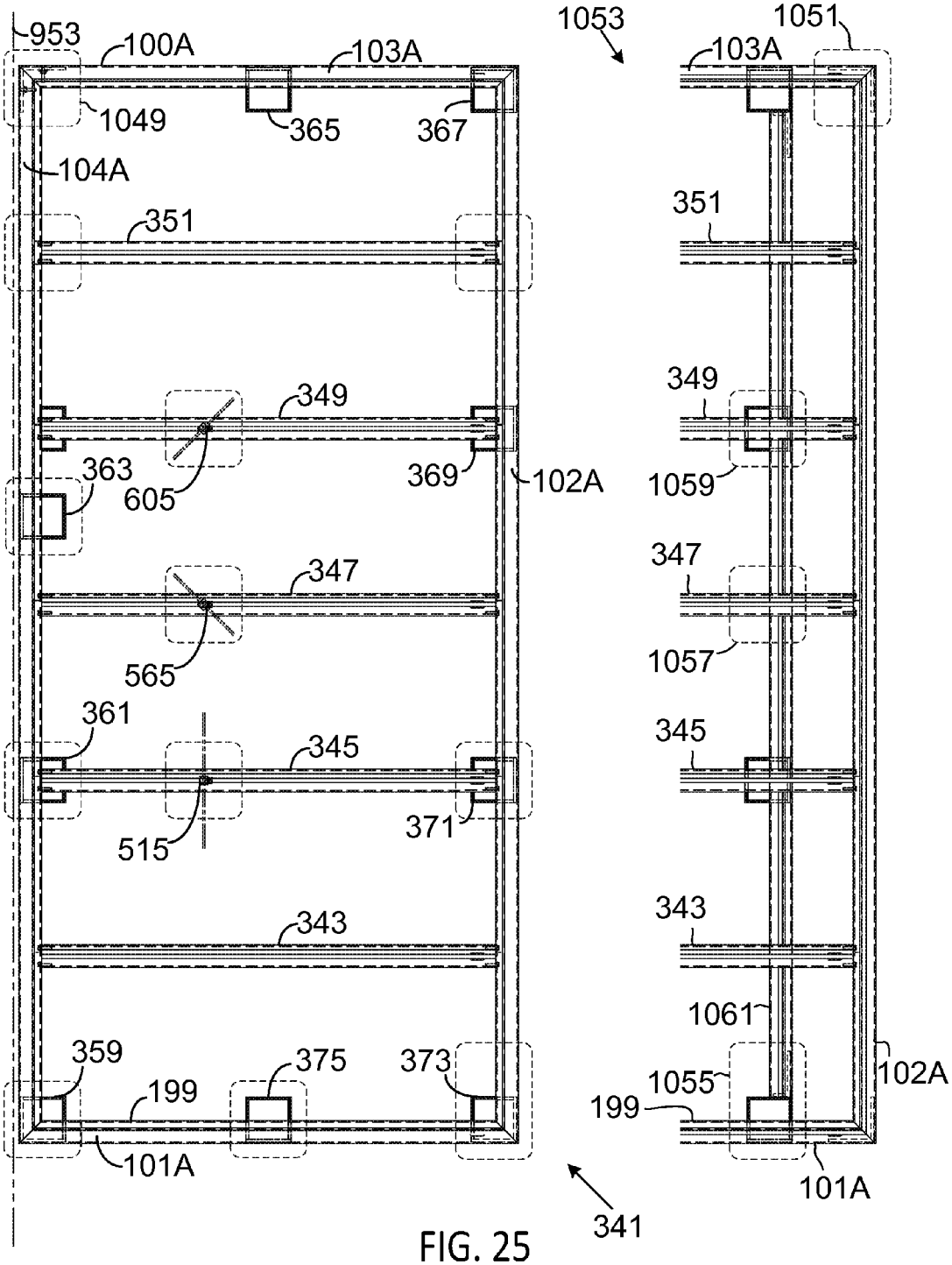
FIG. 25 shows a box-frame and components thereof.
Figure 39:
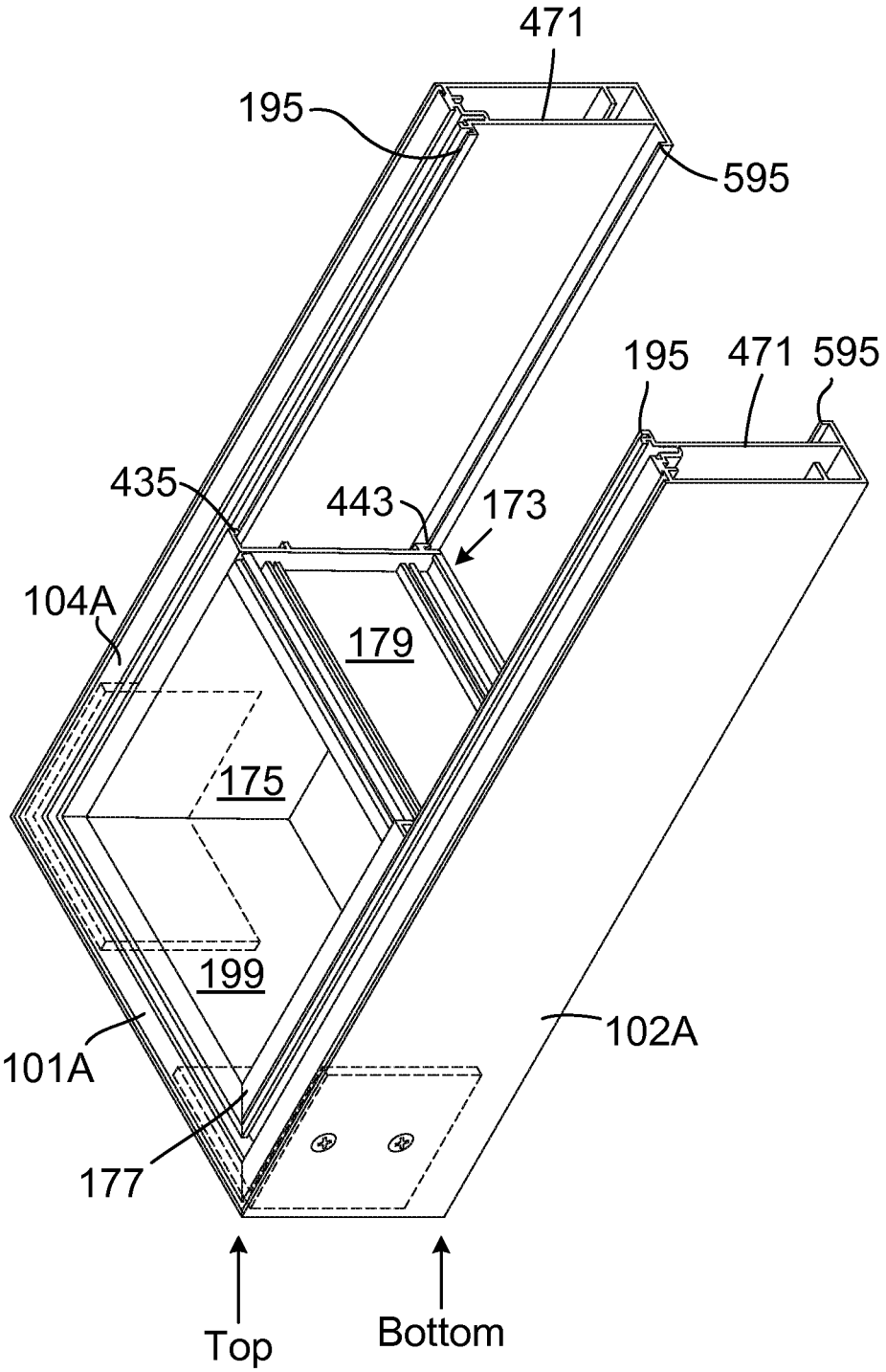

Next, FIG. 39 shows components of a box-frame, such as the deck system 341 shown in FIG. 25. In particular, FIG. 39 shows the box-frame-segment 101A, the box-frame-segment 102A, the box-frame-segment 104A, the box-frame-segment cover 199 attached to the box-frame-segment 101A, and the joist assembly 173 attached to box-frame-segment 102A and the box-frame-segment 104A. The locking tabs 435 of the joist spacers 175 and 177 are positioned within the locking-tab slots, formed in part by the locking tab 195, of the box-frame-segments 104A and 102A, respectively. The locking tabs 443 of the joist spacers 175 and 177 are positioned within the locking-tab slots, formed in part by the locking tab 595, of the box-frame-segments 104A and 102A, respectively. As shown in FIG. 39, a joist assembly can include one joist or joist segment and two joist spacers. A three-piece joist assembly (counting only the joist spacer(s) and joist segment(s)) can be the first joist assembly installed within a deck system during its assembly and the last joist assembly removed from the deck system during its disassembly.

Figure 40:
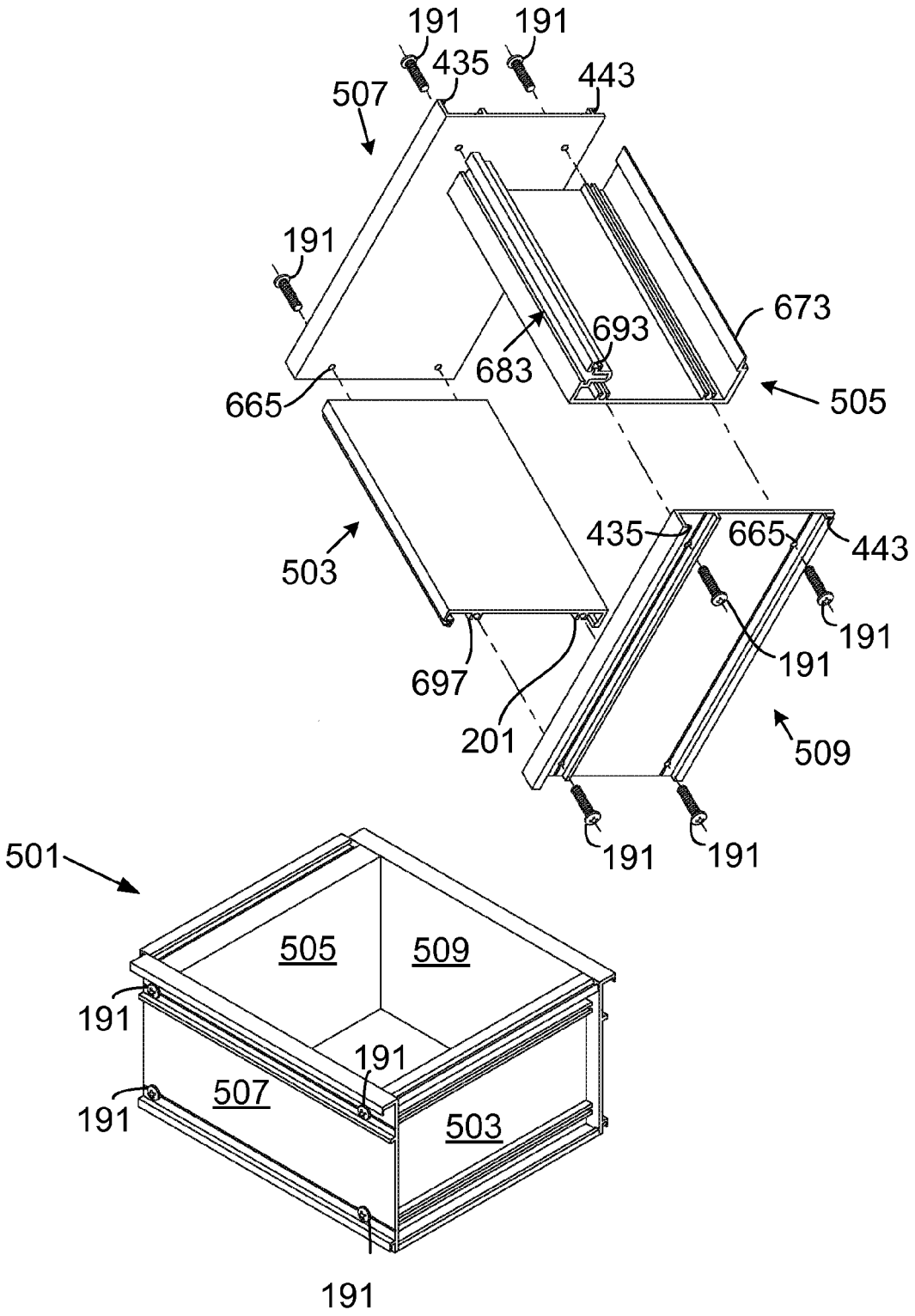

Next, FIG. 40 shows a joist assembly 501 and the components of the joist assembly 501 prior to assembly of the joist assembly 501. The joist assembly 501 includes a joist segment 503, a joist segment 505, a joist spacer 507, a joist spacer 509, and fasteners 191. A four-piece joist assembly (counting only the joist spacer(s) and joist segment(s)) can be an intermediate joist assembly installed within a deck system during its assembly and the last joist assembly removed from the deck system during its disassembly.

The joist segment 503 can include the joist segment 433 shown in FIG. 26. The joist segment 505 can include the joist segment 1037 shown in FIG. 26. Accordingly, some of the features of the joist segments 433 and 1037 are identified on the joist segments 503 and 505.

The joist spacers 507 and 509 can each include the box-frame-segment attachment 405 shown in FIG. 26. Accordingly, some of the features of the box-frame-segment attachment 405 are identified on the joist spacers 507 and 509. Through-holes 665 can be drilled through the joist spacers 507 and 509 at locations corresponding to the screw spines 183 and 189 in the joist segment 505 and at locations corresponding to the screw splines 201 and 697 in the joist segment 503. Portions of the fasteners 191 can be passed through the through-holes 665 and threaded into the screw splines 183, 189, 201 and 697. The fasteners 191 can include hex-head sheet metal screws that are one inch long (i.e., #12×1" HH SMS) or some other fastener.

The locking-tab 443 of the joist segments 507 and 509 can be positioned within the locking-tab slot 169 of the box-frame-segment 102A and 104A, respectively, and the locking-tab 435 of the joist segments 507 and 509 can be positioned within the locking-tab slot 163 of the box-frame-segments 102A and 104A, respectively, when the joist assembly 501 is positioned within the deck system 341.

Figure 41:
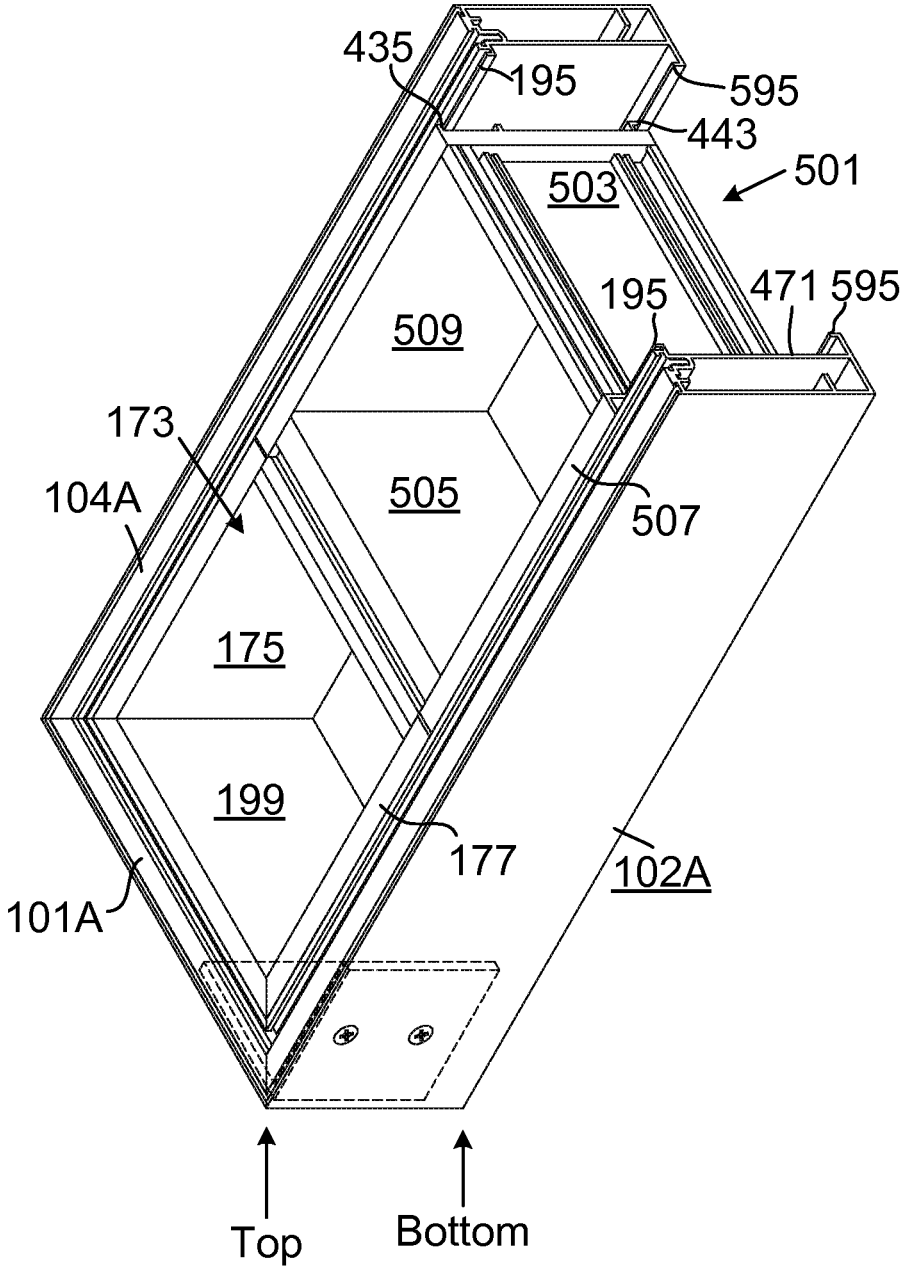

Next, FIG. 41 shows components of a box-frame, such as the deck system 341 shown in FIG. 25. In particular, FIG. 41 shows the box-frame-segment 101A, the box-frame-segment 102A, the box-frame-segment 104A, the box-frame-segment cover 199 attached to the box-frame-segment 101A, the joist assembly 173 attached to the box-frame-segment 102A and the box-frame-segment 104A, and the joist assembly 501 attached to the box-frame-segment 102A, the box-frame-segment 104A, and the joist assembly 173. The locking tabs 435 of the joist spacers 507 and 509 are positioned within the locking-tab slots, formed in part by the locking tab 195, of the box-frame-segments 104A and 102A, respectively. The locking tabs 443 of the joist spacers 507 and 509 are positioned within the locking-tab slots, formed in part by the locking tab 595, of the box-frame-segments 104A and 102A, respectively.

Figure 35:
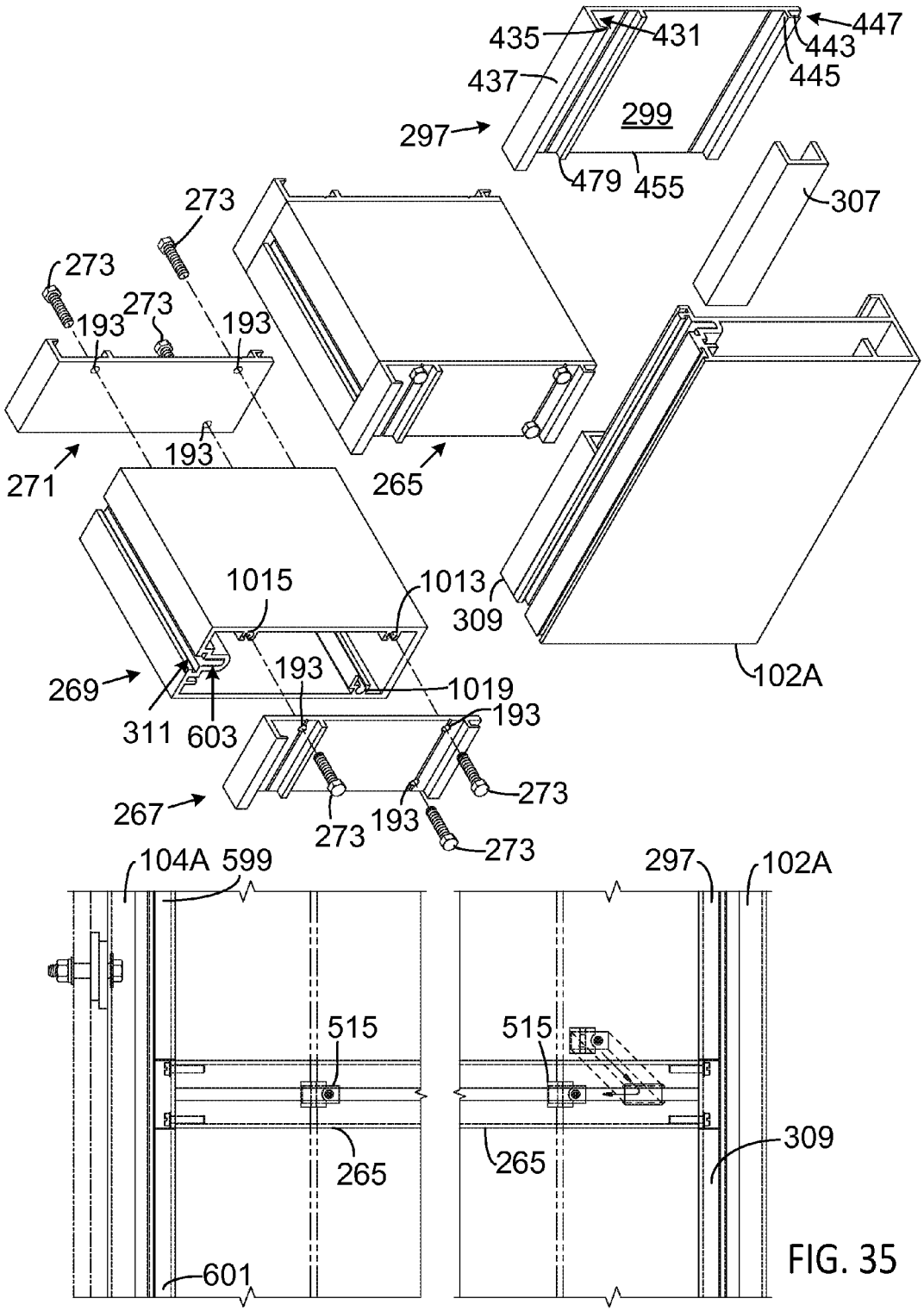
FIG. 35 shows an example single extrusion joist and the joist and joist spacers installed into an example deck system.

Next, FIG. 35 shows a joist assembly 265. The joist assembly 265 includes a joist segment hanger 267, a joist segment 269, a joist segment hanger 271, and fasteners 273. The joist segment hangers 267 and 271 can include extrusions produced from the same or similar extrusion die(s) and, therefore, the joist segment hangers 267 and 271 can have identical features. The joist segment hangers 267 and 271 are examples of box-frame-segment attachments. The joist segment 269 can include a single extrusion produced from another extrusion die. Through-holes 193 can be drilled through the joist segment hangers 267 and 271 at positions that correspond to screw splines 1013, 1015, and 1019 in the joist segment 269. As an example, the fasteners 273 can include number twelve hex-head sheet metal screws that are one inch long (i.e., #12×1" HH SMS) or some other fastener.

The joist assembly 265 can attach to two distinct box-frame-segments of a box-frame. For example, as shown in FIG. 35, the joist assembly 265 can attach to the box-frame-segment 102A and to the opposing box-frame-segment 104A. Other joist assemblies, similar to the joist assembly 265, can be attached to the box-frame-segments 102A and 104A. A joist segment spacer 297 can attach to the box-frame-segment 102A to separate the joist assembly 265 from an adjacent joist assembly attachable to the box-frame-segment 102A. The joist segment spacer 297 can include an extrusion produced from the same or similar extrusion die(s) from which the joist segment hangers 267 and 271 are produced. Therefore, joist segment hangers 267 and 271 can include the same features of the joist segment spacer 297, such as the locking-tab slot 431 and the locking-tab 443. Joist segment spacers 599 and 601 can attach to the box-frame-segment 104A to separate the joist assembly 265 from adjacent joist assemblies attachable to the box-frame-segment 104A.

As shown in FIG. 35, the joist segment spacer 297 includes a vertical element 455, a top horizontal element 437, a locking-tab 435, a horizontal element 445, a locking-tab 443, and an uplift-clip shelf 479. The vertical element 455 has a first side 299 and an opposing side (not shown in FIG. 35. The opposing side of the vertical element 455 can be flat similar to how the visible side of the joist segment hanger 271 appears flat in FIG. 35. The vertical element 455, the top horizontal element 437, and the locking-tab 435 form a locking-tab slot 431. The vertical element 455, the horizontal element 445, and the locking-tab 443 form a locking-tab slot 447. Since the joist segment hangers 267 and 271 and the joist segment spacer 297 can be from the same extrusion, the joist segment hangers 267 and 271 can have the same features as the joist segment spacer 297.

FIG. 35 shows a joist segment spacer 309 attached to the box-frame-segment 102A. The joist segment spacer 309 can be arranged like the joist segment spacer 297. The joist assembly 265 is attachable to the box-frame-segment 102A adjacent to the joist segment spacer 309. An uplift clip 307 can be inserted (e.g., slid) into a uplift-clip slot formed by the joist segment hanger 267. The uplift clip can be supported by an uplift-clip shelf located on the joist segment hanger 267.

The joist segment 269 includes a deck-clip slot 311. One or more deck-clips 515 can be inserted into the deck-clip slot 311. One or more of the deck-clips 515 inserted into the deck-clip slot 311 can be slid within the deck-clip slot to reposition the deck-clip slot 515 for desired placement of deck boards on top of the joist segment 269. The joist segment 269 includes screw splines 603 for retaining a deck-clip screw.

Figure 3:
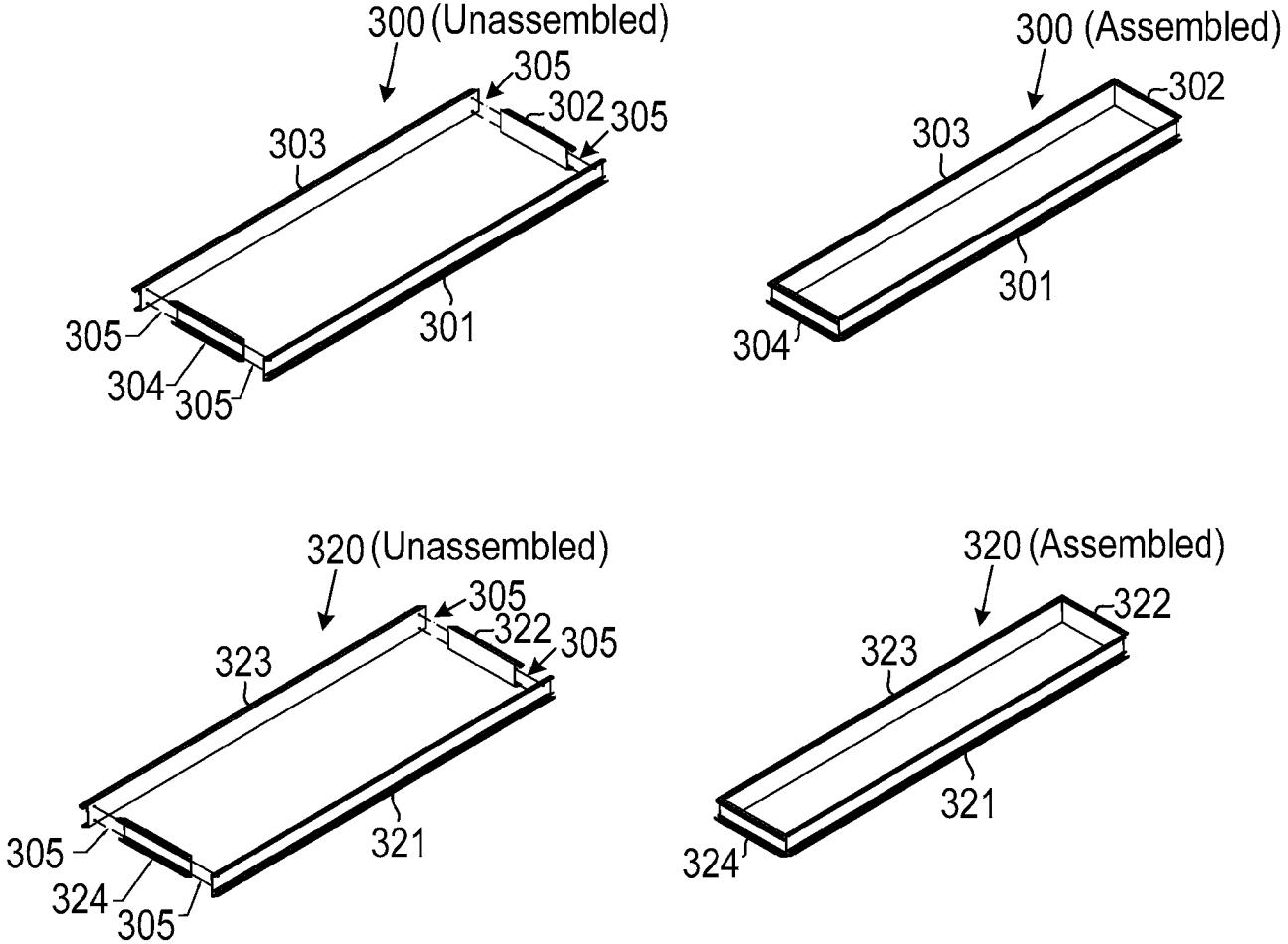
FIG. 3 shows components of joist assemblies in accordance with one or more example embodiments.

Next, FIG. 3 shows example components of additional joist assemblies 300 and 320 usable within an example deck system. The joist assemblies 300 and 320 are shown unassembled and assembled. The joist assemblies 300 and 320 are attachable to and removable from a box-frame, such as the box-frame 100. The joist assemblies 300 and 320 are attachable within a box-frame interior, such as the box-frame interior 112.

The joist assembly components of joist assembly 300 include joist segments 301, 303, joist spacers 302, 304, and fasteners 305. The joist segment 301 can include an aluminum extrusion having a profile like the extrusion 800. The joist segment 303 can include an aluminum extrusion having a profile like the extrusion 825 or the extrusion 850. The joist spacers 302 and 304 can include aluminum extrusions having a profile like the extrusion 850. The fasteners 305 can include number twelve hex-head sheet metal screws that are one inch long (i.e., #12×1" HH SMS) or some other fastener.

The joist segments 301 and 303 can have a common length, such as 6'-0" or some other length. The joist spacers 302 and 304 can have a common length, such as 1'-2" (i.e., 14 inches), or some other length. The common length of the joist spacers 302 and 304 can depend on a thickness of deck boards to be attached to the deck system. The common length of joist the segments 301 and 303 is typically a length that allows the joist segment 303 to be attached to the box-frame-segment 101, the joist spacer 302 to be attached to the box-frame-segment 104, and the joist spacer 304 to be attached to the box-frame-segment 102, all within the box-frame interior 112 when assembled as the joist assembly 300.

The joist assembly components of the joist assembly 320 include the joist segments 321, 323, the joist spacers 322, 324, and the fasteners 305. The joist segment 323 can include an aluminum extrusion having a profile like the extrusion 825 or the extrusion 850. The joist segment 321 and the joist spacers 322 and 324 can include aluminum extrusions having a profile like the extrusion 850.

The joist segments 321 and 323 can have a common length, such as 6'-0" or some other length. The joist spacers 322 and 324 can have a common length, such as 1'-2" (i.e., 14 inches), or some other length. The common length of the joist spacers 322 and 324 can depend on a thickness of deck boards to be attached to the deck system. The common length of the joist segments 321 and 323 is typically a length that allows the joist segment 321 to be attached to the box-frame-segment 103, the joist spacer 322 to be attached to the box-frame-segment 104, and the joist spacer 304 to be attached to the box-frame-segment 102, all within the box-frame interior 112 when assembled as the joist assembly 320. The joist segment 323 can attach to another joist assembly installed with the box-frame interior.

Figure 4:
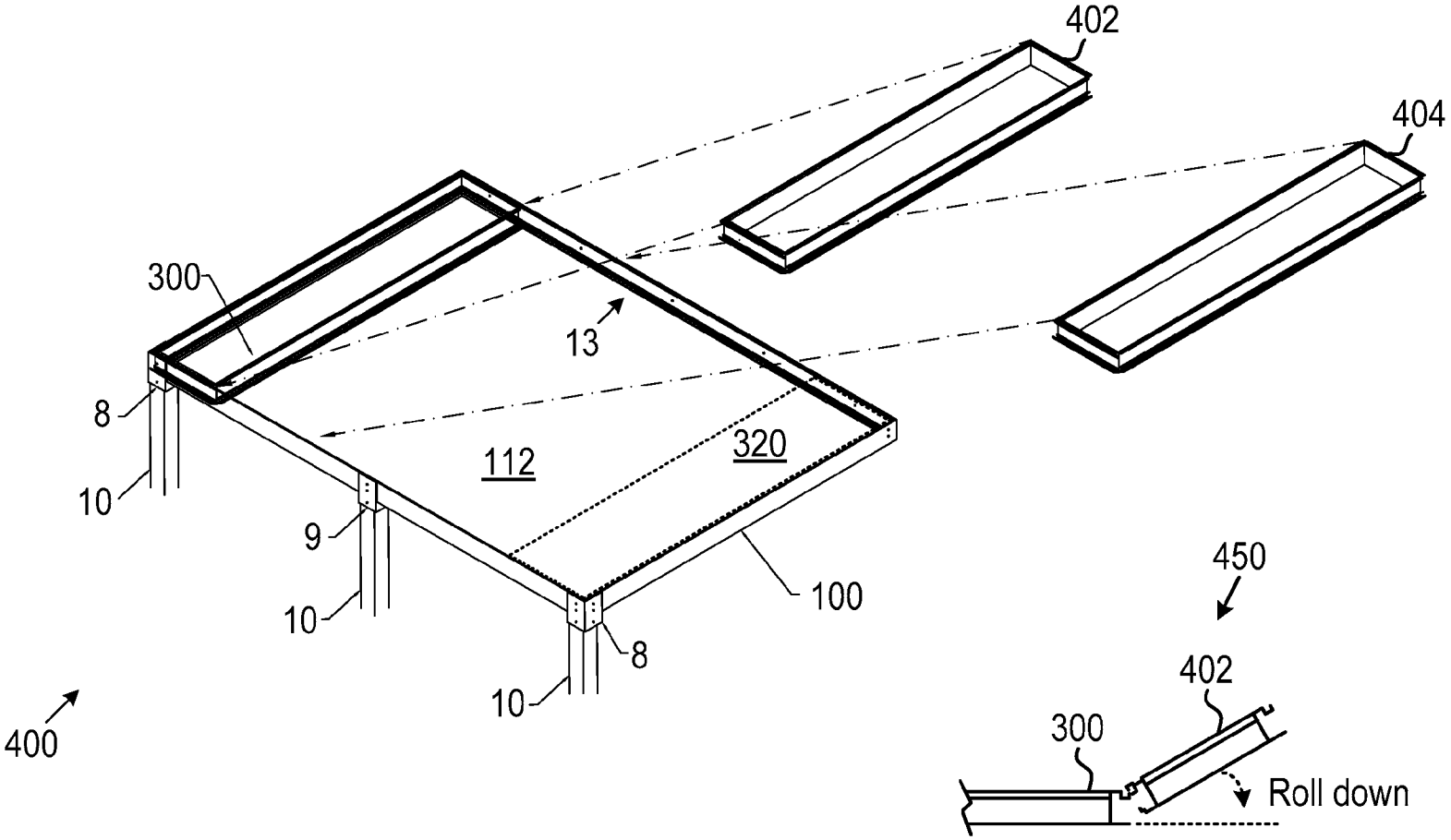
FIG. 4 shows a deck system under construction in accordance with one or more example embodiments.

Next, FIG. 4 shows an example deck system 400 under construction. Deck system 400 includes the box-frame 100, the joist assembly 300 installed within the interior 112 of the box-frame 100, corner-post brackets 8, intermediate-post bracket 9, and posts 10. FIG. 4 also shows additional joist assemblies 402 and joist assembly 404 prior to installation into the deck system 400. The joist assemblies 402 and 404 can be arranged like the joist assembly 300. The short dashed lines within the box-frame 100 represent a location at which the joist assembly 320 can be installed into the deck system 400, typically after all other joist assemblies to be installed into the box-frame 100 have been installed.

In accordance with one or more example embodiments, a first installed joist assembly and all intermediate joist assemblies can be arranged like the joist assembly 300, and a last installed joist assembly can be arranged like the joist assembly 320. The intermediate joist assemblies are installed between the joist assemblies 300 and 320. The portions of two joist segments that abut one another and the portion of a joist segment or joist spacer that abuts a box-frame-segment can have, in combination, a roll-lock tab and a roll-lock tab receiver, as discussed with respect to FIG. 8. The roll-lock tab is positioned within the roll-lock tab receiver to secure attachment of the abutting joist segments, joist spacers, or box-frame-segments.

FIG. 4 shows a side view 450 in which joist assembly is installed within the box-frame interior 112 (without showing box-frame interior 112) and the joist assembly 402 is being attached to the joist assembly 300 and to the box-frame interior 112. A roll-lock tab receiver of the joist assembly 300 receives a roll-lock tab of the joist assembly 402 and then the joist assembly 402 is rolled down (e.g., rotated downward) so that the roll-lock tabs of the joist spacers of the joist assembly 402 enter into the roll-lock tab receivers of the box-frame interior 112. Other joist assemblies, such as the joist assembly 404 can be similarly installed within the box-frame interior 112.

Side 13 of the box-frame 100 can be attached to the example structure discussed herein. In an alternative arrangement, the box-frame 100 can include additional corner-post brackets 8 and an intermediate-post bracket on the side 13. The posts 10 can include a post made of wood, aluminum, a composite material, or some other material. A wooden post can include pressure treated wood. The wood can be cedar, a hardwood, or some other wood. The posts 10 can be referred to as four-by-four posts. The four-by-four posts may not have a four inch width and four inch depth. A bottom portion of the posts 10 can be placed upon concrete footers or upon brackets positioned on concrete footers within the ground below the deck system 400. More than one intermediate-post bracket and respective post 10 can be used on any given side of an example deck system.

In an alternative arrangement, the joist assembly 173 can be installed within the deck system 400 in place of the joist assembly 300, and the joist assembly 501 can be installed within the deck system 400 and to the joist assembly 300 in place of the joist assemblies 402 and 404. Accordingly, the joist assembly 501 can be rolled down into the deck system 400 in the manner in which FIG. 4 shows the joist assembly 402 being rolled down into the deck system 400. The final joist assembly installed within the deck system 400 can include another three-piece joist assembly along with another box-frame-segment cover like box-frame-segment cover 199.

Figure 5:
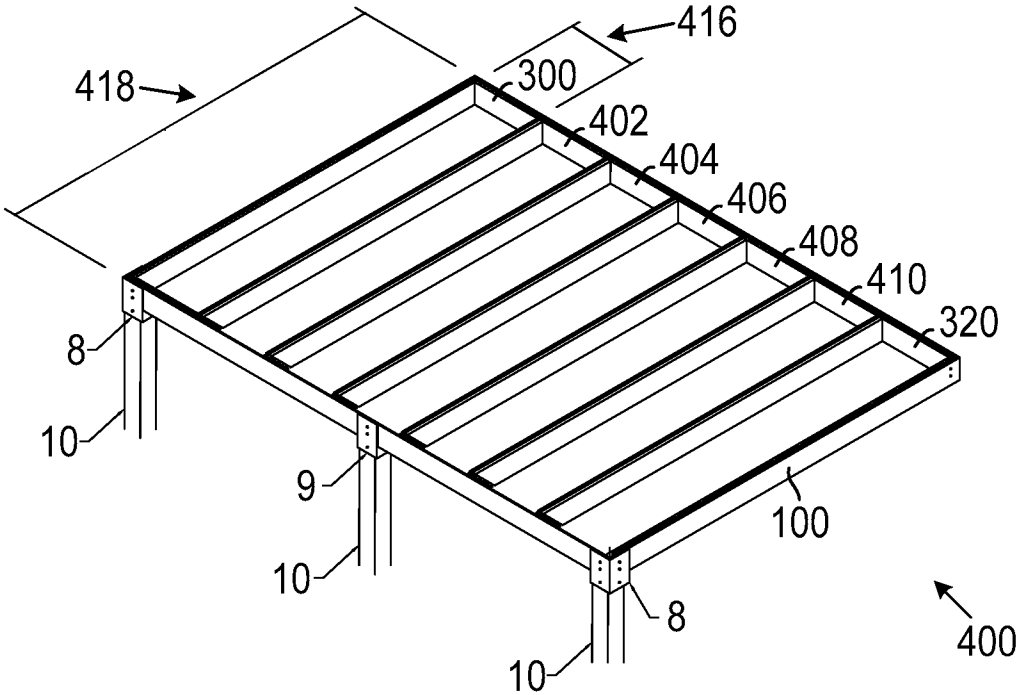
FIG. 5 shows details of the deck system shown in FIG. 4.

Next, FIG. 5 shows additional details regarding the deck system 400. The joist assemblies 300, 402, 404, 406, 408, 410, and 320 are installed within the box-frame 100. A person having ordinary skill in the art will understand that a different quantity of joist assemblies can be installed within box-frame. Corner-post brackets 8, intermediate-post bracket 9, and posts 10 of deck system 400 are described elsewhere herein.

FIG. 5 shows dimensions 416 and 418 to provide perspective of the example deck systems. The dimension 416 can represent any of a variety of lengths, such as a length between center lines of the longitudinal joists of the joist assembly 300, a length between ends of joist segments of the joist assembly 300, or a length of a joist spacer of the joist assembly 300. As an example, the dimension 416 can be 1'-2" (i.e., 14 inches), or some other number of inches. A dimension similar to dimension 416 can pertain to the other joist assemblies of the deck system 400.

The dimension 418 can represent any of a variety of lengths, such as the lengths of the longitudinal joists within the joist assemblies 300, 402, 404, 406, 408, 410, and 320 or a longitudinal length of each of those joist assemblies including the joist spacers. As an example, the dimension 418 can be 6'-0" (i.e., 72 inches) or some other number of inches.

C. Deck Boards

Figure 6:
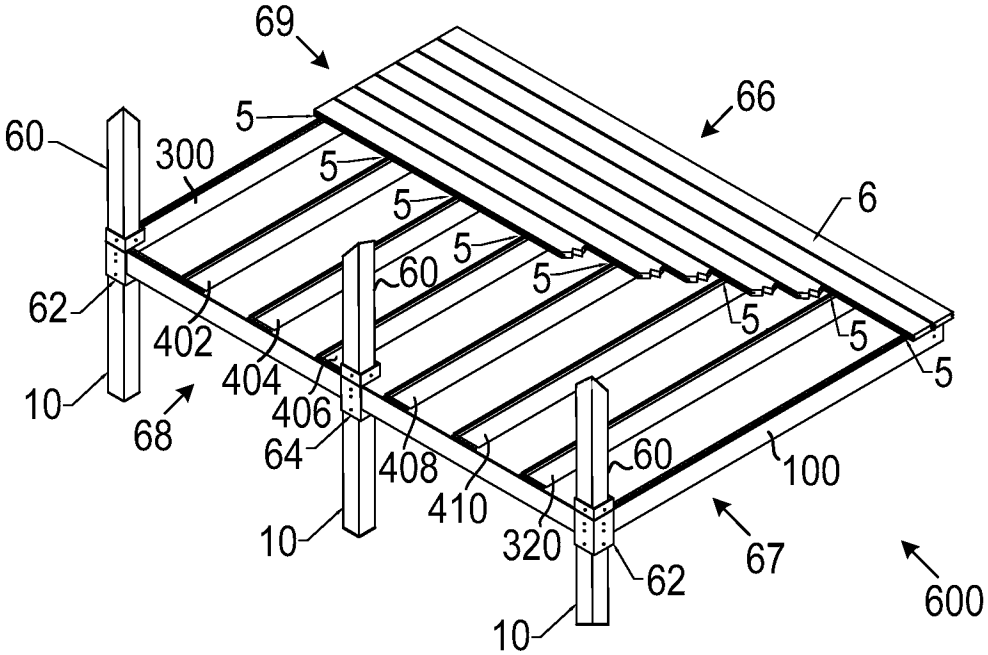
FIG. 6 shows another deck system in accordance with one or more example embodiments.

Next, FIG. 6 shows an example deck system 600. The deck system 600 includes the box-frame 100 including the joist assemblies 300, 402, 404, 406, 408, 410, and 320. The deck system 600 includes the posts 10, railing posts 60, corner-post brackets 62, and intermediate-post bracket 64. Four sides 66, 67, 68, 69 of the deck system 600 are identified in FIG. 6. The deck system 600 can include one or more additional intermediate-post brackets 9 or 62 along sides 66, 67, 68, or 69. The deck system 600 can include one or more additional corner-post brackets 8 or 64 at corners of the box-frame 100.

The deck system 600 includes a plurality of deck-clips 5 and a plurality of deck boards 6. A separate deck-clip 5 can be attached to each joist between each pair of adjacent deck boards 6. The deck-clips 5 can establish a substantially common spacing between each adjacent pair of deck boards 6. The spacing between the deck boards 6 can allow for water to fall between the deck boards 6 to reduce ponding of the water on the deck boards 6. The substantially common spacing can, for example, be within a range of one sixteenth of an inch (i.e., 1/16") and one half inch (i.e., ½"), inclusive.

The deck boards 6 extend perpendicular to the longitudinal portion of the joist assemblies 300, 402, 404, 406, 408, 410, and 320. A single deck board 6 can extend completely across box-frame 100. Alternatively, two or more deck boards 6 can be used to extend across box-frame 100 instead of one of the single deck boards that extend across box-frame 100. A deck board 6 extending across box-frame 100 can include a portion (e.g., a one inch portion) that extends beyond box-frame 100. The deck boards 6 can include a deck board made of wood, aluminum, polyvinyl chloride (PVC), a composite material, or some other material. The wooden boards can include pressure treated wood, cedar, a hardwood, or some other wood.

The other deck systems described herein as having deck boards can include the deck boards 6. The deck boards can be oriented in orientations other than extending perpendicular to the longitudinal portion of a joist assembly. As an example, the deck boards 6 can be rotated a number of degrees (e.g., 45 degrees) from the orientation in which the deck boards extend perpendicular to the longitudinal portion of the joists. The deck-clips 565 or the deck-clips 605 can be used for positioning and attaching the deck boards 6 in those different orientations.

The box-frame 100, at side 66, can be attached to the example structure discussed herein. In an alternative arrangement, the box-frame 100 of can include additional corner-post brackets 62 and an intermediate-post bracket 64 on side 66. The posts 60, similar to the posts 10, can include a post made of wood, aluminum, a composite material, or some other material. The posts 60, similar to the posts 10, can be referred to as four-by-four posts.

The corner-post brackets 62 and the intermediate-post bracket 64 include a portion extending above the box-frame 100. The posts 60 can be inserted into those bracket portions and attached to the corner-post brackets 62 and the intermediate-post bracket 64 using any of a variety of fasteners. Horizontal railing components (not shown) can be attached to the posts 60. The horizontal railing components can include an upper horizontal railing component and a lower horizontal railing component. A plurality of spindles or balusters can be attached to and between the horizontal railing components.

Figure 7:
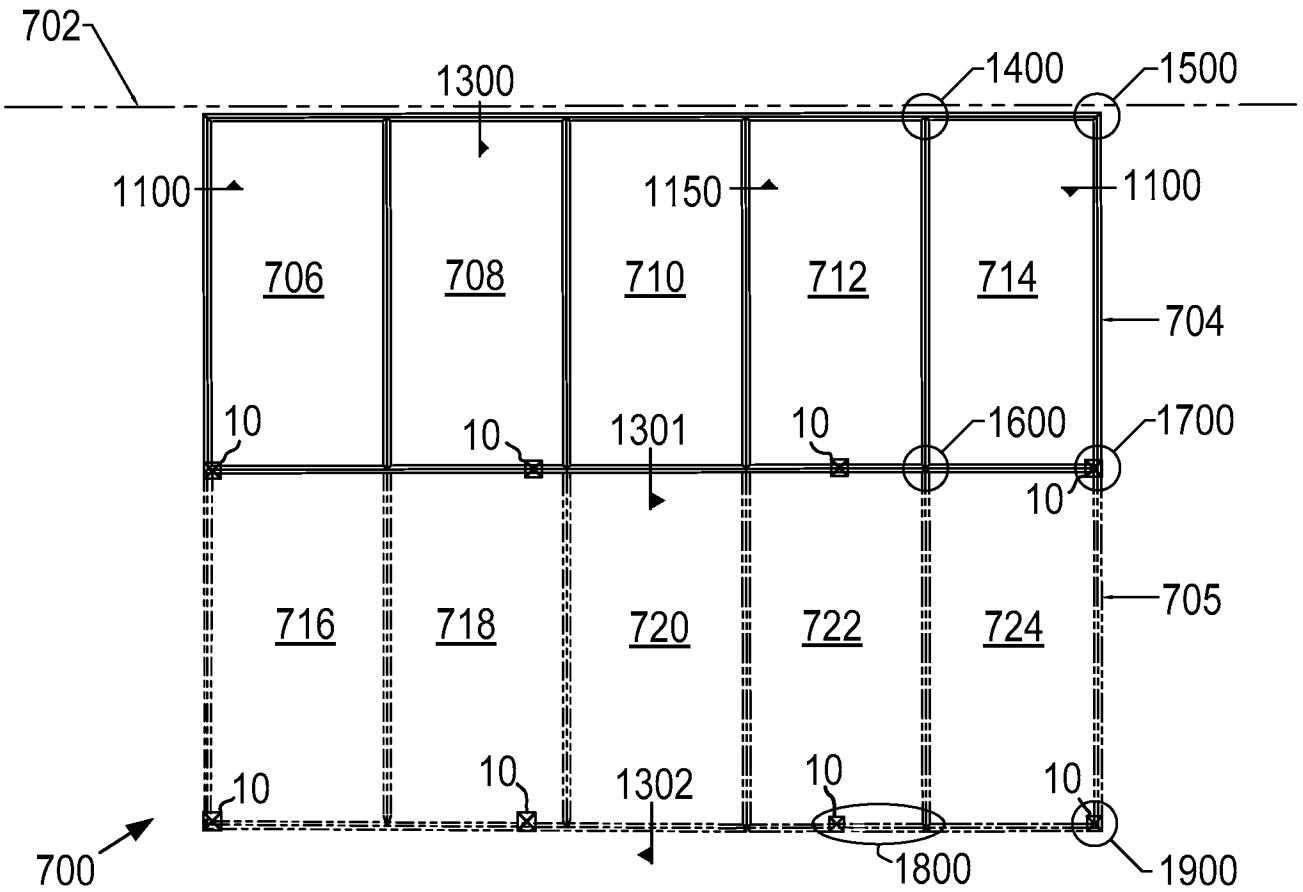
FIG. 7 shows another deck system in accordance with one or more example embodiments.

Next, FIG. 7 shows an example deck system 700 including deck systems 704 and 705. The deck system 704 is positioned adjacent to a structure 702. The structure 702 can be configured like the structures discussed herein. The deck system 704 is removably attachable to the structure 702. For purposes of this description, removably attachable means a first element (such as the deck system 704) can be attached to a second element (such as the structure 702) and the first element can be unattached from and removed away from the second element. The attachment and un-attachment of the first and second elements can be repeated one or more times.

The deck system 704 includes joist assemblies 706, 708, 710, 712, and 714. One of the joist assemblies 706 and 714 can be configured like the joist assembly 320 or the joist assembly 173, while the other of those joist assemblies and the joist assemblies 708, 710, and 712 can be configured like the joist assembly 300 or the joist assembly 501. Alternatively, the deck system 704 can include joists like the joist 265 and joist spacers like the joist spacers 297 and 309 in place of one or more of the joist assemblies described with respect to the deck system 704.

The deck system 705 includes joist assemblies 716, 718, 720, 722, and 724. One of the joist assemblies 716 and 724 can be configured like the joist assembly 320, while the other of those joist assemblies and the joist assemblies 718, 720, and 722 can be configured like the joist assembly 300.

A number of posts 10 can be used to support the deck system 700 above the ground. Each post 10 that supports the deck system 700 can be positioned within a corner-post bracket (such as corner-post bracket 9 or 64) or within an intermediate-post bracket (such as intermediate-post bracket 8 or 62).

Figure 11:
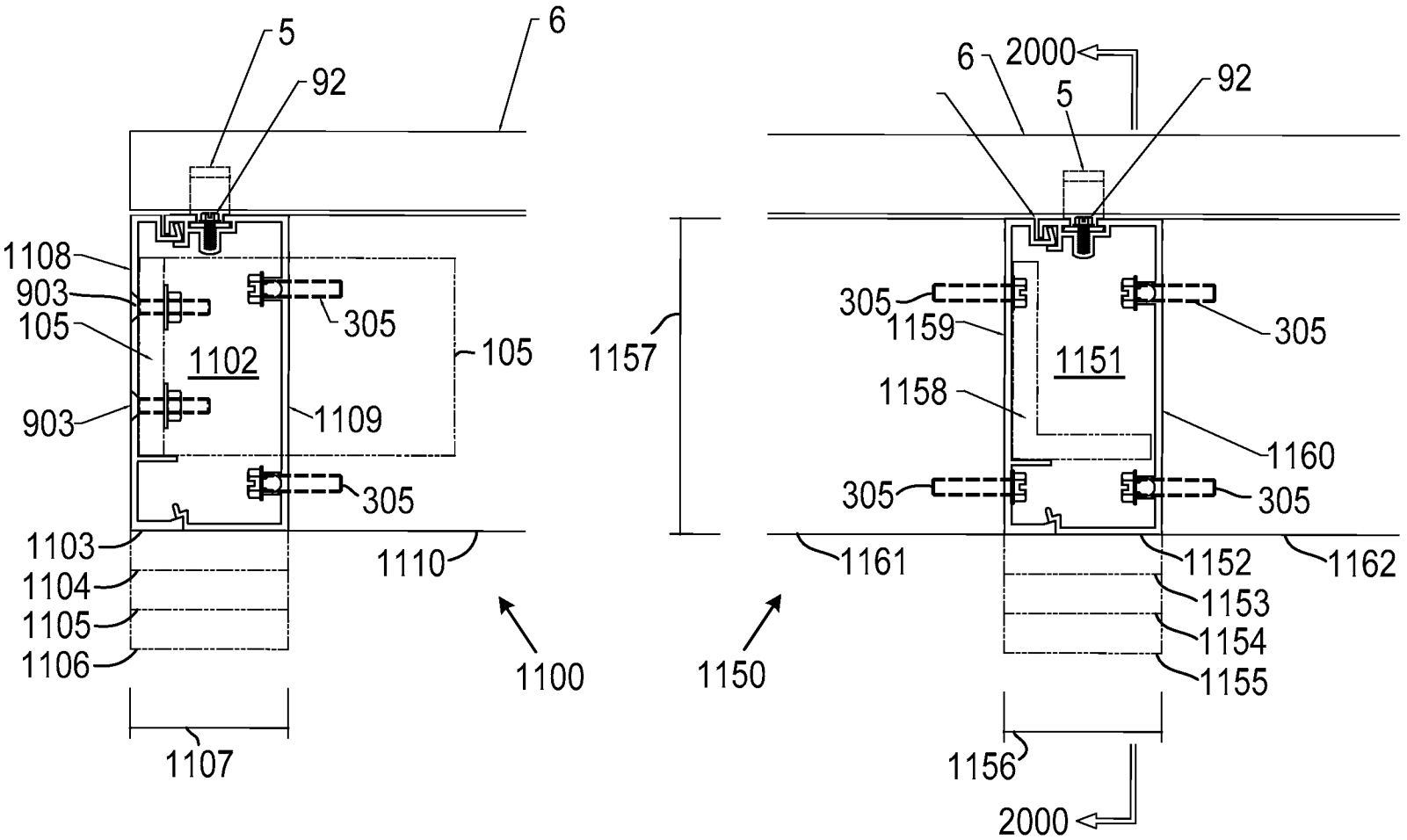
FIG. 11 shows partial section views shows in accordance with one or more example embodiments.
Figure 13:
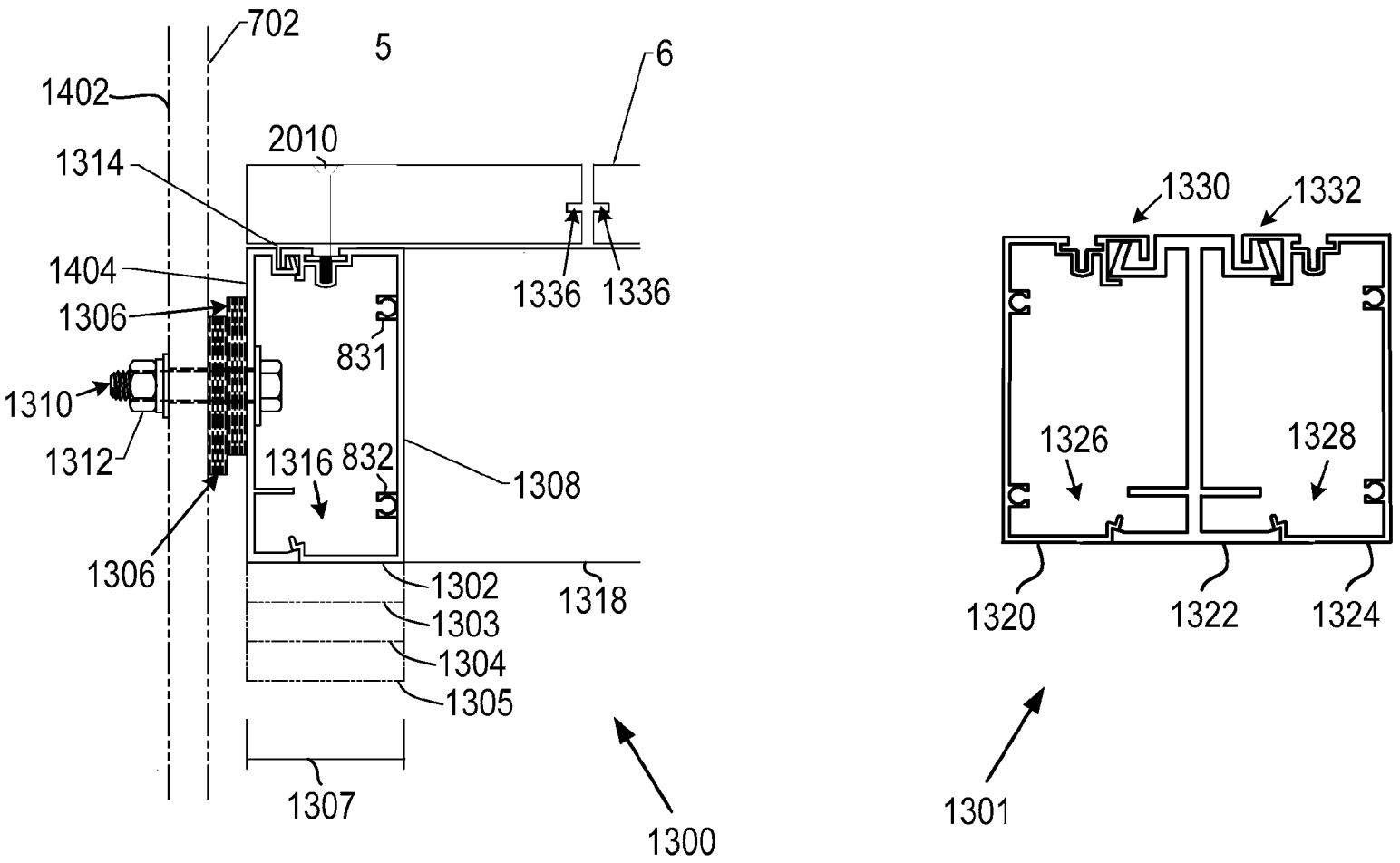
FIG. 13 shows a partial section view of a deck system in accordance with one or more example embodiments.

FIG. 7 shows example locations within the deck system 700 at which partial section views 1100, 1150, 1300, 1301, and 1302, shown in FIG. 11 and FIG. 13 can be taken. A partial section view taken at line 1302 in FIG. 7 is not shown, but would look like section view 1300 in FIG. 7 without the following items: structure lines 702 and 1402, fasteners 1310 and 1312, and shims 1306. FIG. 7 also shows portions 1400, 1500, 1600, 1700, 1800 and 1900 at which large-scale views shown in FIG. 14 through FIG. 19 pertain.

Next, FIG. 25 shows components of a deck system 341 and deck system features 1053 for an alternative arrangement of the deck system 341. The deck system 341 includes a box-frame perimeter (also known as a "perimeter box-frame," or more simply as a "box-frame," a "deck perimeter", or a "deck-frame") 100A that includes box-frame-segments 101A, 102A, 103A, and 104A. Details corresponding to the box-frame-segments 101A, 102A, and 104A are shown in FIG. 36 and FIG. 37. The box-frame-segment 103A can be identical to the box-frame-segment 101A. The deck system 341 includes joists 343, 345, 347, 349, and 351.

In a first respect for the deck system 341, the joists 343, 345, 347, 349, and 351 can each include a joist assembly like the joist assembly 265 shown in FIG. 35. A joist segment hanger, like the joist segment hangers 267 and 271, can attach to the box-frame-segments 102A and 104A. Joist segment spacers, such as the joist spacer segment 297, can be positioned on the box-frame-segments 102A and 104A between each of the joists 343, 345, 347, 349, and 351, and between the joist 343 and the box-frame-segment 101A, and between the joist 351 and the box-frame-segment 103A. A box-frame-segment cover, like the box-frame-segment cover 199, can be attached to the box-frame-segment 101A and another can be attached to the box-frame-segment 103A.

In a second respect for the deck system 341, the joist 343 can be part of a joist assembly like the joist assembly 173 shown in FIG. 38, and the joists 345, 347, 349, and 351 can be part of a joist assembly like the joist assembly 501 shown in FIG. 40.

FIG. 25 shows the box-frame-segments 101A, 102A, and 103A are straight box-frame-segments. The box-frame attachments attached to each of the box-frame-segments are straight box-frame attachment. One or more of the box-frame-segments 101A, 102A, 103A, and 104A and the box-frame attachments attached thereto are straight box-frame attachments. One or more of the box-frame-segments and the corresponding box-frame attachment can be curved. The curve of a curved box-frame-segment may be such that a center point of box-frame-segment is furthest away from a box-frame-segment on the opposite side of the box-frame perimeter. A curved box-frame-segment and a curved box-frame attachment can include a rolled extrusion. The joists, joist segments, or joist assemblies that attach to a curved box-frame-segment can be miter cut for mounting flush to the curved box-frame-segment.

FIG. 25 illustrates a 90° deck-clip 515 installed in the joist 345, a 45° deck-clip 565 installed in the joist 347, and a 135° deck-clip 605 installed in the joist 349. The lines passing through the deck-clips 515, 565, and 605 represent an orientation of deck boards that can be attached to the deck system 341 by use of those deck-clips.

The deck system 341 can be supported by an existing structure. For instance, the box-frame-segment 104A can be fastened to the structure. As another example, one or more posts can be positioned in or on the ground and attached to the deck system 341. FIG. 25 shows example posts (or brackets) 359, 361, 363, 365, 367, 369, 371, 373, and 375 that can be used to support the deck system 341. One or more of the posts 359, 361, 363, 365, 367, 369, 371, 373, and 375 can attach to the deck system 341 using a post bracket as described herein or a different type of post bracket or with a bracket integral to the post.

The deck system features 1053 include a support beam 1061 extending from a post (or bracket) 1063 to a post (or bracket) 1071. The post (or bracket) 1063 and the post (or bracket) 1071 can each include a 4 inch×4 inch by 0.25 inch aluminum post. The joists 343, 345, 347, 349, and 351 extend to the box-frame-segment 102A or to a box-frame-segment attachment attached to the box-frame-segment 102A. FIG. 25 identifies detail areas 1051, 1055, 1057, and 1059 that pertain to the deck system features 1053. Details pertaining to those detail areas are shown in FIG. 31 to FIG. 34. The support beam 1061 and the posts supporting the support beam 1061 allow for portions of the deck system 341 (i.e., portions of the box-frame 101A, 102A, 103A and the joists 343, 345, 347, 349, and 351 to cantilever beyond the support beam 1061.

D. Deck-Clips

Figure 12:
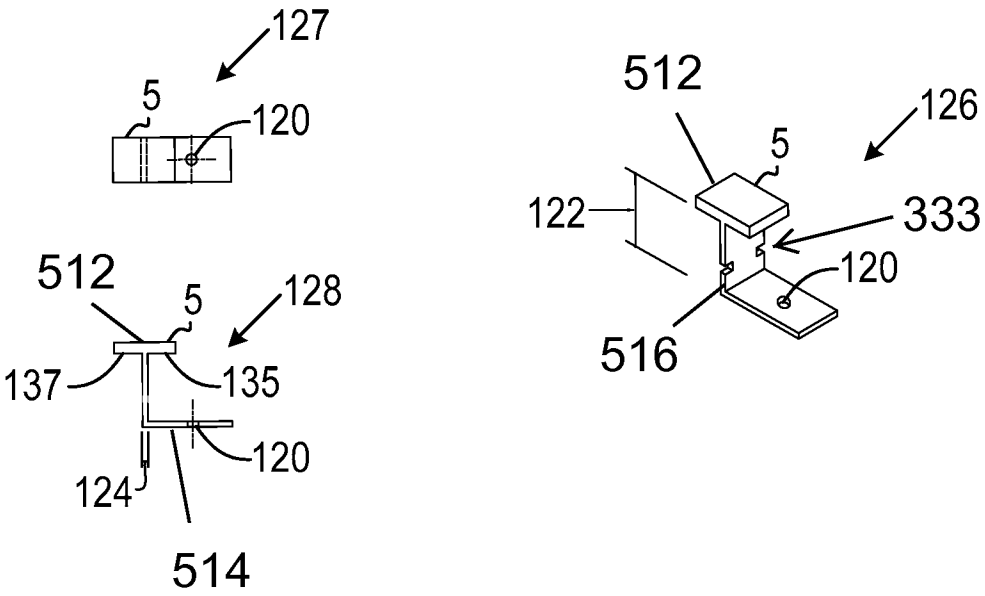
FIG. 12 shows various views of a deck-clip in accordance with one or more example embodiments.

Next, FIG. 12 shows a deck-clip 5. FIG. 12 includes an isometric view 126 of the deck-clip 5, a top view 127 of the deck-clip 5, and a side view 128 of the deck-clip 5. The deck-clip 5 includes a deck board retainer 512 including deck board retaining surfaces 135 and 137 to retain deck boards to the joist assemblies. The deck-clip 5 includes a base 514 and a vertical element 516 extending from the base 514 to the deck-clip retaining surfaces 135 and 137. The deck-clip 5 can include a through-hole 120 in the base 514 for insertion of a deck-clip screw 92. The deck-clip 5 can be made of steel (e.g., stainless steel), aluminum, plastic, or some other material. Dimensions 122, 124 can be any of a variety of dimensions. The dimension 122 can depend upon a height (e.g., depth) of deck boards 6, or a height of a deck-clip slot positioned along a side of a deck board 6, used within a deck system. As an example, the dimension 122 can equal 0.625 inches or some other dimension. As an example, the dimension 124, a thickness of deck-clip 5, can equal 0.0625 inches or some other dimension. The size of the deck-clip 5, such as the depth and thickness dimensions, can vary per requirements of the deck boards installed onto the deck system. The deck-clip 5 is an example of a 90° deck-clip. As an example, the deck-clip 5, as well as any other deck-clip described herein, can include a plastic deck-clip, a metal deck-clip, or a deck-clip having a metal portion and a plastic portion.

Figure 27:
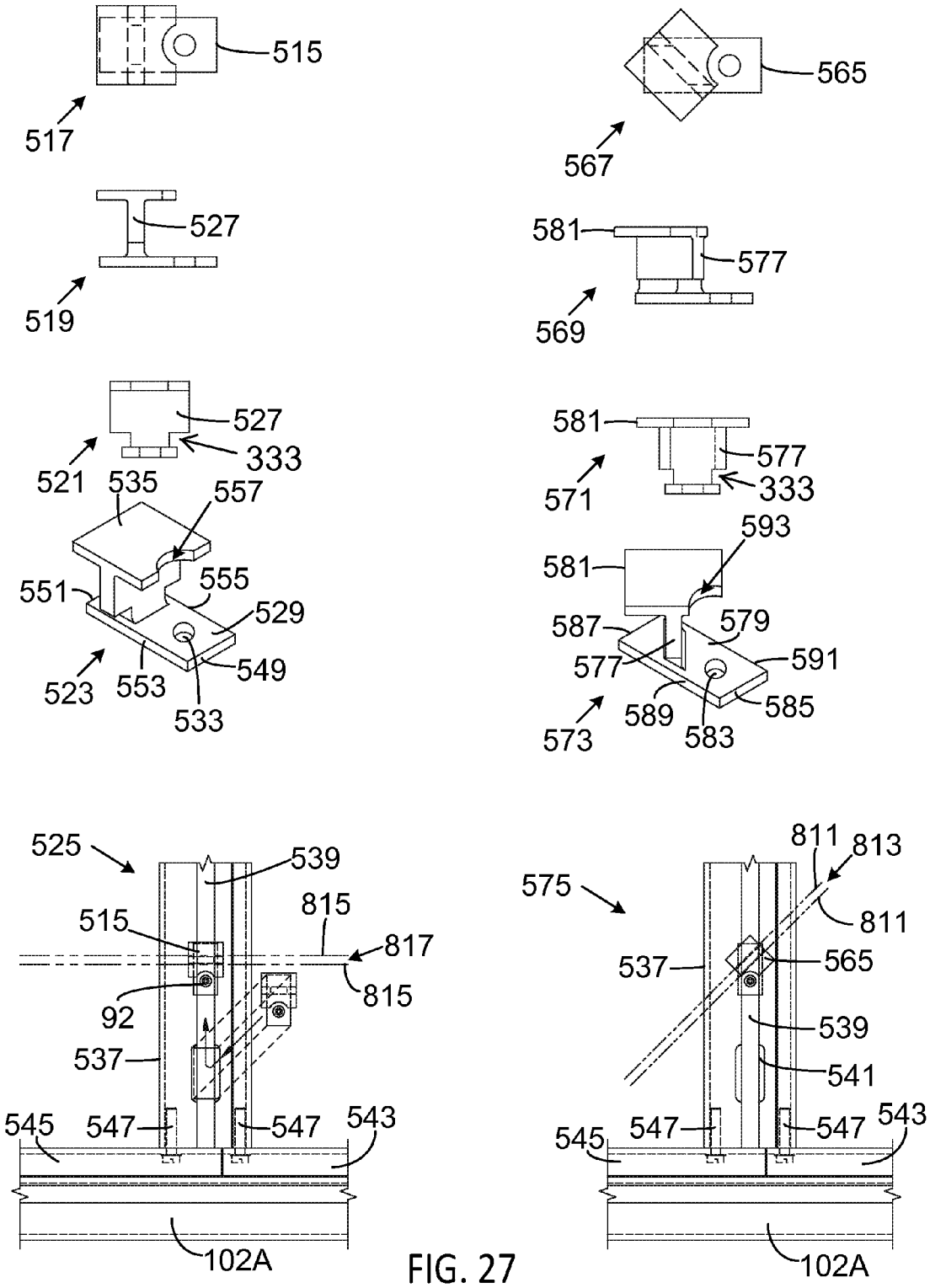
FIG. 27 shows example deck-clips and deck board layout using the deck-clips.
Figure 28:
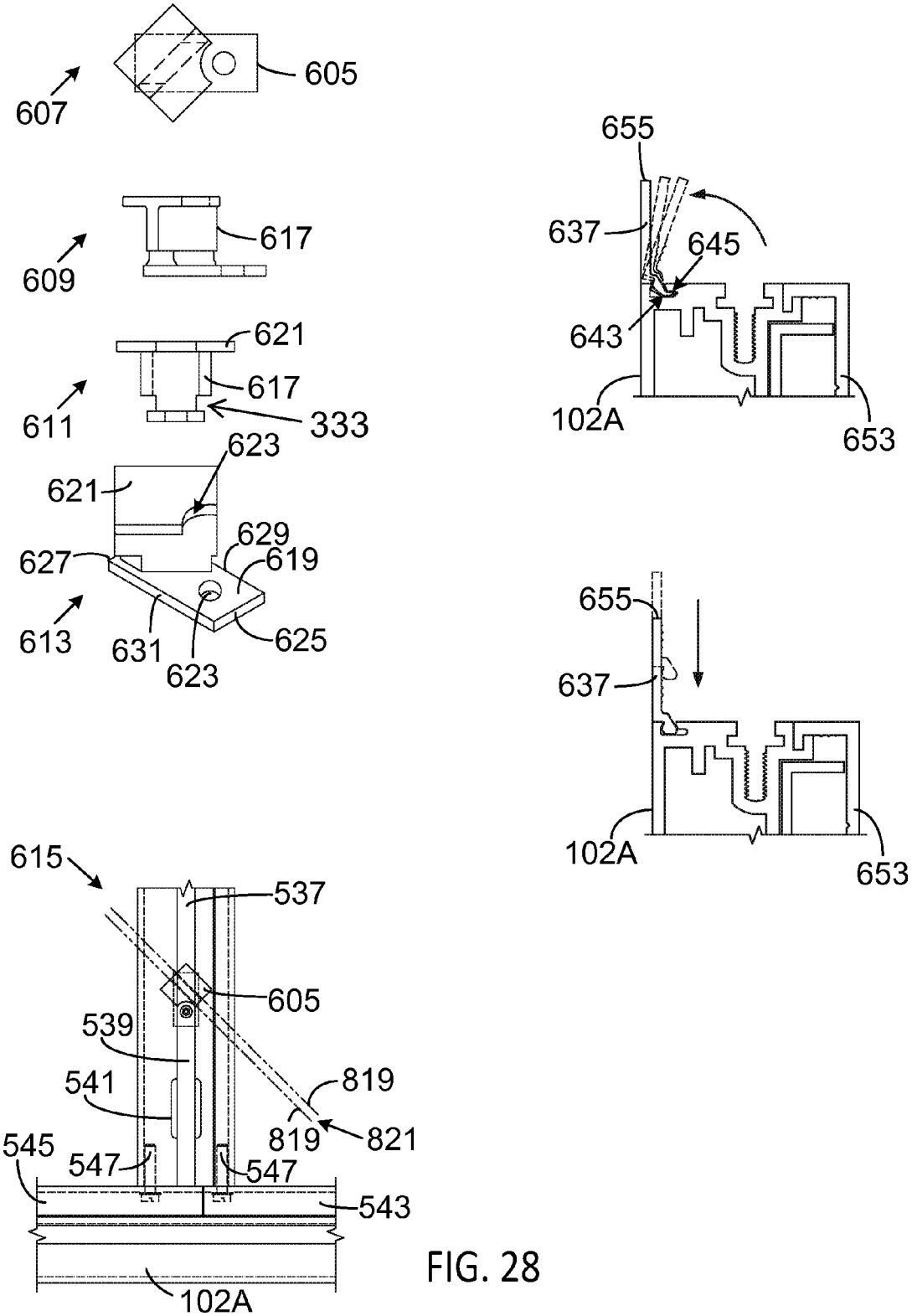
FIG. 28 shows an example deck-clip and deck board layout using the deck-clip, and example installation of a perimeter-trim-piece.

The vertical element 516 includes a notched area 333. The notched area 333 includes a first notch and a second notch accessible from opposing sides of the vertical element 516. The first notch and the second notch allow a portion of a respective tab (such as tabs 329 and 331 shown in FIG. 26) of a deck component with a deck-clip slot (such as a joist, joist segment, or box-frame segment) to be positioned in between upper and lower portions of the vertical element 516. In an alternative arrangement, the notched area 333 can begin at the base 514 such that the lower portion of the vertical element 516 includes only the portion between the first notch and the second notch. Examples of a notched area 333 beginning at a base of a deck clip are shown in FIG. 27 and FIG. 28. Portions of the base 514 and the lower portion of the vertical segment 516 can be positioned within recessed areas of a deck-clip slot (such as the recessed areas 325 and 327 of the deck-clip slot shown in FIG. 26). The other portions of the base 514 and the lower portion of the vertical segment 516 can be positioned between the recessed areas of the deck-clip slot.

Figure 20:
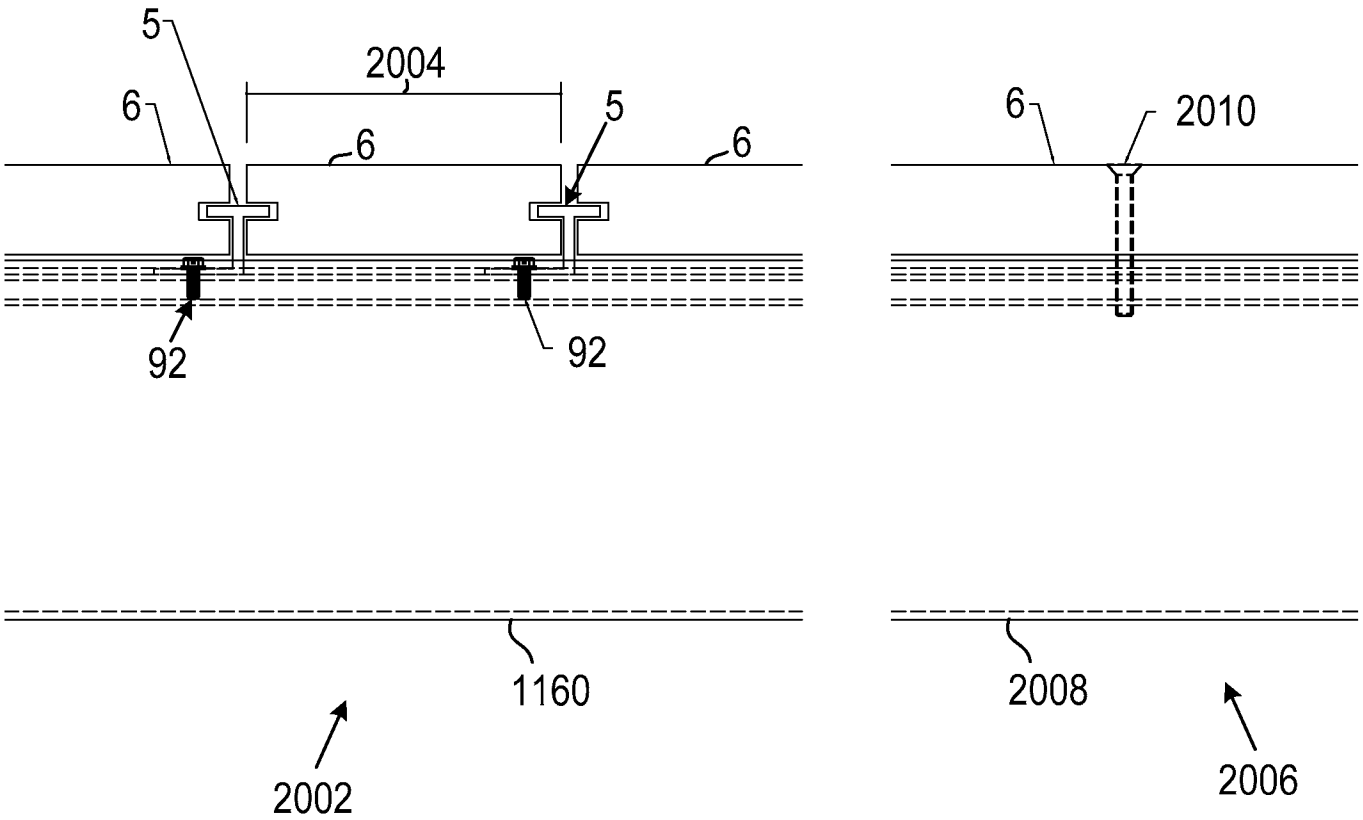
FIG. 20 shows partial section views with respect to section lines shown in FIG. 11.

Next, FIG. 20 shows a partial section view 2002 with respect to section lines 2000 shown in FIG. 11. The partial view 2002 shows deck-clips 5 secured to a joist segment 1160 using fasteners 92. The deck-clips 5 provide for spacing for deck boards 6 and for attachment of deck boards 6 to joist segment 1160. FIG. 20 shows an alternative partial section view 2006 showing a deck board 6 attached to an extrusion 2008, such as a joist segment, using a deck screw 2010. The deck screw 2010 provides an alternative manner for attaching deck boards 6 to a deck system. The deck screw 2010 can be inserted through a deck-clip slot (such as the deck-clip slot shown in FIG. 26) and into deck-screw splines (such as the deck-screw splines 422 shown in FIG. 26).

Next, FIG. 27 shows a deck-clip 515. FIG. 27 includes a top view 517 of the deck-clip 515, a side view 519 of the deck-clip 515, a front view 521 of the deck-clip 515, an isometric view 523 of the deck-clip 515, and installation view 525 of the deck-clip 515. The deck-clip 515 can be referred to as a 90° deck-clip. The deck-clip 515 includes a base 529, a vertical element 527, and a deck board retainer 535. The base 529 includes a through-hole 533 for insertion of a deck-clip screw 92 into deck-screw splines (such as the deck-screw splines 422 shown in FIG. 26). The deck-clip screw 92 can keep the deck-clip 515 at a desired position within a joist 537. The vertical element 527 is perpendicular to the base 529 and to the deck board retainer 535. The base includes short edges 549 and 551 and long edges 553 and 555. The vertical element 527 is parallel to the short edges 549 and 551. The deck board retainer 535 includes a notch 557 to allow the deck-clip screw 92 to be installed without tilting the deck-clip screw 92.

The deck-clip 515 includes a notched area 333 within the vertical element 527 beginning at the base 529. A height of a first notch and a second notch accessible from opposing sides of the vertical element 527 can be slightly greater than a height of tabs (such as tabs 329 and 331 shown in FIG. 26) which will pass through the notched area 333. After being installed into a deck-clip slot, the portions of the base 529 that are wider than the portion of the vertical element 527 at the notched area 333 can prevent the deck-clip 515 from being lifted upward out of the deck-clip slot as that wider portion of the base 529 contacts or would contact the lower portion of the tabs 329 and 331 if upward movement of the deck-clip is attempted. The deck-screw 92 passing through the through-hole 533 and into deck-screw splines can also prevent the deck-clip 515 from being lifted upward out of the deck-clip slot.

As shown in the installation view 525, the deck-clip 515 is adapted to provide spacing between deck boards that are positioned perpendicular to the joist 537 in which the deck-clip 515 is installed. The joist 537 includes a deck-clip slot 539. A milled-portion 541 of the of the joist 537 can include a portion of the joist 537 that is milled to allow the base 529 to be inserted into the deck-clip slot 539. The milled-portion 541, and any other milled-portion, for inserting a deck-clip can be referred to as a "deck-clip insertion point." Once the deck-clip 515 is slid within the deck-clip slot 539 away from the milled portion 541, the joist 537 prevents the deck-clip 515 from being lifted upward (e.g., vertically) out of the joist 537. The partial deck assembly shown in the installation view 525 includes the box-frame-segment 102A, a joist spacer 543, a joist spacer 545, and fasteners 547. As an example the fasteners 547 can include 1.0 inch #12 hex head sheet metal screws. The box-frame segments, joist segments, and other joists can include a deck-clip insertion point similar to the milled portion 541 to allow for insertion of a deck-clip into a deck-clip slot.

FIG. 27 shows a deck-clip 565. FIG. 27 includes a top view 567 of the deck-clip 565, a side view 569 of the deck-clip 565, a front view 571 of the deck-clip 565, an isometric view 573 of the deck-clip 565, and installation view 575 of the deck-clip 565. The deck-clip 565 can be referred to as a 45° deck-clip. The deck-clip 565 includes a base 579, a vertical element 577, and a deck board retainer 581. The base 579 includes a through-hole 583 for insertion of a deck-clip screw 92 into deck-screw splines (such as the deck-screw splines 422 shown in FIG. 26). The deck-clip screw 92 can keep the deck-clip 565 at a desired position within the joist 537. The vertical element 577 is perpendicular to the base 579 and to the deck board retainer 581. The base 579 includes short edges 585 and 587 and long edges 589 and 591. The vertical element 577 is rotated 45° with respect to a corner of the base 579 formed by the short edge 577 and the long edge 591. The deck board retainer 581 includes a notch 593 to allow the deck-clip screw 92 to be installed without tilting the deck-clip screw 92.

As shown in the installation view 575, the deck-clip 565 is adapted to provide spacing between deck boards that are positioned 45° from being perpendicular to the joist 537 in which the deck-clip 565 is installed. Once the deck-clip 565 is slid within the deck-clip slot 539 away from the milled portion 541, the joist 537 prevents the deck-clip 565 from being lifted upward out of the joist 537. The deck-clip 565 includes a notched area 333 within the vertical element 577 beginning at the base 579. In an alternative arrangement for the deck-clip 565 and other deck-clips having a notched area 333, the notched area 333 can be offset from the base of the deck-clip similar to how the notched area 333 of deck-clip 5 is offset from the base 514 as shown in FIG. 5.

Next, FIG. 28 shows a deck-clip 605. FIG. 28 includes a top view 607 of the deck-clip 605, a side view 609 of the deck-clip 605, a front view 611 of the deck-clip 605, an isometric view 613 of the deck-clip 605, and installation view 615 of the deck-clip 605. The deck-clip 605 can be referred to as a 135° deck-clip. The deck-clip 605 includes a base 619, a vertical element 617, and a deck board retainer 621. The base 619 includes a through-hole 623 for insertion of a deck-clip screw 92 into deck-screw splines (such as the deck-screw splines 422 shown in FIG. 26). The deck-clip screw 92 can keep the deck-clip 605 at a desired position within the joist 537. The vertical element 617 is perpendicular to the base 619 and to the deck board retainer 621. The base 619 includes short edges 625 and 627 and long edges 629 and 631. The vertical element 617 is rotated 45° with respect to a corner of the base 619 formed by the short edge 627 and the long edge 629. The deck board retainer 621 includes a notch 633 to allow the deck-clip screw 92 to be installed without tilting the deck-clip screw 92.

As shown in the installation view 615, the deck-clip 605 is adapted to provide spacing between deck boards that are positioned 45° from being perpendicular to the joist 537 in which the deck-clip 605 is installed, although the deck boards are oriented 90° from the orientation of the deck boards shown in the installation view 575. Once the deck-clip 605 is slid within the deck-clip slot 539 away from the milled portion 541, the joist 537 prevents the deck-clip 605 from being lifted upward out of the joist 537. The deck-clip 605 includes a notched area 333 within the vertical element 617 beginning at the base 619.

Figure 45:
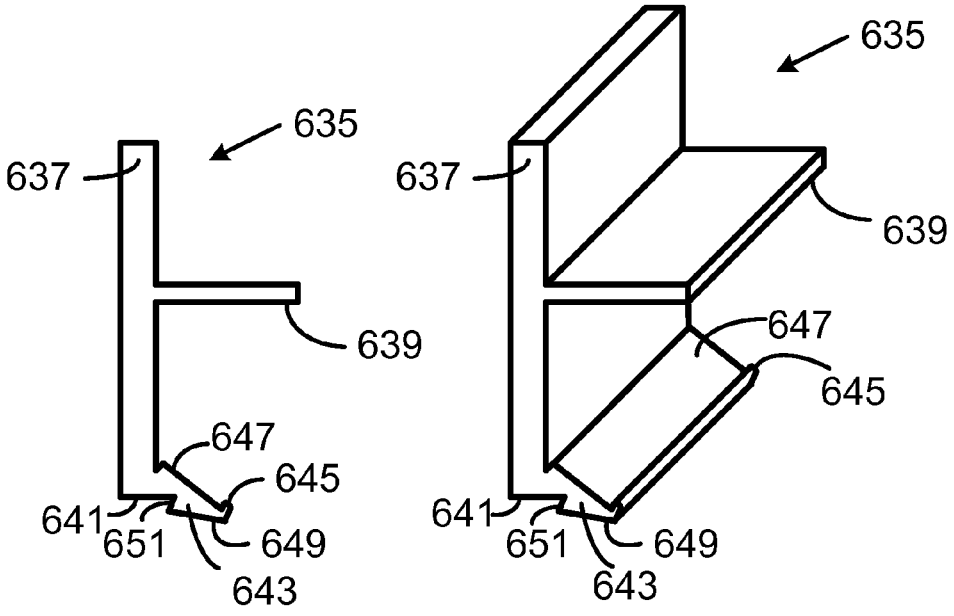
FIG. 45 shows an example perimeter trim clip.

Next, FIG. 45 shows a perimeter-trim-piece 635. The perimeter-trim-piece 635, like any other perimeter-trim-piece described herein or shown in the figures, can be inserted into a perimeter-trim-piece slot, such as the perimeter-trim-piece slot 417 shown in FIG. 26. The perimeter-trim-piece 635 can be retained within the perimeter-trim-piece slot 417. The perimeter-trim-piece 635, like other perimeter-trim-pieces, can be removed from the perimeter-trim-piece slot 417. Accordingly, the perimeter-trim-piece 635 can include a removably retainable perimeter-trim-piece. The perimeter-trim-pieces, such as perimeter-trim-piece 635, can be used to keep one or more deck boards from sliding beyond an edge of a box-frame-segment and can be used to keep a portion of one or more deck boards from being lifted upwards from a box-frame-segment or joist.

The perimeter-trim-piece 635 includes a vertical element 637, a horizontal member 639, a horizontal base 641, an intermediate perimeter-trim-piece locking tab 643, and a distal perimeter-trim-piece locking tab 645. The distal perimeter-trim-piece locking tab 645 and then the intermediate perimeter-trim-piece locking tab 643 can be positioned into the perimeter-trim-piece slot 417. The intermediate perimeter-trim-piece locking tab 643 includes an upper surface 647, a lower surface 649, and an upright surface 651 that extends from the lower surface 649 to the horizontal base 641. The upright surface 651 can be positioned against a vertical element of a box-frame-segment that forms a perimeter-trim-piece slot. The horizontal member 639 can be positioned within a slot of one or more deck boards.

Next, FIG. 28 illustrates insertion of a perimeter-trim-piece 655 into a perimeter-trim-piece slot of the box-frame-segment 102A. A box-frame-segment attachment 653 is attached to the box-frame-segment 102A. As an example, the box-frame-segment attachment 653 can be a joist, a joist spacer, or a joist assembly. The perimeter-trim-piece 655 can include the same features of the perimeter-trim-piece 635 shown in FIG. 45, but the perimeter-trim-piece 635 may not include the horizontal shelf 639. The perimeter-trim-piece 655 can include barbs (e.g., sharp points) protruding from the vertical element 637 for preventing or reducing upright movement of a deck board into which the barbs have been inserted. The barbs can be positioned within a slot of one or more deck boards to retain the deck board in position.

As shown in FIG. 28, the distal perimeter-trim-piece locking tab 645 and the intermediate perimeter-trim-piece locking tab 643 of the perimeter-trim-piece 655 are inserted into the perimeter-trim-piece slot of the box-frame-segment 102A with the vertical element 637 tilted from its vertical position and then the perimeter-trim-piece 655 is rotated (counter-clockwise with respect to FIG. 28) until the perimeter-trim-piece 655 snaps into the perimeter-trim-piece slot.

A perimeter-trim-piece installed into a perimeter-trim-piece slot may include a single perimeter-trim-piece. For example, for a box-frame-segment 12 feet long, the perimeter-trim-piece installed into a perimeter-trim-piece slot of that box-frame-segment may be 12 feet long or nearly 12 feet long. That perimeter-trim-piece may be nearly 12 feet long so as to allow perimeter-trim-pieces to be installed into box-frame-segments that attach to the 12 foot long box-frame-segment.

Figure 46:
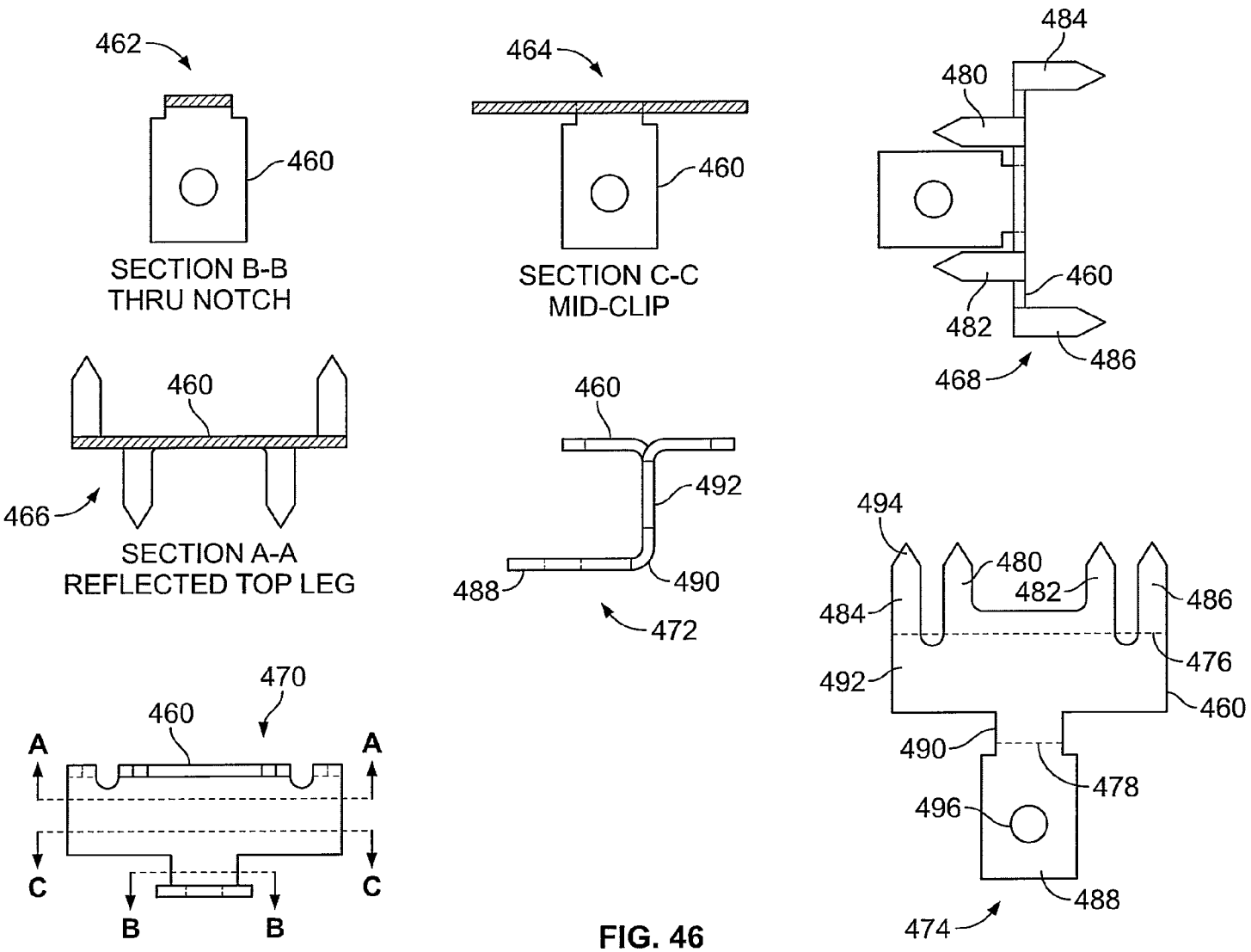
FIG. 46 shows an example deck-clip.

Next, FIG. 46 shows multiple views of a deck-clip 460. The deck-clip 460 can be a metallic clip, such as a clip made of steel or aluminum. The various views of the deck-clip 460 shown in FIG. 46 include section views 462, 464, and 466, a top view 468, a front view 470, a side view 472, and a material view 474 showing material used to form the deck-clip 460. The section view 462 corresponds to the section lines B-B shown in the front view 468. The section view 464 corresponds to the section lines C-C shown in the front view 468. The section view 466 corresponds to the section lines A-A shown in the front view 468.

The material view 474 shows bend lines 476 and 478 that indicate points at which a deck-clip material is bent to form the deck-clip 460. The material view 474 shows the deck-clip material includes inner tabs 480 and 482, outer tabs 484 and 486, a lower base portion 488, a first intermediate portion 490, and a second intermediate portion 492. The first intermediate portion is connected to and extends between the lower base portion 488 and the second intermediate portion 492. The first intermediate portion 490 can be referred to as a notch.

Each of the inner tabs 480 and 482 and the outer tabs 484 and 486 can include a pointed end, such as the pointed end 494 of the outer tab 484. The points of the inner tabs 480 and 482 can be positioned within a first deck board. The points of the outer tabs 484 and 486 can be positioned within a second deck board. The inner tabs 480 and 482 can be referred to as proximal tabs as those tabs are closer to a center line that passes through the lower base portion 488, the first intermediate portion 490, and the second intermediate portion 492, as shown in the material view 474. The outer tabs 484 and 486 can be referred to as distal tabs as those tabs are further away from the aforementioned center line.

The deck-clip material shown in the material view 474 can be bent at bend lines 476 and 478 to form the deck-clip 460 as shown in the other view of FIG. 46. As such, the second intermediate portion 492 can be perpendicular to the lower base portion 488 and to the inner tabs 480 and 482 and to the outer tabs 484 and 486. A through-hole 496 can be provided in the lower base portion 488 to allow a deck-clip screw, such as the deck-clip screw 92 to pass through the lower base portion 488 and into screw splines, such as the deck screw splines 422 shown in FIG. 26. Since deck screw splines can extend from end to end of a box-frame segment, joist, or joist segment, the example deck-clips described herein can be slid to a desired location within the box-frame segment, joist, or joist segment and screwed into the box-frame segment, joist, or joist segment at the desired location. While positioned within the deck-clip slot away from a milled portion at which the deck-clip was inserted into the deck-clip slot, the deck-clip can be prevented from being lifted upward (e.g., vertically) out of the box-frame segment, joist, or joist segment. Fastening the deck-clip 460 using a deck-clip screw 92 into a deck-clip slot can secure the deck-clip sufficiently so that a deck board can be pushed in a direction towards the deck-clip 460 such that the points of the inner tabs 480 and 482 or the points of the outer tabs 484 and 486 pierce the deck-board for securing the deck board to the box-frame segment, joist or joist segment housing the deck-clip 460.

The lower base portion 488 can have a width of 0.5 inches or some other dimension that allows the lower base portion 488 to be inserted into a milled-portion of a joist or joist segment, such as the milled-portion 541 shown in FIG. 27, and slid within the deck-clip slot 539. While in a deck-clip slot, away from a milled-portion that permits placement of the deck-clip 460 into the deck-clip slot, the deck clip 460 can be restrained from being pulled out of the deck-clip slot due, in part to width of lower base portion 488. Furthermore, a dimension of a distance from the furthest edges of the outer tabs 484 and 486 can be 1.5 inches or some other dimension. Furthermore still, after the inner tabs 480 and 482 and the outer tabs 484 and 486 are bent at the bend line 476, an end of a point of each of those tabs can be positioned 0.4375 inches or another number of inches away from the second intermediate portion 492.

As an alternative to inserting the lower base portion 488 into a milled portion of a box-frame segment, joist, or joist segment, the lower base portion 488 of the deck-clip 460 can be inserted into a deck-clip slot at any end of a box-frame segment, such as the deck-clip slot 419 shown in FIG. 26, or the deck-clip slot at any end of a joist or joist segment, such as the deck-clip slot 683 shown in FIG. 26. The aforementioned ends of the box-frame segment, joist, or joist segment refer to the opposite ends of the box-frame segment, joist, or joist segment, longitudinally. The other deck-clips described herein can also be inserted into deck-clip slots in the foregoing manner or through a milled portion, such as the milled portion 541. Moreover, multiple deck-clips can be inserted into a deck-clip slot at any end of a box-frame segment, joist, or joist segment before the box-frame segment is attached to another box-frame segment or before the joist or joist segment in inserted into a box frame.

E. Extrusions

Next, FIG. 26 illustrates example extrusions for use within a box-frame, a joist assembly, or otherwise within a deck system. In particular, FIG. 26 shows a box-frame-segment assembly 401 including a box-frame-segment 403 and a box-frame-segment attachment 405. The box-frame-segment 403 can include an extrusion produced from a first extrusion die and the box-frame-segment attachment 405 can include an extrusion made from a second extrusion die. The features of those extrusions can be uniform over the entirety of the respective extrusions prior to performance of any milling, drilling or other operation to the extrusions. The box-frame-segments 101A, 102A, 103A, and 104A shown in FIG. 25 are examples of box-frame-segments that can include a profile like the box-frame-segment 403.

The box-frame-segment 403 includes a vertical element 407, a base horizontal element 409, a top horizontal element 411, a top horizontal element 413, a top horizontal element 415, and a locking-tab 195. The box-frame-segment 403 includes a deck-clip slot 419 and deck screw splines 422 accessible through the deck-clip slot 419 between the horizontal element 413 and the horizontal element 415. Adjacent to the horizontal element 415 is a locking-tab slot 431 adapted to accept a locking-tab 435 on the box-frame-segment attachment 405. The box-frame-segment 403 includes a locking-tab 595 at an end of the horizontal element 409 adapted to be positioned within a locking-tab slot 447 on the box-frame-segment attachment 405.

A perimeter-trim-piece slot 417 is positioned between the horizontal element 411 and the horizontal element 413. The perimeter-trim-piece slot 417 includes a vertical slot extending from between the top horizontal elements 411 and 413 and a horizontal slot extending from the vertical slot to beneath the horizontal element 413. As an example, the vertical slot can be 0.125 inches and the horizontal slot can be 0.25 inches. A perimeter-trim-piece can be inserted into the perimeter-trim-piece slot 417 to cover edges of deck boards positioned upon a deck system including the box-frame-segment assembly 401.

The box-frame-segment 403 can include a reinforcement shelf 421 to support a reinforcement element 423 within the box-frame-segment assembly 401. As shown in FIG. 26, an upper portion of the reinforcement element 423 can be positioned within a reinforcement guide 427 formed, in part, by and between the vertical element 407 and a vertical element 425. Any reinforcement element described herein can include an L-shaped piece of aluminum or some other metal. The L-shaped reinforcement element can include a vertical portion that extends from an upper surface 451 of the reinforcement shelf 421 to a position within the reinforcement guide 427. The reinforcement shelf 421 includes a lower surface 453. A box-frame perimeter including the box-frame-segment 403 can be used without the reinforcement element 423. Placement of the reinforcement element 423 within the reinforcement guide 427 and onto the reinforcement shelf 421 allows the reinforcement element 423 to be locked into the reinforcement guide 427. A reinforcement element locked into a reinforcement guide can be unlocked (e.g., removed) by applying sufficient forces to one or both of the reinforcement element and the box-frame-segment having the reinforcement guide.

The box-frame-segment attachment 405 includes a vertical element 455, a top horizontal element 437 extending from the vertical element 455 to the locking-tab 435. The box-frame-segment attachment 405 includes a horizontal element 445 extending away from the vertical element 455 and the locking-tab 443 extending away from the horizontal element 445 so as to form the locking-tab slot 447. The box-frame-segment attachment 405 includes an uplift clip shelf 479 for supporting an uplift clip 449. Use of the uplift clip 449 can prevent removal of the box-frame-segment attachment 405 from the box-frame-segment 403. Removal of the uplift clip 449 from a box-frame perimeter, such as the box-frame-segment assembly 401, allows for the box-frame-segment attachment 405 to be removed from a box-frame-segment 403.

FIG. 26 shows a box-frame-segment assembly 461 including a box-frame-segment 463, a box-frame-segment attachment 465, a reinforcement element 467, and an uplift clip 469. The box-frame-segment 463 is identical to the box-frame-segment 403 except that the box-frame-segment 463 includes a reinforcement fin 471. As shown in FIG. 26, the reinforcement fin 471 extends from a vertical element 473 that includes one portion of the deck screw spline 422 down to the horizontal element 409. As an example, the reinforcement fin 471 can have a thickness of 0.125 inches and a length of 4.125 inches. The box-frame-segment attachment 465 can be identical to the box-frame-segment attachment 405. The uplift clip 469 can be identical to the uplift clip 449. In one respect, the reinforcement element 467 can be identical to the reinforcement element 423. In another respect, the reinforcement element 467 can have a horizontal element that is shorter than the horizontal portion of the reinforcement element 423 since the horizontal element of the reinforcement element 467 cannot extend beyond the reinforcement fin 471. The box-frame-segments 101A, 102A, 103A, and 104A shown in FIG. 25 are examples of box-frame-segments that can a profile like the box-frame-segment 463.

FIG. 26 shows a box-frame-segment assembly 485 including a box-frame-segment 487, a box-frame-segment attachment 489, a reinforcement element 491, an uplift clip 493, and a reinforcement fin 495. The box-frame-segment 487 includes an intermediate horizontal element 457, a vertical element 497, a vertical element 483, and a base horizontal element 499. The portion of the box-frame-segment 487 above the intermediated horizontal element 457 includes the same features as the portion of the box-frame-segment assembly 461 above the horizontal element 409. The box-frame-segment assembly 485 includes a locking-tab 511 extending from the horizontal element 457 and is adapted to be positioned within a locking-tab slot 597 on the box-frame-segment attachment 489. The vertical element 497 includes the vertical element 407 of the box-frame-segment 403. The box-frame-segment 487 is a higher-profile box-frame-segment as compared to the box-frame-segments 403 and 463. The box-frame-segment attachment 489 can be identical to the box-frame-segment attachments 405 and 465. The uplift clip 493 can be identical to the uplift clips 449 and 469. The reinforcement element 491 can be identical to the reinforcement element 467. The box-frame-segments 101A, 102A, 103A, and 104A shown in FIG. 25 are examples of box-frame-segments that can a profile like the box-frame-segment 487.

FIG. 26 shows recessed areas 325, 327 and tabs 329, 331 of a deck-clip slot within the box-frame-segment 487. The recessed areas 325, 327 provide an area for a base of a deck-clip (or the base and a lower portion of a vertical element of the deck-clip) to be positioned. The recessed areas 325, 327 allow a deck-clip installed into the deck-clip slot to be slid axially within the deck-clip slot. The tabs 329, 331 correspond to notches of a notched area 333 of a deck-clip. Portions of the tabs 329, 331 (at a location where the deck-clip is positioned) can extend within notches of the notched area 333 of a deck-clip. The tabs 329, 331 prevent an installed deck-clip from being lifted upward out of a deck-clip slot as portions of the base of the deck-clip are positioned below the tabs 329, 331.

Other deck-clip slots within the deck components shown in the figures or described herein, such as the deck-clip slot 419, can include recessed areas similar to the recessed areas 325, 327, and can include tabs similar to tabs 329, 331. The description of the recessed areas and tabs of the other deck-clips slots is therefore not repeated with the description of the other deck-clip slots.

FIG. 26 also shows a joist assembly 699, a joist assembly 701, and a joist 703. As shown in FIG. 26, the joist assembly 699 includes a joist segment 1037 and a joist segment 433. The joist segment 1037 includes a vertical element 675, a base horizontal element 669, a top horizontal element 685, a top horizontal element 691, a locking tab 693 extending from the top horizontal element 691, an inner vertical element 677, an inner vertical element 681, an inner horizontal element 679 connecting the inner vertical element 677 and the inner vertical element 681. The locking tab 693, the top horizontal element 691, an inner vertical element 689, and a tab 695 form a roll-lock tab receiver 767 into which a roll-lock tab 213 on the joist segment 433 can be positioned. The joist segment 1037 includes a vertical element 671 extending from the base horizontal element 669 and a horizontal element 673 extending from the vertical element 671. The vertical element 671 and the horizontal element 673 form a tab retainer for retaining a locking tab 219 on the joist segment 433. The joist segment 1037 also includes a screw spline 189 and a screw spline 183.

The joist segment 433 includes a vertical element 197, a base vertical element 203, a locking tab 219 located at an end of the base horizontal element 203. The joist segment 433 includes a top horizontal element 207, an inner vertical element 439, an inner horizontal element 211, and a roll-lock tab 213. The roll-lock tab 213, the inner horizontal element 211 and the inner vertical element 439 form a roll-lock tab receiver 209 into which the roll-lock tab 213 can be positioned. The joist segment 433 also includes a screw spline 201 and a screw spline 697.

Assembly of the joist assembly 699 can include positioning the roll-lock tab 213 into the roll-lock tab receiver 767 and rotating one or more of the base horizontal element 669 and the base horizontal element 203 towards one another until the locking tab 219 contacts and is retained by the tab retainer formed by the vertical element 671 and the horizontal element 673. The assembly of the joist assembly can include positioning the locking tab 693 into the roll-lock tab receiver 209.

As shown in FIG. 26, the joist assembly 701 includes a joist segment 707 and a joist segment 355. The joist segment 707 includes the same features as the joist segment 1037 and includes a reinforcement fin 769 extending from the inner horizontal element 679 to the base horizontal element 669. The joist segment 707, similar to the joist segment 1037, includes a deck-clip slot 683 positioned between the top horizontal element 685 and the top horizontal element 691. The inner vertical element 677 and the inner vertical element 681 include splines 357 for retaining a deck-clip screw inserted into a deck-clip positioned within the deck-clip slot 683. The joist segment 355 includes the same features as the joist segment 433. Assembling the joist assembly 701 can occur in the same manner as assembling the joist assembly 699.

As shown in FIG. 26, the joist 703 includes a vertical element 769, a vertical element 773, a base horizontal element 771, a top horizontal element 1007, and a top horizontal element 1009. The joist 703 includes a deck-clip slot 1023 positioned between the top horizontal element 1007 and the top horizontal element 1009. The deck-clip slot 1023 provides access to screw splines 1025 formed on an inner vertical element 1029 and an inner vertical element 1035. An inner vertical element 1027 and the vertical element 769 and the top horizontal element 1007 form a reinforcement guide for keeping a reinforcement element 1021 in position on a reinforcement shelf 1019. The joist 703 includes screw splines 1011, 1013, and 1015.

As shown in FIG. 26, the deck system components of the example deck systems can include tabs and tab slots on each or two components for locking the two components together. As shown in FIG. 26 and other figures showing tabs and tab slots, a tab or an element defining a tab slot (e.g., the roll-lock tab receiver 209 or the locking-tab slot 431) can be slanted (e.g., non-perpendicular) with respect to an element from which the slanted element extends. In particular, the joist segments 355 and 433 each include a slanted element to form a roll-lock tab receiver.

The tabs and tab slots on two components that lock together can include tabs and tab slots formed by perpendicular elements only. The box-frame segment assemblies 401, 461, and 485 are examples of deck system components that can include tabs and tab slots formed by perpendicular elements only. Alternatively, one or more of the box-frame segment assemblies 401, 461, and 485 can include a tab or tab slot defined with at least one slanted element. One or more of the components described herein as being lockable or locked to another component can be unlockable or unlocked from the other component.

Figure 44:
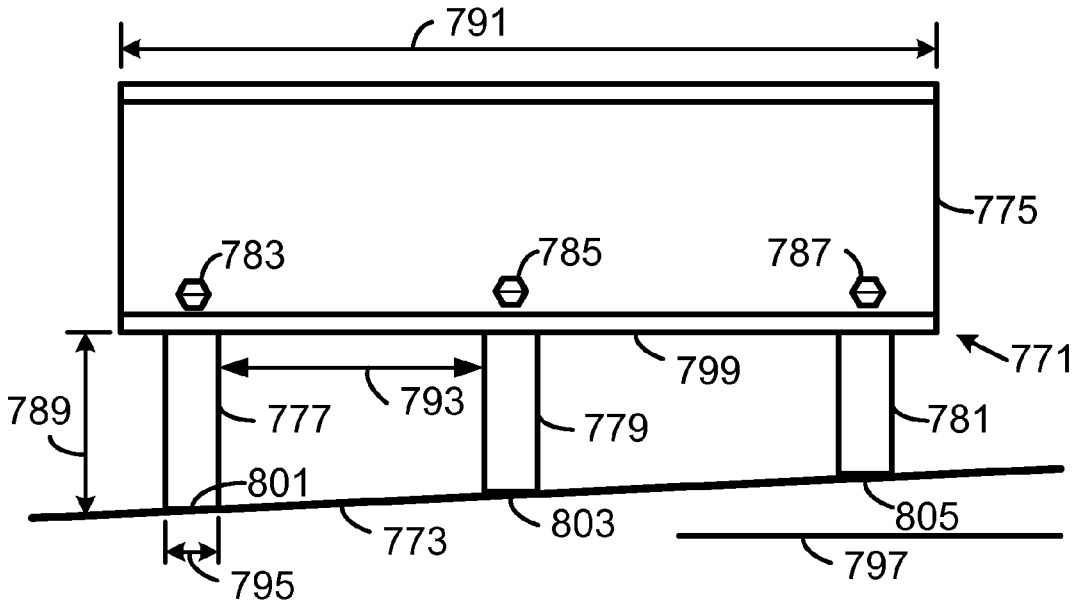
FIG. 44 shows a joist assembly installed on a sloped surface.

Next, FIG. 44 shows a side view of a joist assembly 771 positioned on a surface 773. As shown in FIG. 44, surface 773 is sloped with respect to a horizontal reference 797. Alternatively, the joist assembly 771 can be positioned on a surface that is parallel to the horizontal reference 797. The surface 773 can be a roof or a portion thereof (e.g., roof shingles or asphalt). The roof can be a top portion of a house or some other building. As an example, the roof can have a 6/12 pitch or some other pitch. For example embodiments that pertain to positioning the joist assembly 771 on a roof, the joist assembly 771 can be referred to as a roof-top joist.

The joist assembly 771 includes a joist 775 and H-bar shims 777, 779, and 781. The joist assembly can include a number of H-bar shims other than three, where the number equals one, two, or a number greater than three. The H-bar shims 777, 779, and 781 are attached to the joist 775. In one respect, an H-bar shim can be removably attached to the joist 775 using one or more fasteners. FIG. 44 shows fasteners 783, 785, and 787 for removably attaching the H-bar shims 777, 779, and 781, respectively, to the joist 775. The fasteners 783, 785, and 787 can include a screw or some other type of fastener. In another respect, an H-bar shim can be non-removably attached to the joist 775 by welding the H-bar shim to the joist 775 or by another process. An H-bar shim can be referred to as a support clip or an H-bar support clip or by some other term.

The joist assembly 775 can be one of several joist assemblies positioned on the surface 773 as part of a structure, such as a roof-top deck. Each of those joist assemblies can be installed within a box-frame, such as one of the box-frames described in this description.

FIG. 44 shows example dimensions 789, 791, 793, and 795. Dimension 795 represents a dimension of an H-bar shim. As an example, the dimension 795 can be a distance between four inches (0.1016 meters) and eight inches (0.2032 meters) (e.g., six inches (0.1524 meters)). Other examples of dimension 795 are also possible. For two or more of H-bar shims 777, 779, and 781, the dimension 795 can be identical or may not be identical.

Dimension 791 represents a longitudinal dimension of the joist 775. As an example, the dimension 791 can be thirteen feet (i.e., 3.9624 meters). Other examples of dimension 791 are also possible.

Dimension 793 represents a distance between the closest surfaces of two adjacent H-bar shims on the same joist. As an example, the dimension 793 can be five feet and six inches (i.e., 1.9812 meters). In that way, the center lines of two adjacent H-bar shims with the dimension 795 of six inches would be six feet (1.8288 meters) apart. Other examples of dimension 793 are also possible.

Dimension 789 represents a height of an H-bar shim extending from a bottom surface 799 of the joist 775 and the surface 773. For surface 773, dimension 789 at a surface location 799, at a surface location 801, and at a surface location 803 are different and can depend on the pitch of the surface 773. As an example, the dimension 789 for the H-bar shim 777 at the surface location 801 can be three feet (i.e., 0.9144 meters), the dimension 789 for the H-bar shim 779 at the surface location 803 can be two feet (i.e., 0.6096 meters), and the dimension 789 for the H-bar shim 781 at the surface location 805 can be 1 foot (i.e., 0.3048 meters). Other examples of the dimension 789 for H-bar shims 777, 779, and 781 are also possible.

In an alternative arrangement, the joist 775 can be oriented in an arrangement in which the joist 775 is perpendicular to the arrangement of the joist 775 as shown in FIG. 44 and in which the joist 775 is above the surface location 803 but is not above the surface locations 801 and 805. A second joist can extend parallel to the joist 775 and above the surface location 801 and a third location can extend parallel to the joist 775 and above the surface location 805. In this alternative arrangement, a joist assembly including the joist 775 can include multiple H-bar shims that are a common first height, a joist assembly including the second joist can include multiple H-bar shims that are a common second height greater than the first height, and a joist assembly including the third joist can include multiple H-bar shims that are a common third height less than the first height.

Figure 42:
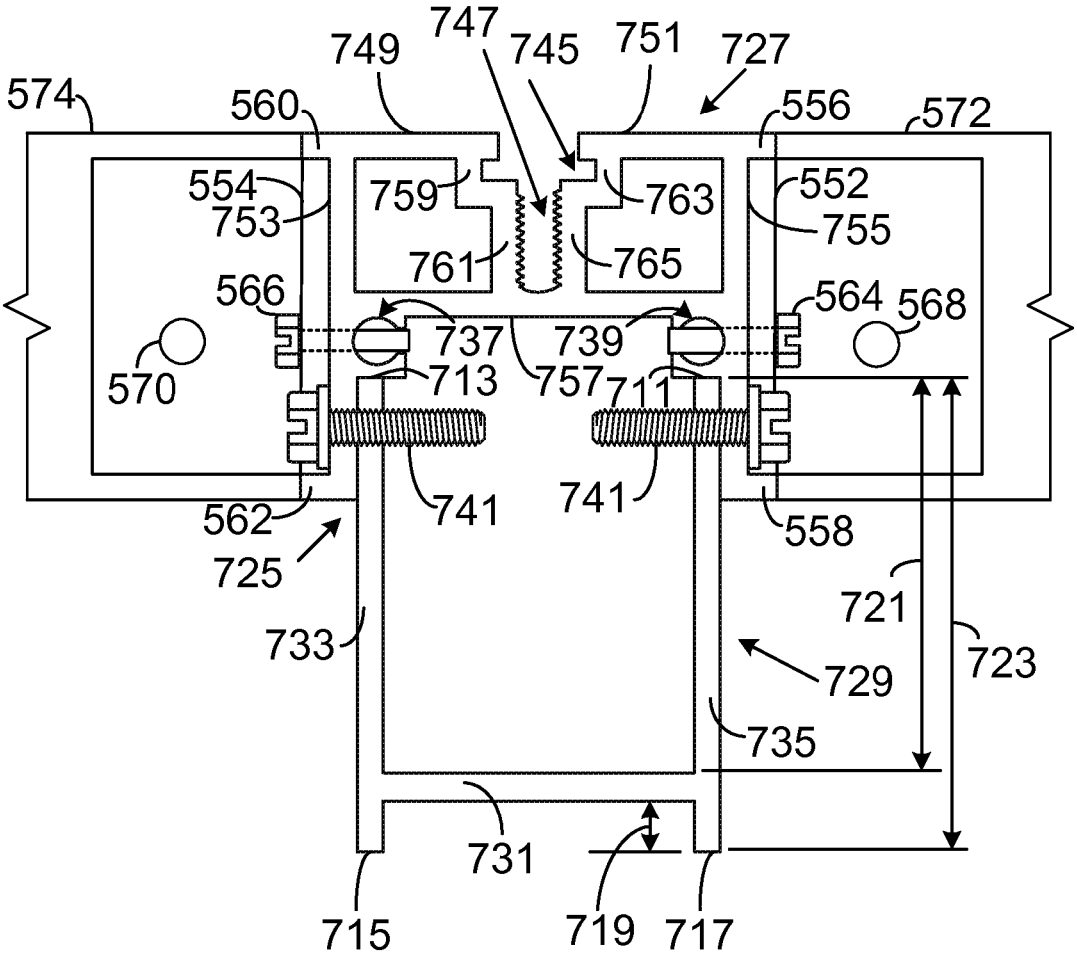
FIG. 42 shows a joist assembly including a joist and an H-bar shim.

Next, FIG. 42 shows a section view of a joist assembly 725 including a joist 727 and an H-bar shim 729. The H-bar shim 729 includes a horizontal element 731, a vertical element 733, and a vertical element 735. A thickness of the horizontal element 731, the vertical element 733 and the vertical element 735 can be a uniform thickness such as 0.125 inches (0.003175 meters). Different examples of the uniform thickness are also possible. In an alternative arrangement, the horizontal and vertical elements of the H-bar shim 729 may not have a uniform thickness. The joist assembly 775 shown in FIG. 44 can be arranged like the joist assembly 725.

The vertical element 733 includes a bottom surface 715 and a top surface 713. The vertical element 735 includes a bottom surface 717 and a top surface 711. The top surfaces 711 and 713 can be formed by milling (e.g., cutting) portions of the vertical elements 735 and 733, respectively, above the horizontal element 731. Milling the vertical elements 735 and 733 can be performed to allow the joist 727 to be level or substantially level when positioned on a pitched roof or other inclined surface.

The H-bar shim 729 can have various dimensions, some of which are shown in FIG. 42. A dimension 719 represents a dimension from the bottom surfaces 715 and 717 to a bottom surface of the horizontal element 731. The dimension 719 may be identical for each H-bar shim installed within a joist (e.g., H-bar shims 777, 779, and 781 shown in FIG. 44). A dimension 721 represents a dimension from an upper surface of the horizontal element 731 to the top surfaces 711 and 713. A dimension 723 represents a dimension from the bottom surfaces 715 and 717 to the top surfaces 711 and 713. The dimensions 721 and 723 may be different for each H-bar shim installed within a joist (e.g., H-bar shims 777, 779, and 781).

The joist 727 a top horizontal element 749, a top horizontal element 751, a horizontal element 757, an outer vertical element 753, an outer vertical element 755, an inner vertical element 759, an inner vertical element 761, an inner vertical element 763, an inner vertical element 765, a screw spline 737, and a screw spline 739. The top horizontal elements 749 and 751 can be separated to form a narrow portion of a deck-clip slot 745. The inner vertical elements 759 and 763 can be recessed from edges of the top horizontal elements 749 and 751 so as to form a wider portion of the deck-clip slot 745. The inner vertical elements 761 and 765 can be separated at a distance to form a deck screw spline 747 for retaining deck screws driven into the deck screw spline 747.

Through-holes can be drilled through the outer vertical elements 753 and 755 and the vertical elements 733 and 735. Fasteners 741 can be inserted through those through-holes to releasably attach the joist 727 to the H-bar shim 729.

An angle clip 552 can be positioned within a recessed area of the joist 727 formed between tabs 556 and 558. The angle clip 552 can be removably fastened to the joist 727 by a fastener 564 extending into the screw spline 739. The angle clip 552 can be removably fastened to an attachment element 572 by a fastener (not shown) positioned within attachment hole 568. As an example, the attachment element 572 can include a joist spacer or brace positioned between the joist 727 and another joist within a box-frame perimeter. That other joist can be configured like the joist 727.

An angle clip 554 can be positioned within a recessed area of the joist 727 formed between tabs 560 and 562. The angle clip 554 can be removably fastened to the joist 727 by a fastener 566 extending into the screw spline 737. The angle clip 554 can be removable fastened to an attachment element 574 by a fastener (not shown) positioned within attachment hole 570. As an example, the attachment element 574 can include a joist spacer or brace positioned between the joist 727 and another joist within a box-frame perimeter. That other joist can be configured like the joist 727. In another arrangement, the attachment elements 572 and 574 can include a single element such as a box-frame segment (e.g., box frame segment 104A). The fastener 564 and the fastener positioned within the attachment hole 568 can include any of the fasteners described herein or another fastener. The fasteners 564 and 566 and the fasteners positioned within the attachment holes 568 and 570 can include any of the fasteners described herein or another fastener.

Figure 43:
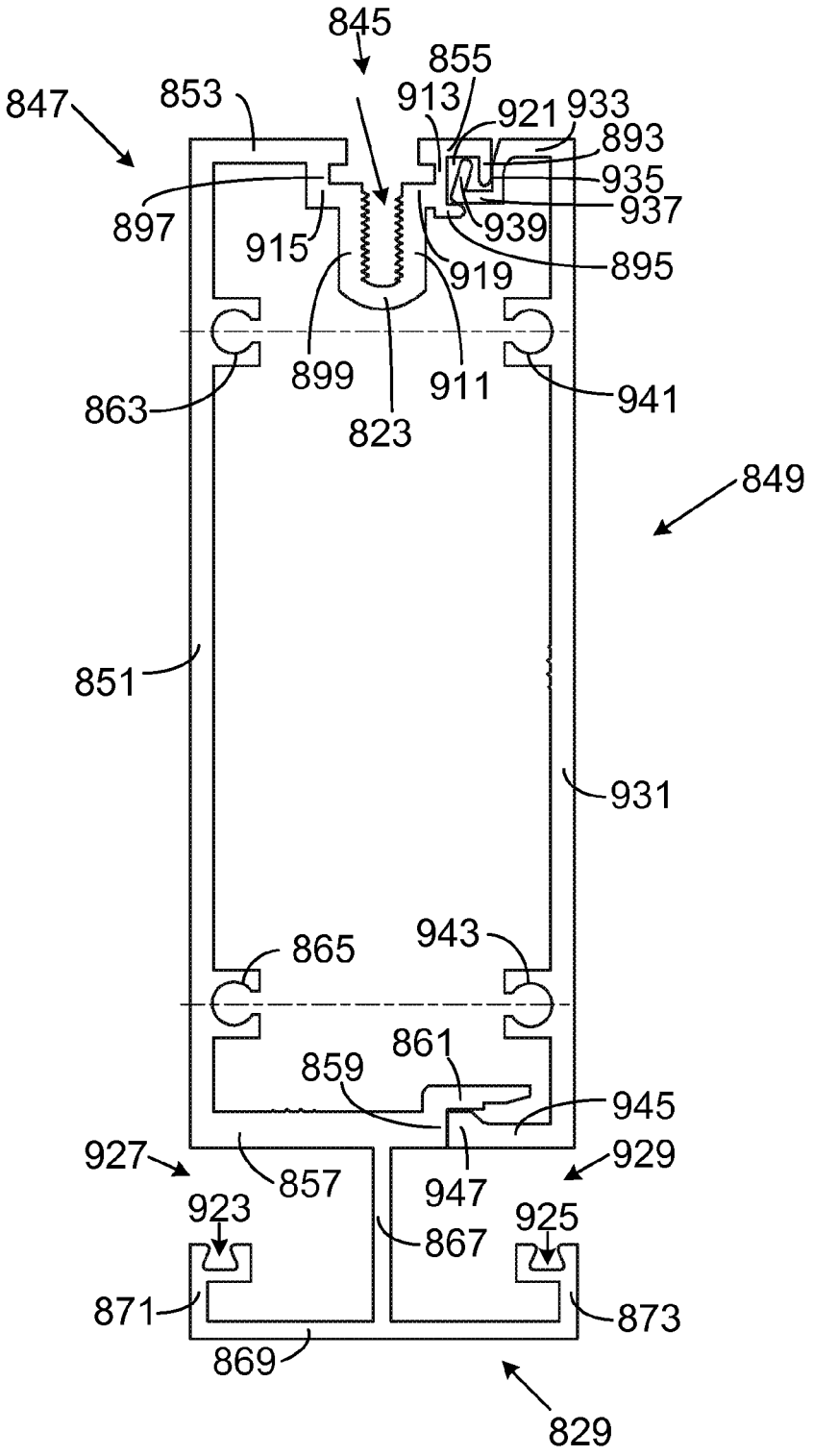
FIG. 43 shows a joist assembly including a ceiling gutter.

Next, FIG. 43 shows a joist assembly 845 with a ceiling gutter 829. The joist assembly includes a joist segment 847 and a joist segment 849. The joist segment 847 includes the ceiling gutter 829, a vertical element 851, a top horizontal element 853, a top horizontal element 855, a horizontal element 857, a locking tab vertical member 859, a locking tab horizontal member 861, an inner vertical element 897, an inner vertical element 899, an inner vertical element 911, an inner vertical element 913, a vertical element 893, an inner horizontal element 915, an inner horizontal element 919, an inner horizontal element 823, a horizontal element 895, and screw splines 863 and 865. The vertical element 893, the top horizontal element 855, the inner vertical element 913, and the horizontal element 895 form a roll-lock tab receiver 921 adapted for receiving a roll-lock tab of a joist segment, such as joist segment 849.

The joist segment 849 includes a vertical element 931, a top horizontal element 933, an inner vertical element 935, an inner horizontal element 937, a roll-lock tab 939, a screw spline 941, a screw spline 943, a bottom horizontal element 945, and a locking tab 947.

The ceiling gutter includes a horizontal element 869 and a vertical element 867 extending from the horizontal element 857 to the horizontal element 869. A vertical element 871 extends away from the horizontal element 869 towards, but stopping short, of the horizontal element 857. A vertical element 873 is similarly situated on the opposite side of the horizontal element 869.

A gasket gap protrusion including a gasket gap 923 extends inward from the vertical element 871 towards the vertical element 867. Similarly, a gasket gap protrusion including a gasket gap 925 extends inward from the vertical element 873 towards the vertical element 867. A ceiling panel gap 929 is formed between the bottom horizontal element 945 and the gasket gap protrusion including the gasket gap 925. A ceiling panel gap 927 is formed between the horizontal element 857 and the gasket gap protrusion including the gasket gap 923. As an example, the ceiling panel gaps 927 and 929 can include a gap between 0.0625 inches and 0.25 inches. A rubber gasket or otherwise can be inserted into the gasket gaps 923 and 925. The gasket can include a wedge gasket. A ceiling panel can be inserted into each of the ceiling panel gaps 927 and 929 and into ceiling gaps of a ceiling gutter on an adjacent joist assembly or box-frame-segment. After a ceiling panel is inserted into the ceiling panel gaps, a spacer, such as a W-shaped spacer, can be inserted in between the vertical element 867 and the installed ceiling panel.

The features of the ceiling gutter 829 extending from the horizontal element 857 can be included with a different joist or joist segment described herein. For example, the features extending from the horizontal element 857 can extend from the base horizontal element 669 of the joist segment 1073 and the joist segment 707 (as the joist segment 707 includes the features of the joist segment 1073) (shown in FIG. 26). As another example, the features extending from the horizontal element 857 can extend from the base horizontal element 771 of the joist 703 shown in FIG. 26.

Next, FIG. 8 shows profiles of example extrusions 800 and 825 of various components of the example deck systems. The extrusion 800 includes vertical surfaces 801 and 802, horizontal surfaces 803, 804 and 806, a locking tab 805, an angle-clip shelf 110, an angle-clip slot 111, a roll-lock-tab receiver 809, and a roll-lock tab 810. Each of those elements of the extrusion 800 can extend along an entire length of the extrusion 800 or a component having a profile like the extrusion 800.

The horizontal surface 804 is at a top side of the extrusion 800. The horizontal surface 803 is at a bottom side of the extrusion 800. The angle-clip shelf 110 or the angle-clip slot 111 can be configured for guiding an angle-clip, such as the angle-clip 105, within deck assembly components or extrusions having a profile like the extrusion 800. An angle clip 105 can be positioned within the angle-clip slot 111 or outside of and below the angle-clip slot 111.

The extrusion 825 includes the vertical surfaces 826 and 827, the horizontal surfaces 828, 829, 830, 833 and 838, long roll-lock tabs 834 and 840, screw splines (or self-tapping raceways) 831 and 832, a threaded screw slot 835, a roll-lock-tab receiver 836, a deck-clip slot 837, a locking tab edge 841, and a locking tab retainer 839. Each of those elements of the extrusion 825 can extend along an entire length of the extrusion 825 or a component having a profile like the extrusion 825.

The horizontal surfaces 829 and 830 are at a top side of the extrusion 825. The horizontal surface 828 is at a bottom side of the extrusion 825. Deck-clips, such as deck-clips 5, can be inserted into the deck-clip slot 837. A fastener placed through deck-clip 5 and into threaded screw slot 835 can fasten the deck-clip 5 to the extrusion 825 or a component having a profile like the extrusion 825.

Next, FIG. 21 shows profiles of example the extrusions 850 and 875 used for various components of the example deck systems. The extrusion 850 comprises the same elements as the extrusion 825 except that the extrusion 850 includes short roll-lock tab 843 instead of long roll-lock tab 834. The extrusion 825 and the extrusion 850 can be formed from separate and different extrusion dies. Alternatively, the extrusion 850 can be formed by milling the extrusion 825 to modify the long roll-lock tab 834 to be a short roll-lock tab 843. As an example, the long roll-lock tabs 834 or 840 can be or about twice as long (i.e., 2×), three times as long (i.e., 3×), four times as long (i.e., 4×) or five times as long (i.e., 5×) as the short roll-lock tab 843. As another example, the long roll-lock tabs 834 or 840 can be within a range of 1.1 (i.e., 1.1×) to 5 times (i.e., 35×) longer than the short roll-lock tab 843. As yet another example, the short roll-lock tab 843 can be ⅛ inches long and the long roll-lock tabs 834 or 840 can be ⅜ to ½ inches long. The length of the short roll-lock tab 843 can be a length that allows a joist assembly including a joist spacer or segment having a profile like the extrusion 850 to be snapped into an end of a box-frame assembly and secured within the box-frame assembly, yet allow for subsequent removal of that joist assembly from the box-frame assembly.

The extrusion 875 includes horizontal surfaces 876 and 879, vertical surfaces 877 and 878 of a vertical riser 891 extending between the horizontal surfaces 876 and 879, angle clip shelves 886 and 887, angle clip slots 884 and 885, locking tabs 888 and 889, roll-lock tab receivers 880 and 881, and roll-lock tabs 882 and 883. Each of those elements of the extrusion 875 can extend along an entire length of the extrusion 875 or a component having a profile like the extrusion 875. The horizontal surface 879 is at a top of the extrusion 875. The horizontal surface 876 is at a bottom of the extrusion 875.

Figure 23:
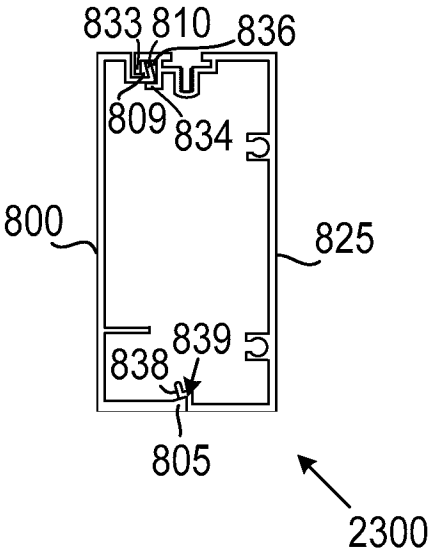
FIG. 23 shows a profile of two extrusions connected together.

Next, FIG. 23 shows a profile 2300 of the extrusion 800 and the extrusion 825 connected to one another. Connecting the extrusions 800 and 825 to one another can include bringing the locking tab 805 into contact with the locking tab retainer 839, and then rotating one or more of the extrusions until the roll-lock tab 810 is positioned within the roll-lock-tab receiver 836 and the roll-lock tab 833 is positioned within the roll-lock-tab receiver 809. The long toll-lock tab 834 can provide for a more secured connection of the extrusions 800 and 825. Alternatively, the roll-lock tab 810 can be positioned within the roll-lock-tab receiver 836 and the roll-lock tab 833 can be positioned within the roll-lock-tab receiver 809 and then one or more of the extrusions can be rotated until locking tab 805 contact and attaches to the locking tab retainer 839.

F. Post Brackets

Figure 9:
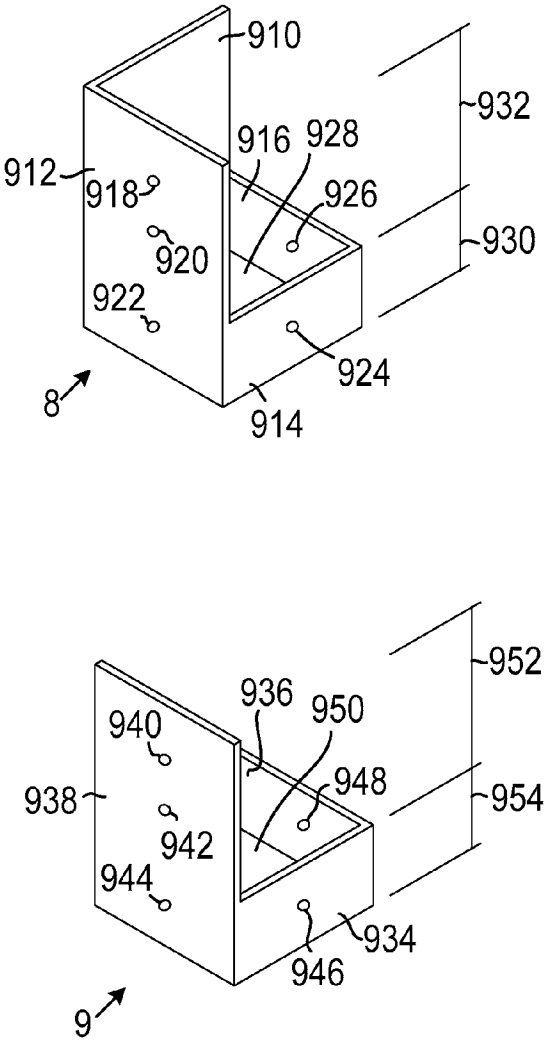
FIG. 9 shows a partial section view of a deck system and shows brackets in accordance with one or more example embodiments.
Figure 9:
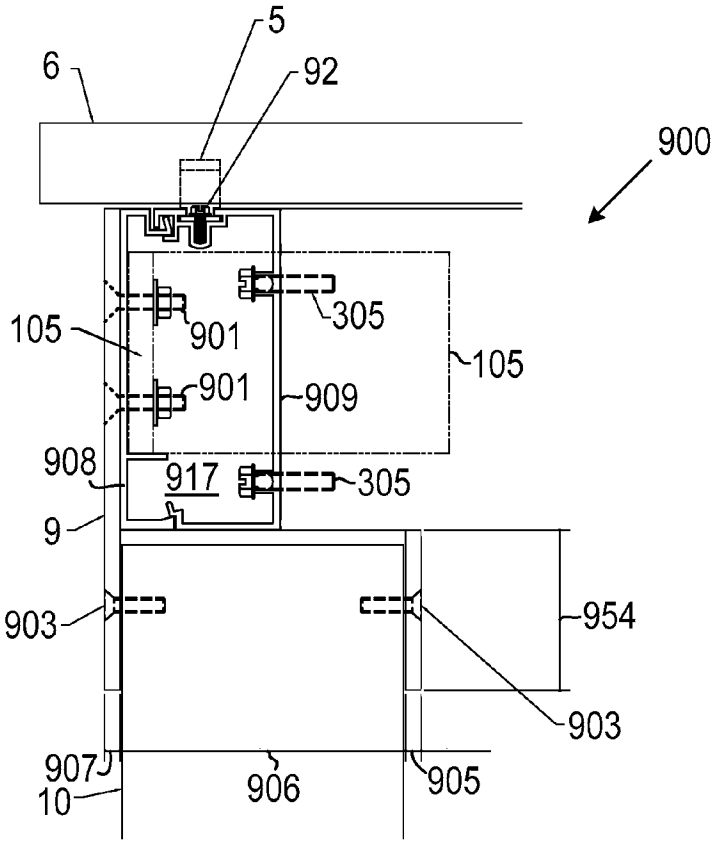

Next, FIG. 9 shows a partial section view 900 of a portion of a box-frame assembly attached to a post 10, and a deck board 6 attached to the box-frame assembly using a deck-clip 5 and a deck-clip screw 92. The deck screw 92, if used, can include a 0.75 inch long No. 10 sheet metal screw with a Phillips head, and a 24 threads per inch rating. Other examples of the deck-clip screw 92 are also possible. The box-frame assembly can be configured like box-frame assembly 100 or the box-frame assembly of the deck system 341.

The section view 900 shows the post 10 positioned within and attached to an intermediate-post bracket 9 using fasteners 903. The fasteners 903 can include a flat-head fastener, such as a flat-head screw. Dimensions 905, 906, and 907 are provided to provide perspective with respect to the intermediate-post bracket 9. The dimensions 905 and 907 can represent a thickness of elements and the dimension 906 can represent a length of an opening within the intermediate-post bracket 9. As an example, the dimensions 905 and 907 can be three sixteenths of an inch (i.e., 3/16") or some other number of inches. As another example, the dimension 906 can be three and nine sixteenths inches (i.e., 3 9/16") or some other number of inches.

FIG. 9 shows a joist or box-frame-segment 917 comprising an extrusion 908 configured like the extrusion 800 and an extrusion 909 configured like the extrusion 825. The extrusions 908 and 909 can attach together similar to the manner in which the extrusions 800 and 825 are attached as described with respect to FIG. 23. FIG. 9 shows an angle clip 105 attached to the extrusion 908 using fasteners 901. The fasteners 901 can include number 10 by 1 inch (i.e., #10×1") flat head screws with a lock washer and nut. FIG. 9 shows fasteners 305 within screw splines, such as screw splines 831 and 832 shown in FIG. 8. The fasteners 305 can be positioned within screw splines of one or more extrusions, such as the extrusions of a joist spacer and into a joist segment.

FIG. 9 shows details of the intermediate-post bracket 9, which is shown in several other figures as well. The intermediate-post bracket 9 comprises a long side 938, short sides 934 and 936, another short side (not shown) opposite short side 934 and between the long side 938 and the short side 936, and a post-opening 950. The long side 938 includes attachment holes 940, 942, 944. The short side 934 includes attachment hole 946. The short side 936 includes attachment hole 948. The short side opposite short side 934 can include an attachment hole at a position similar to attachment hole 946. The short sides 934 and 936 can have a height dimension 954 of 2 inches or some other number of inches. The long side 938 can have a height dimension 952 of 4 inches or some other number of inches above the upper surface of the short sides 934, 936.

A portion of a post, such as the post 10, can be inserted into a post-opening 950. Fasteners, such as the fasteners 903, can be inserted into holes 944, 946, and 948 and an attachment hole on short side opposite the short side 934 to secure the corner-post bracket 9 to the post 10. A box-frame-segment, such as box-frame-segment 102, positioned above post-opening 950 can be attached to the corner-post bracket 9 using fasteners, such as the fasteners 901, placed into attachment holes 940 and 942.

FIG. 9 also shows details of corner-post bracket 8, which is shown in several other figures described herein. The corner-post bracket 8 comprises long sides 910 and 912, short sides 914 and 916, a post-opening 928, attachment holes 918, 920 and 922 on long side 912, attachment hole 924 on short side 914, and attachment hole 926 on short side 916. The long side 910 can include attachment holes in arrangement similar to the attachment holes on the long side 912. The short sides 914 and 916 can have a height dimension 930 of 2 inches or some other number of inches. The long sides 910 and 912 can have a height dimension 932 of 4 inches or some other number of inches above the upper surface of the short sides 914 and 916.

A portion of a post, such as the post 10, can be inserted into the post-opening 928. The fasteners, such as the fasteners 903, can be inserted into the attachment holes 922, 924 and 926 and an attachment hole on the long side 910 to secure the corner-post bracket 8 to the post 10. Two box-frame-segments, such as the box-frame-segments 101 and 102, positioned above the post-opening 928 can be attached to the corner-post bracket 8 using fasteners, such as the fasteners 901, placed into the attachment holes 918 and 920 or similarly positioned attachment holes within the long side 910.

Figure 10:
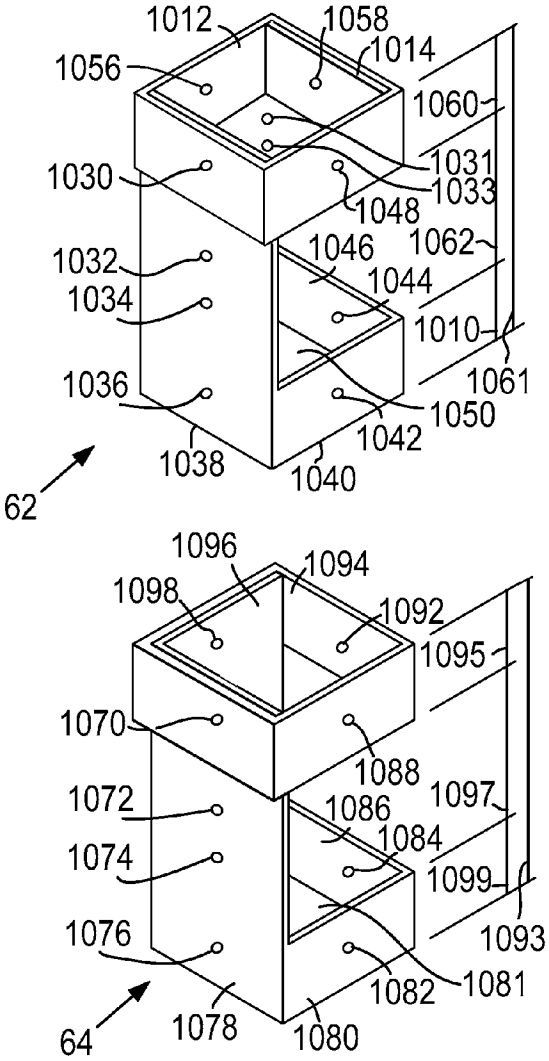
FIG. 10 shows a partial section view of a deck system and shows brackets in accordance with example embodiment(s).
Figure 10:
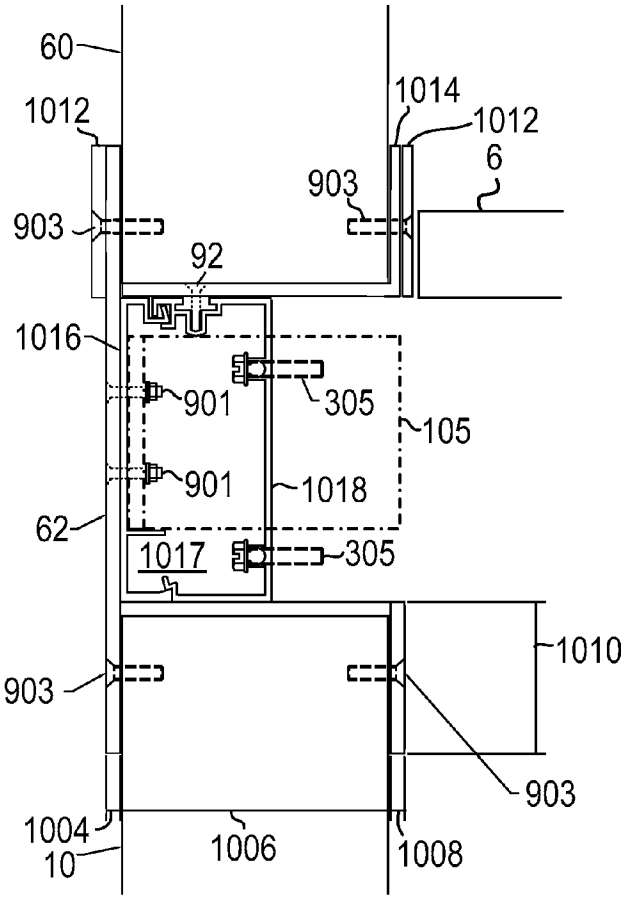

Next, FIG. 10 shows a partial section view 1000 of a portion of a box-frame assembly attached to a post 10 and a deck board 6. The box-frame assembly can be configured like the box-frame 100.

Section view 1000 shows the post 10 positioned within and attached to the intermediate-post bracket 62 using the fasteners 903. Dimensions 1004, 1006, 1008, and 1010 are provided to provide perspective with respect to the intermediate-post bracket 62. The dimensions 1004 and 1008 can represent a thickness of elements and the dimension 1006 can represent a length of an opening within the intermediate-post bracket 62. The dimension 1010 can represent a length (e.g., a height) of a short element of the intermediate-post bracket 62. The dimensions 1004 and 1008 can be three sixteenths of an inch (i.e., 3/16") or some other number of inches. The dimension 1006 can be three and nine sixteenths inches (i.e., 3 9/16") or some other number of inches. The dimension 1010 can be two inches (i.e., 2") or some other number of inches.

FIG. 10 shows a joist or box-frame-segment 1017 comprising an extrusion 1016 configured like the extrusion 800 and an extrusion 1018 configured like the extrusion 825. Extrusions 1016 and 1018 can attach to together similar to the manner in which the extrusions 800 and 825 are attached as described with respect to FIG. 23. FIG. 10 shows fasteners 305 within screw splines, such as the screw splines 831 and 832 of a joist spacer and into a joist segment.

The intermediate-post bracket 62 includes a portion that abuts joist or box-frame-segment 1017 and a portion above joist or box-frame-segment 1017. A post 60 can be positioned within support ring 1012 and above a support bracket 1014 attached to box-frame-segment 1017 using one or more deck screws 92. The support ring 1012 can include attachment holes 1030, 1048, 1056, and 1058. The support ring 1012 and the support bracket 1014 can be made of aluminum or another material. The support bracket 1014 can be configured as an L-bracket that includes attachment holes 1031 and 1033. One or more fasteners 903 can attach the intermediate-post bracket 62 and the support ring 1012 to the post 60. One or more fasteners 903 can attach the support ring 1012 and the support bracket 1014 to the post 60.

FIG. 10 shows details of the intermediate-post bracket 62, which is shown in several other figures as well. The intermediate-post bracket 62 comprises a long side 1038, short sides 1040 and 1046, another short side (not shown) opposite short side 1040 and between long side 1038 and short side 1046, and a post-opening 1050. The long side 1038 includes attachment holes 1032, 1034, and 1036, and another attachment hole in line with the attachment hole 1030 of the support ring 1012. The short side 1040 includes the attachment hole 1042. The short side 1046 includes the attachment hole 1044. The short side opposite the short side 1040 can include an attachment hole at a position similar to attachment hole 1042. The short sides 1040 and 1046 can have a height dimension 1010, as previously discussed. The long side 1038 can have a height dimension 1061 equal to eight inches or some other number of inches. The support ring 1012 can have a height dimension 1060 equal to two inches or some other number of inches. The dimension 1062 can represent a space between the short side 1040 and the support ring 1014. The dimension 1062 can equal four inches or some other number of inches.

A portion of a post, such as the post 10, can be inserted into the post-opening 1050. The fasteners, such as fasteners 903, can be inserted into the holes 1036, 1042, 1044, and an attachment hole on the short side opposite the short side 1040 to secure the intermediate-post bracket 62 to the post 10. A joist or box-frame-segment 1017, positioned above the post-opening 1050 can be attached to the intermediate-post bracket 62 using fasteners, such as fasteners 901, placed into the attachment holes 1032 and 1034.

FIG. 10 also shows details of the corner-post bracket 64, which is shown in several other figures described herein. The corner-post bracket 64 comprises long sides 1078 and 1096, short sides 1080 and 1086, and a post-opening 1081. The long side 1078 includes attachment holes 1072, 1074, and 1076, and another attachment hole in line with attachment hole 1070 of support ring 1094. The short side 1080 includes an attachment hole 1082. The short side 1086 includes an attachment hole 1084. The long side 1096 can include attachment hole 1098 and other attachment holes arranged like the attachment holes on the long side 1078. The short sides 1080 and 1086 can have a height dimension 1099 equal to two or some other number of inches. The long sides 1078 and 1096 can have a height dimension 1093 of eight or some other number of inches. The support ring 1094 can have a height dimension 1095 equal to two or some other number of inches. Dimension 1097 can represent a space between short side 1080 and support ring 1094. Dimension 1097 can equal four or some other number of inches.

A portion of a post 10 can be positioned within the post-opening 1081. Fasteners, such as fasteners 903, can be inserted into the attachment holes 1076, 1082, 1084, and an attachment hole on the long side 1096 to secure the corner-post bracket 62 to the post 10. A joist or box-frame-segment 1017, positioned above post-opening 1081 and below support ring 1096, can be attached to the corner-post bracket 62 using the fasteners 903 placed into the attachment holes 1072, 1074 and similarly positioned holes on the long side 1096.

The intermediate-post bracket 64 includes a portion that abuts joist or box-frame-segment 1017 and a portion above joist or box-frame-segment 1017. A post 60 can be positioned within the support ring 1092. The support ring 1092 can include attachment holes 1070, 1088, 1092, and an attachment hole in line with the attachment hole 1096. The support ring 1092 can be made of aluminum or another material. One or more fasteners 903 can attach the intermediate-post bracket 62 and the support ring 1092 to the post 60.

Next, FIG. 29 shows details of a corner post (or corner bracket) 959 attached to a structure 953. As an example, the corner post (or corner bracket) 959 can include a 4 inch×4 inch by 0.25 inch aluminum post or a bracket within which a 4 inch×4 inch post can be inserted. Any 4 inch×4 inch dimensions referred to herein can be replaced by a 6 inch×6 inch dimension or some other dimension. The height of the corner post (or corner bracket) 959 in post form, as with any other post described herein can depend, in part, upon an elevation above the ground at which a deck is being installed. The height of the corner post (or corner bracket) 959 in bracket form can be a fixed height for all instances and the height of posts installed into the brackets can be varied to provide the desired deck height. The corner post (or corner bracket) 959 is attached to the box-frame-segment 104A and to the box-frame-segment 101A using fasteners 957 (e.g., ¼–20×1.5 inch long flathead sheet metal screws with nut and lock washer). As shown in FIG. 29 and other figures, the box-frame-segment 104A is attached to the structure 953 using a fastener 1310 and may be separated from the structure 953 by one or more shims 1306. The box-frame-segment cover 199 and the joist spacer 175 are attached to box-frame-segments 101A and 104A, respectively, below the deck boards 961 and 963, which are separated by a 90° deck-clip 515.

FIG. 29 shows details of an intermediate post (or intermediate bracket) 949 (i.e., a post or bracket not in a corner of a deck system). The intermediate post (or intermediate bracket) 949 can include a 4 inch×4 inch by 0.25 inch aluminum post. The intermediate post (or intermediate bracket) is centered with respect to a joist 951 and is adjacent to the structure 953. The intermediate post (or intermediate bracket) 949 is attached to the box-frame-segment 104A using fastener(s) 957. The joist 951 can include any of the joists, joist segment, joist spacers, or joist assemblies described herein as attaching to the box-frame-segment 104A. The deck boards 961 and 963 are separated by another instance of a 90° deck-clip 515.

FIG. 29 shows details of a corner post (or corner bracket) 971. The corner post (or corner bracket) 971 can include a 4 inch×4 inch by 0.25 inch aluminum post. The corner post or bracket (or corner bracket) 971, like other posts, can include four sides, such as sides 253, 255, 259, and 261. The corner post (or corner bracket) 971 is attached to the box-frame-segment 101A and to the box-frame-segment 102A using fasteners 957. Since the box-frame-segments 101A and 102A are not directly attached to the structure 953, the corner post (or corner bracket) 971 can be referred to as an independent corner post. The box-frame-segment cover 199 and the joist spacer 177 are attached to box-frame-segments 101A and 102A, respectively, below the deck boards 973 and 975, which are separated by another instance of a 90° deck-clip 515.

FIG. 29 shows details of an intermediate post (or intermediate bracket) 977. The intermediate post (or intermediate bracket) 977 can include a 4 inch×4 inch by 0.25 inch aluminum post. The intermediate post (or intermediate bracket) 977 is centered with respect to a joist 979. The intermediate post (or intermediate bracket) 977 is attached to the box-frame-segment 102A using a fastener(s) 957. Since the box-frame-segment 102A is not directly attached to the structure 953, the intermediate post (or intermediate bracket) 977 can be referred to as an independent intermediate post. The joist 979 can include any of the joists, joist segment, joist spacers, or joist assemblies described herein as attaching to the box-frame-segment 102A. The deck boards 973 and 975 are separated by another instance of a 90° deck-clip 515.

The lower portion of FIG. 29 shows aspects of some of the deck components shown in FIG. 29. In particular, the lower left portion of FIG. 29 shows a sectional view of the corner post (or corner bracket) 971, the box-frame-segment 102A, and the joist spacer 177. The corner post (or corner bracket) 971 includes a bearing area 989 at which a load of the box-frame-segment 102A, the joist spacer 177, and the joist spacer 199 contacts the corner post (or corner bracket) 971.

In one respect, the corner post (or corner bracket) 971 can include a single partial side that is concealed by the box-frame-segments to which the corner post (or corner bracket) 971 is attached. A bottom portion 993 of the box-frame-segment 102A and a portion of the reinforcement shelf 421 (not shown) at location 263 can be milled to allow an upper part of the side 253 of the corner post (or corner bracket) 971 to be positioned within the box-frame-segment 102A. In this way, an upper part of the side 253 of the corner post (or corner bracket) 971 is concealed within the box-frame-segment 102A.

In another respect, the corner post (or corner bracket) 971 can include multiple partial sides that are concealed by the box-frame-segments to which the corner post (or corner bracket) 971 is attached (e.g., the upper part of the side 253 can be concealed by the box-frame-segment 102A and an upper part of the side 251 can be concealed by the box-frame-segment 101A. The box-frame-segment 101A can be milled at a bottom portion of the box-frame-segment 101A similar to the bottom portion 993, and at a portion of the reinforcement shelf 421 of the box-frame-segment 101A to allow the upper part of the side 251 to be positioned within the box-frame-segment 101A.

A top portion of the upper part of the side of a post (or post bracket) inserted into a box-frame-segment can be inserted into a reinforcement guide, such as the reinforcement guide 427, of a box-frame-segment. The reinforcement guide can have a width slightly larger than a width of the side of the post such that the side of the post can effectively lock into the reinforcement guide. The side of a post (or post bracket, or reinforcement element or corner angle clip) locked into a reinforcement guide can be unlocked (e.g., removed) by applying sufficient forces to one or both of the post and the box-frame-segment having the reinforcement guide. Top portions of one or more sides of other posts (or post bracket, or reinforcement element or corner angle clip) described herein or used in an example deck system can also be locked into and unlocked from a reinforcement guide of a box-frame-segment. Attachment holes 141 are milled within the reinforcement fin 995 to allow for positioning the fasteners 957 that are used to attach the box-frame-segment 102A to the corner post (or corner bracket) 971.

The lower right portion of FIG. 29 shows other aspects of some of the deck components shown in FIG. 29. In particular, FIG. 29 shows the corner post (or corner bracket) 959, the box-frame-segment 101A, and the fasteners 957. A bottom portion 997 of the box-frame-segment 101A is milled to allow an upper wall section of the corner post (or corner bracket) 959 to be positioned within the box-frame-segment 101A. The upper wall section of the corner post (or corner bracket) 959 is releasably attached to the box-frame-segment 101A using the fasteners 957.

Figure 30:
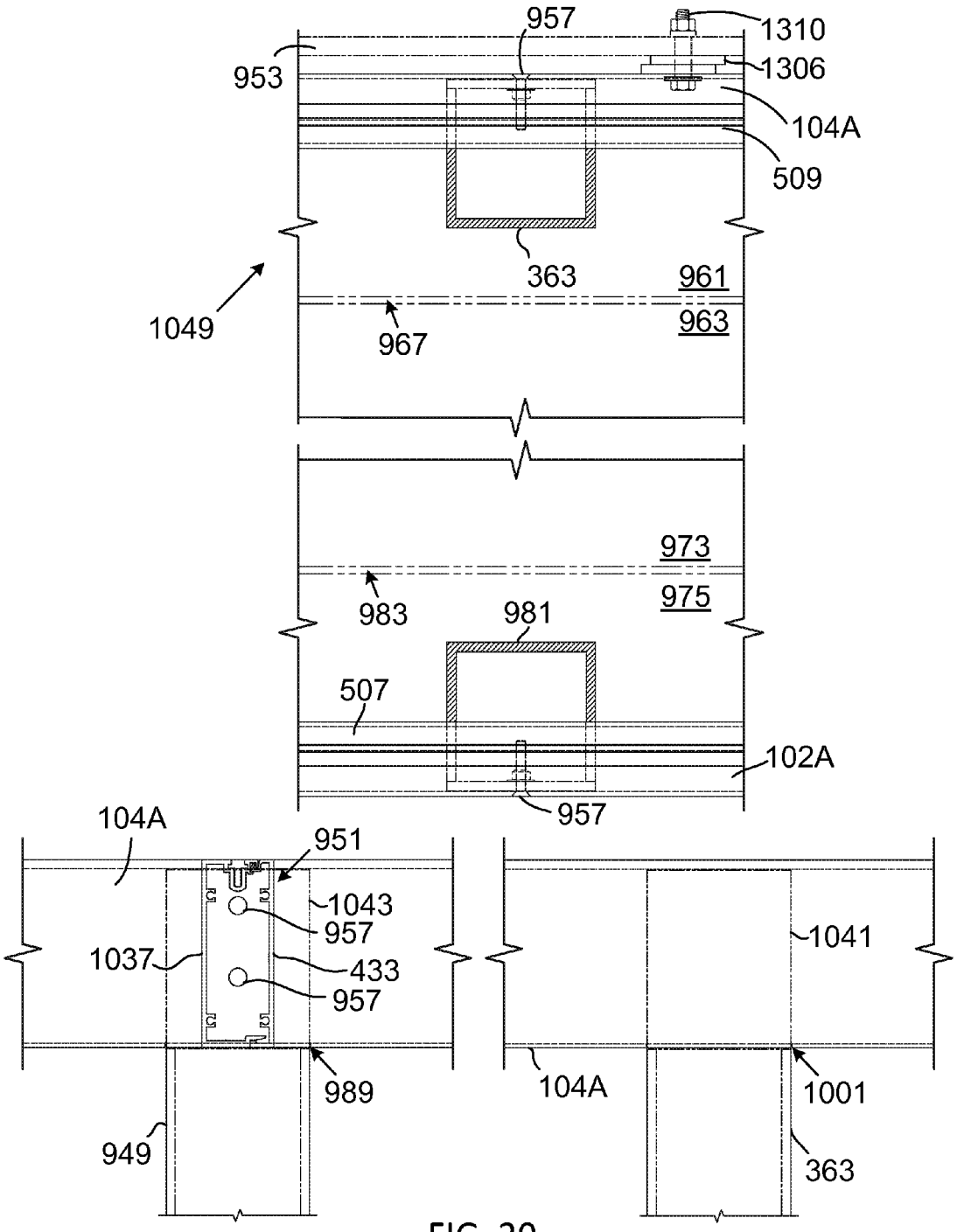

Next, the top of FIG. 30 shows details of the intermediate post (or intermediate bracket) 363 of the deck system 341 shown in FIG. 25. The intermediate post (or intermediate bracket) 363 is offset with respect to the joists 347 and 349 and is adjacent to the structure 953. The intermediate post (or intermediate bracket) 363 can include a 4 inch×4 inch by 0.25 inch aluminum post. The intermediate post (or intermediate bracket) 363 is attached to the box-frame-segment 104A using the fastener(s) 957. FIG. 30 shows the deck boards 961 and 963 separated by a gap 967. The gap 967 can exist because of the placement of 90° deck-clips 515 rather than the deck-clips 565 and 605 shown in FIG. 25. A joist spacer, such as the joist spacer 509 shown in FIG. 40, can attach to the box-frame-segment 104A in proximity to the intermediate post (or intermediate bracket) 363. That joist spacer can include an extrusion like the box-frame-segment attachment 405 shown in FIG. 26.

Next, the center of FIG. 30 shows details of an intermediate post (or intermediate bracket) 981. The intermediate post (or intermediate bracket) 981 is not shown in the deck system 341 of FIG. 25, but can be installed within the deck system 341 in between two joists such as joists 347 and 349. Installing the intermediate post (or intermediate bracket) 981 in between the joists 347 and 349 may permit for omitting the post (or bracket) 369 shown in FIG. 25. The intermediate post (or intermediate bracket) 981 can include a 4 inch×4 inch by 0.25 inch aluminum post. The intermediate post (or intermediate bracket) 981 can attach to the box-frame-segment 102A using the fastener(s) 957. Since the box-frame-segment 102A is not directly attached to the structure 953, the intermediate post (or intermediate bracket) 981 can be referred to as an independent intermediate post. The deck boards 973 and 975 are attached to the deck system 341 in proximity to the intermediate post (or intermediate bracket) 981. The deck boards 973 and 975 are separated by a gap 983 that can exist because of the placement of 90° deck-clips 515. A joist spacer, such as the joist spacer 507 shown in FIG. 40, can attach to the box-frame-segment 102A in proximity to the intermediate post (or intermediate bracket) 981. That joist spacer can include an extrusion like the box-frame-segment attachment 405 shown in FIG. 26.

Next, the lower left portion of FIG. 30 shows aspects of some of the deck components shown in upper right portion of FIG. 29. In particular, the lower left portion of FIG. 30 shows the intermediate post (or intermediate bracket) 949, the box-frame-segment 104A, and the joist 951. The joist 951 includes the joist segment 1037 and the joist segment 433. A bottom portion 989 of the box-frame-segment 104A can be milled to allow an upper portion of three wall sections of the intermediate post (or intermediate bracket) 949 to be positioned within the box-frame-segment 104A. A bottom portion of the joist spacers 509 attached to the box-frame-segment 104A can also be milled to allow an upper portion 1043 of a respective wall section of the intermediate post (or intermediate bracket) 949 to be positioned within the joist spacers 509. The milling of the joist spacers 509 and the box-frame-segment 104A allow for the upper portions of the intermediate post (or intermediate bracket) 949 to be concealed.

Next, the lower right portion of FIG. 30 shows aspects of some of the deck components shown in the upper portion of FIG. 30. In particular, the lower right portion of FIG. 30 shows the intermediate post (or intermediate bracket) 363 and the box-frame-segment 104A. A bottom portion 1001 of the box-frame-segment 104A can be milled to allow an upper portion of three wall sections of the intermediate post (or intermediate bracket) 363 to be positioned within the box-frame-segment 104A. A bottom portion of the joist spacer 509 attached to the box-frame-segment 104A can also be milled to allow an upper portion 1043 of a respective wall section of the intermediate post (or intermediate bracket) 363 to be positioned within the joist spacer 509.

Figure 31:
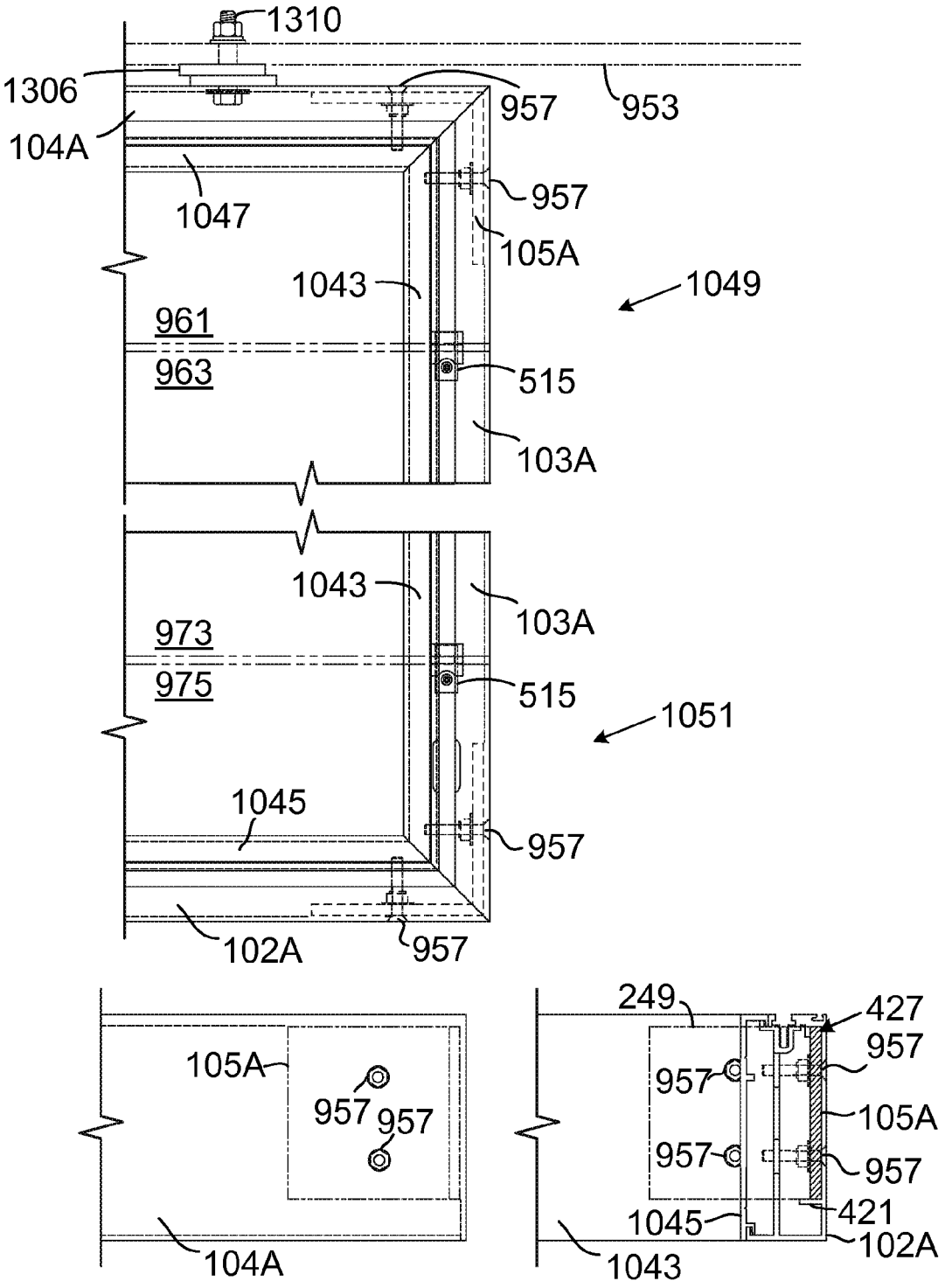

Next, the upper portion of FIG. 31 shows details in the detail area 1049 of the deck system 341 shown in FIG. 25. The detail area 1049 shows the box-frame-segment 104A attaches to the structure 953 using a fastener 1310 and are separated by a shim 1306. The corner of the deck system 341 shown in the detail area 1049 includes a corner angle clip 105A where two box-frame-segments 104A and 103A abut one another. The corner angle clip can be used with the box-frame-segments 103A and 104A. The corner angle clip 105A can include or be formed from a 4 inch by 4 inch by 0.25 inch by 4 inch piece of aluminum. The corner angle clip 105A can attach to the box-frame-segments 103A and 104A using the fasteners 957. The deck boards 961 and 963 are separated by another instance of a 90° deck-clip 515. A box-frame-segment attachment 1047 is attached to the box-frame-segment 104A. A box-frame-segment attachment 1043 is attached to the box-frame-segment 103A. The box-frame-segment attachments 1043 and 1047 can include an extrusion having the features of the box-frame-segment attachment 405. One or more of the box-frame-segment attachments 1043 and 1047 can be part of a joist assembly including the joist 351 shown in FIG. 25.

Next, the center portion of FIG. 31 shows details in the detail area 1051 of the deck system features 1053 shown in FIG. 25. The detail area 1051 shows the box-frame-segment 102A and the box-frame-segment 103A and the corner angle clip 105A located where two box-frame-segments 102A and 103A abut one another. The corner angle clip can be used with the box-frame-segments 103A and 104A. The corner angle clip 105A can include or be formed from a 4 inch by 4 inch by 0.25 inch by 4 inch piece of aluminum. The corner angle clip 105A can attach to the box-frame-segments 102A and 103A using the fasteners 957. The deck boards 973 and 975 are separated by another instance of a 90° deck-clip 515. A box-frame-segment attachment 1045 is attached to the box-frame-segment 102A. A box-frame-segment attachment 1043 is attached to the box-frame-segment 103A. The box-frame-segment attachments 1043 and 1045 can include an extrusion having the features of the box-frame-segment attachment 405. One or more of the box-frame-segment attachments 1043 and 1045 can be part of a joist assembly including the joist 351 shown in FIG. 25.

Next, the lower left portion of FIG. 31 shows aspects of some of the deck components shown in the detail area 1049 of FIG. 31. In particular, the lower left portion of FIG. 31 shows an elevation view of the corner angle clip 105A, the box-frame-segment 104A, and the fasteners 957.

Next, the lower right portion of FIG. 31 shows aspects of some of the deck components shown in the detail area 1051 of FIG. 31. In particular, the lower right portion of FIG. 31 shows an elevation view of the corner angle clip 105A, the box-frame-segment 102A, the box-frame-segment attachments 1043 and 1045, and the fasteners 957. A top part of the corner-clip angle 105A can be inserted into the reinforcement guide 427 of the box-frame-segment 102A and another top part 249 of the corner angle clip 105A can be inserted into the reinforcement guide 427 of the box frame segment 103A. That insertion and placement onto the reinforcement shelf 421 can allow for the corner angle clip 105A to be locked into a box-frame-segment. Corner angle clips 105A inserted into other box-frame-segments having a reinforcement guide can also be locked into and unlocked from a reinforcement guide of those other box-frame-segments.

Figure 32:
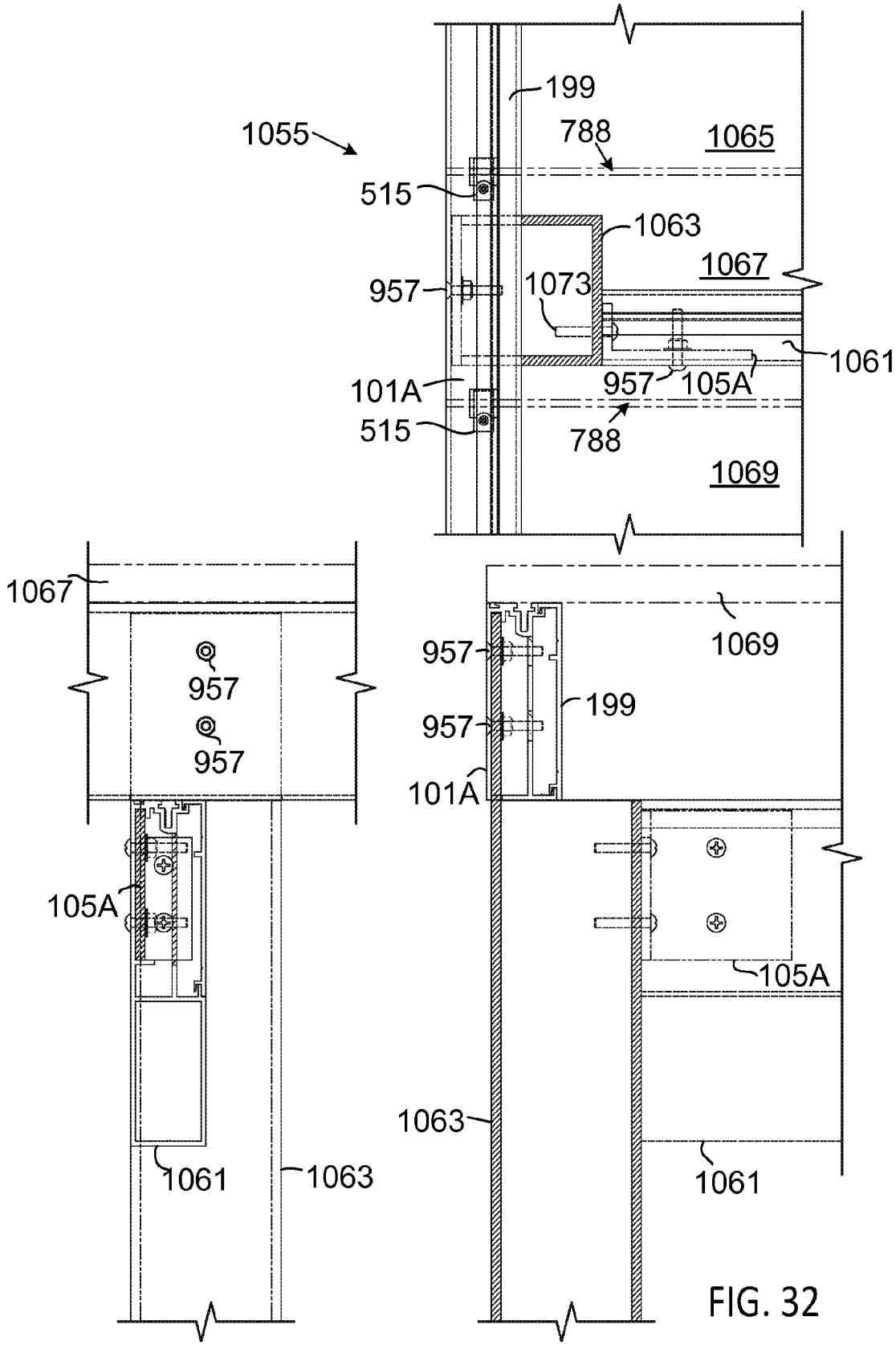

Turning to FIG. 32, the upper portion of FIG. 32 shows details in the detail area 1055 of the deck system features 1053 shown in FIG. 25. The detail area 1055 shows a post (or bracket) 1063 attached to the box-frame-segment 101A by the fastener(s) 957 and attached to the support beam 1061 and the angle clip 105A by fastener(s) 1073, such as ¼–20×1.5 inch Philips head sheet metal screw(s). The post (or bracket) 1063 and the box-frame-segment 101A can provide support for deck boards 1065, 1067, and 1069 separated by deck board gaps 788 provided for by use of the deck-clips 515. The support beam 1061 can include extrusions having the features of the box-frame-segment assembly 485 shown in FIG. 26 or can include features of a common aluminum shape. The angle clip 105A can be attached to the support beam 1061 using fastener(s) 957. The support beam 1061 can provide support for the box-frame-segment cover 199 attached to the box-frame-segment 101A. Portions of the box-frame-segment 101A and the box-frame-segment cover 199 can be milled to allow upper portions of the post (or bracket) 1063 to be positioned within and concealed by the box-frame-segment 101A and the box-frame-segment cover 199.

The lower left portion of FIG. 32 shows an elevation view of elements shown in the detail area 1055. In particular, the lower left portion of FIG. 32 shows a cross section view of the post (or bracket) 1063, the support beam 1061, the angle clip 105A positioned within the support beam 1061, the fasteners 957 that attach the post (or bracket) 1063 to the box-frame-segment 101A, and the deck board 1067.

The lower right portion of FIG. 32 shows another elevation view of elements shown in the detail area 1055. In particular, the lower right portion of FIG. 32 shows the post (or bracket) 1063, the support beam 1061, the angle clip 105A, the box-frame-segment 101A and the box-frame-segment attachment 199, and the deck board 1069.

Figure 33:
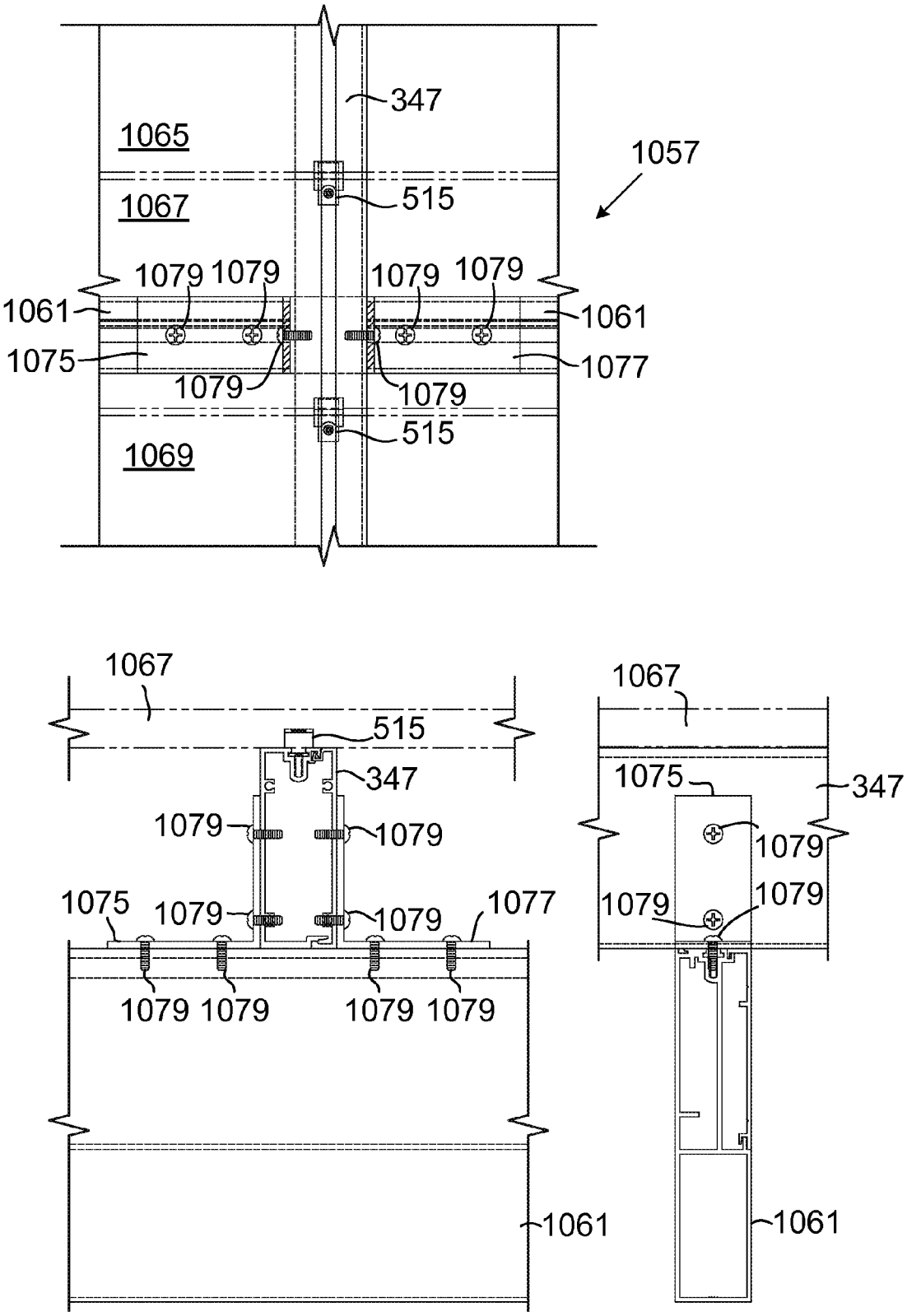

Turning to FIG. 33, the upper portion of FIG. 33 shows details in the detail area 1057 of the deck system features 1053 shown in FIG. 25. The detail area 1057 shows the joist 347, the support beam 1061, a joist bracket 1075, and a joist bracket 1077. The joist brackets 1075 and 1077 are attached to the joist 347 and to the support beam 1061 by fasteners 1079. As an example, the fasteners 1079 can include Phillips head sheet metal screws. The joist brackets 1075 and 1077 can include a 4 inch×4 inch×0.1875 inch×2 inch clip angle made of aluminum or another metal. Other example dimensions of the joist brackets 1075 and 1077 are also possible. The deck boards 1065, 1067 and 1069 can be positioned on the joist 347 and separated by the use of the deck-clips 515.

The lower left portion of FIG. 33 shows additional aspects of some of the deck components shown in the detail area 1057 by way of an elevation view. In particular, this elevation view shows the support beam 1061, the joist 347, the joist bracket 1075, the joist bracket 1077, the fasteners 1079, the deck board 1067, and a deck-clip 515.

The lower right portion of FIG. 33 shows additional aspects of some of the deck components shown in the detail area 1057 by way of another elevation view. In particular, this elevation view shows the support beam 1061, the joist 347, the joist bracket 1075, the fasteners 1079, and the deck board 1067.

Figure 34:
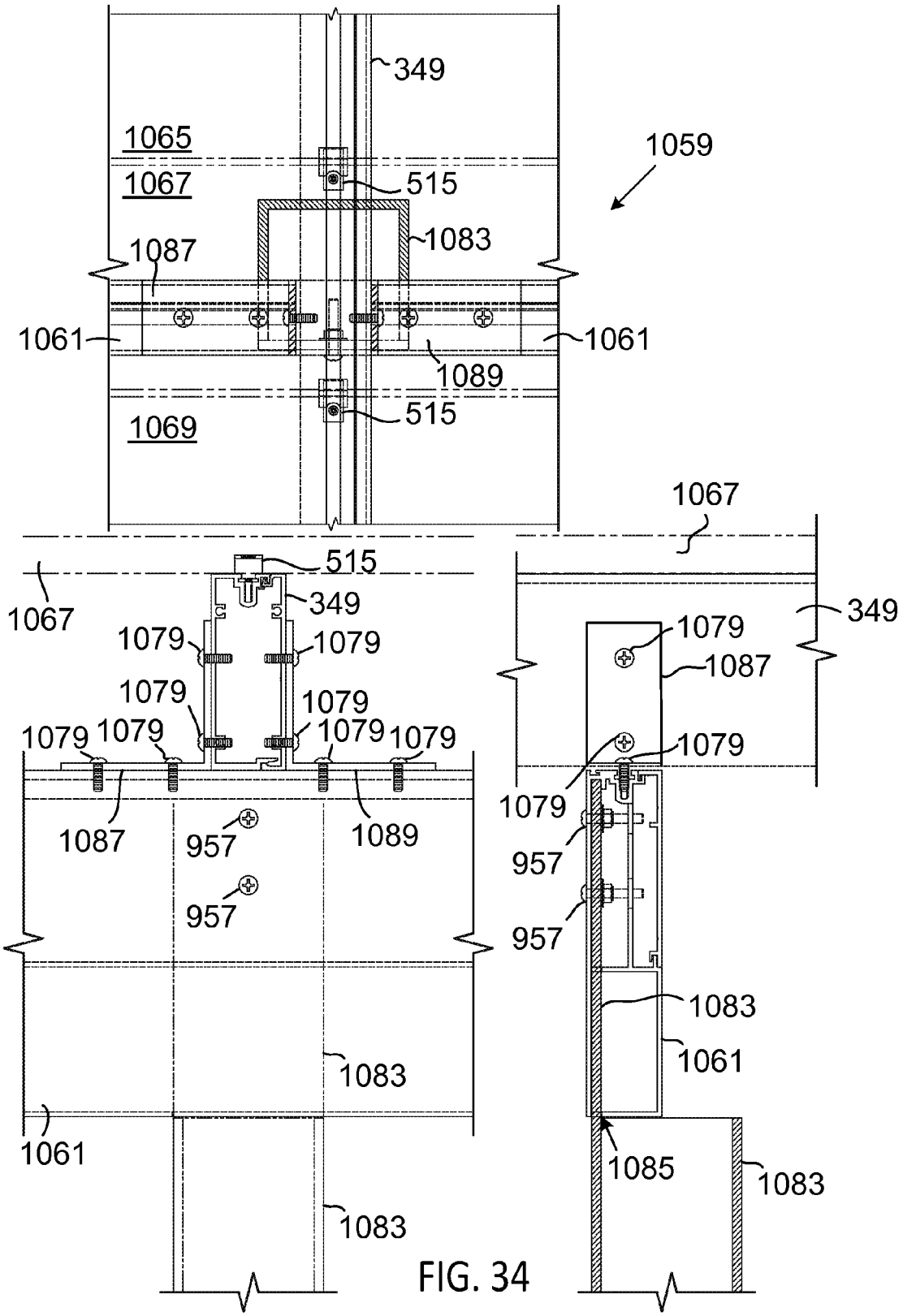

Turning to FIG. 34, the upper portion of FIG. 34 shows details in the detail area 1059 of the deck system features 1053 shown in FIG. 25. The detail area 1059 shows the joist 349, the support beam 1061, a post (or bracket) 1083, a joist bracket 1087, and a joist bracket 1089. The joist brackets 1087 and 1089 are attached to the joist 349 and to the support beam 1061 by fasteners 1079. The joist brackets 1087 and 1089 can be configured like the joist brackets 1075 and 1077 shown in FIG. 33. The deck boards 1065, 1067 and 1069 can be positioned on the joist 349 and separated by the use of the deck-clips 515.

The lower left portion of FIG. 34 shows additional aspects of some of the deck components shown in the detail area 1059 by way of an elevation view. In particular, this elevation view shows the support beam 1061, the joist 349, the joist bracket 1087, the joist bracket 1089, the fasteners 1079, the deck board 1067, a deck-clip 515, the post (or bracket) 1083, and fasteners 957 used to attach the post (or bracket) 1083 to the support beam 1061. An area 1085 of the support beam 1061 can be milled to allow an upper portion of the post (or bracket) 1083 to be positioned within and concealed by the support beam 1061.

The lower right portion of FIG. 34 shows additional aspects of some of the deck components shown in the detail area 1059 by way of another elevation view. In particular, this elevation view shows the support beam 1061, the joist 349, the joist bracket 1087, the fasteners 1079, the deck board 1067, the post (or bracket) 1083, the area 1085 of the post (or bracket) 1083 is milled to allow the upper portion of the post (or bracket) 1083 to be positioned within the support beam 1061. The fasteners 957 are used to attach the post (or bracket) 1083 to the support beam 1061.

G. Additional Deck System Details

Next, FIG. 11 shows a partial section view 1100 through various portions of the deck system 704 shown in FIG. 7. The section view 1100 shows a perimeter joist 1102 of the deck system 704 having a lower surface 1103 and alternative lower surfaces 1104, 1105, and 1106 such that the perimeter joist 1102 can be formed with extrusions of different heights. The extrusions having longer heights can be used for longer spans of the perimeter joist 1102.

The perimeter joist 1102 can be formed by attaching an extrusion 1108 to an extrusion 1109. The extrusion 1108 can be configured like the extrusion 800. The extrusion 1108 can be a box-frame-segment of the box-frame 100. The extrusion 1108 can be configured like the extrusion 825 or the extrusion 850. The extrusion 1108 can be a joist segment of a joist assembly, such as the joist assembly 300 or the joist assembly 320. A deck board 6 is attached to the perimeter joist 1102 using the deck-clip 5 and a deck-clip screw 92. That deck board, deck-clip, and deck-clip screw are not shown in FIG. 7.

An angle clip 105 attaches to the perimeter joist 1102 and to a joist spacer 1110 of the box-frame of deck system 704. The fasteners 903 can fasten the angle clip 105 to the perimeter joist 1102. In FIG. 11, the fasteners 305 can be positioned within screw splines, such as the screw splines 831 and 832 described with respect to FIG. 8. The fasteners 305 can be positioned within screw splines of one or more extrusions, such as the extrusions of a joist segment and into a joist spacer.

A dimension 1157 pertains to the section view 1100 and to another section view 1150 shown in FIG. 11. The dimension 1157 represents a height of the perimeter joist 1102. The dimension 1157 can equal four or another number of inches. The dimension 1107 represents an example width of the perimeter joist 1102. The dimension 1107 can equal 1.75 (i.e., 1¾) inches or another number of inches.

The section view 1150 is another partial section view through the deck system 704 shown in FIG. 7. The section view 1150 shows details of a multi joist segment 1151 formed by joist segments 1159 and 1160. The joist segment 1159 is configured like the extrusion 800 and is part of the joist assembly 710. The joist segment 1160 is configured like the extrusion 825 and is part of the joist assembly 712. The section view 1150 shows a lower surface 1152 of the multi joist segment 1151 and alternative lower surfaces 1153, 1154, and 1155 of the multi joist segment 1151. Extrusions having longer heights can be used for longer spans of the multi joist segment 1151.

A deck board 6 is attached to the multi joist segment 1151 using the deck-clip 5 and a deck-clip screw 92. That deck board, deck-clip, and deck-clip screw are not shown in FIG. 7. The multi joist segment 1151 is attached to the joist spacers 1161 and 1162 of respective joist assemblies. The dimension 1156 represents an example width of the multi joist segment 1151. The dimension 1156 can equal 1.75 (i.e., 1¾) inches or another number of inches. A reinforcing angle 1158 can be used within the multi joist segment 1151.

Next, FIG. 13 a partial section view 1300 through a portion of the deck system 704 and a portion of the joist assembly 708 shown in FIG. 7. FIG. 13 shows the joist spacer 1308 and a joist segment 1318 of the joist assembly 708, and the box-frame-segment 1404 of box-frame 100 of the deck system 704. The box-frame-segment 1404 is configured like the extrusion 800. The joist spacer 1308 is configured like the extrusion 850. The joist segment 1318 can be configured like the extrusion 800, the extrusion 825, or the extrusion 850.

The joist spacer 1308 and the box-frame-segment 1404 can attach securely together at an attachment point 1316 using the locking tab of the box-frame-segment 1404 and the locking tab retainer of the joist spacer 1308, and using the roll-lock tab and roll-lock tab receivers of the box-frame-segment 1404 and the joist spacer 1308. Fasteners 902 can attach the joist spacer 1308 to the joist segment 1318.

FIG. 13 shows the box-frame-segment 1404 is attached to the structure 702 using fasteners 1310 and 1312. The fastener 1310 can include a lag screw used without fastener 1312. Shims 1306 are positioned between the box-frame-segment 1404 and the external line of the structure 702. The shims 1306 can include through-holes to allow the fastener 1310 to pass through the shims 1306. Alternatively, the shims 1306 can be positioned adjacent to the fastener 1310. The fastener 1312 can include a nut that abuts an internal line 1402 representing, for example, a wall of the structure 702.

FIG. 13 shows a deck-clip 5 and a deck-clip screw 92 positioned within the joist spacer 1308. FIG. 13 shows a deck board 6 attachable to the deck system 700, and the attached box-frame-segment 1404 and the joist spacer 1308 having a lower surface 1302 or alternative lower surfaces 1303, 1304, and 1305. The alternative lower surfaces provide for longer spans of the box-frame-segment 1404 and the joist spacer 1308 or for increased loading of the deck system 700. A dimension 1307 represents an example width of the attached box-frame-segment 1404 and the joist spacer 1308. The dimension 1307 can equal two inches or another dimension.

FIG. 13 also shows a partial section view 1301 for a portion of the deck systems 704 and 705 shown in FIG. 7. The partial section view 1301 shows the joist spacers 1320 and 1324, configured like the extrusion 800, and the box-frame-segment 1322, configured like the extrusion 875. The box-frame-segment 104 of the box-frame 100 can include the box-frame-segment 1322. The joist spacer 1320 can be a joist spacer of the joist assembly 710. The joist spacer 1324 can be a joist spacer of the joist assembly 720. The partial section view 1301 shows attachment points 1326 and 1328 of the locking tabs of the box-frame-segment 1322 to the locking tab retainers of the joist spacers 1320 and 1324. The partial section view 1301 also shows retaining points 1330 and 1332 of roll-lock tabs of the joist spacers 1320 and 1324 within roll-lock tab receivers of the box-frame-segment 1322.

Figure 14:
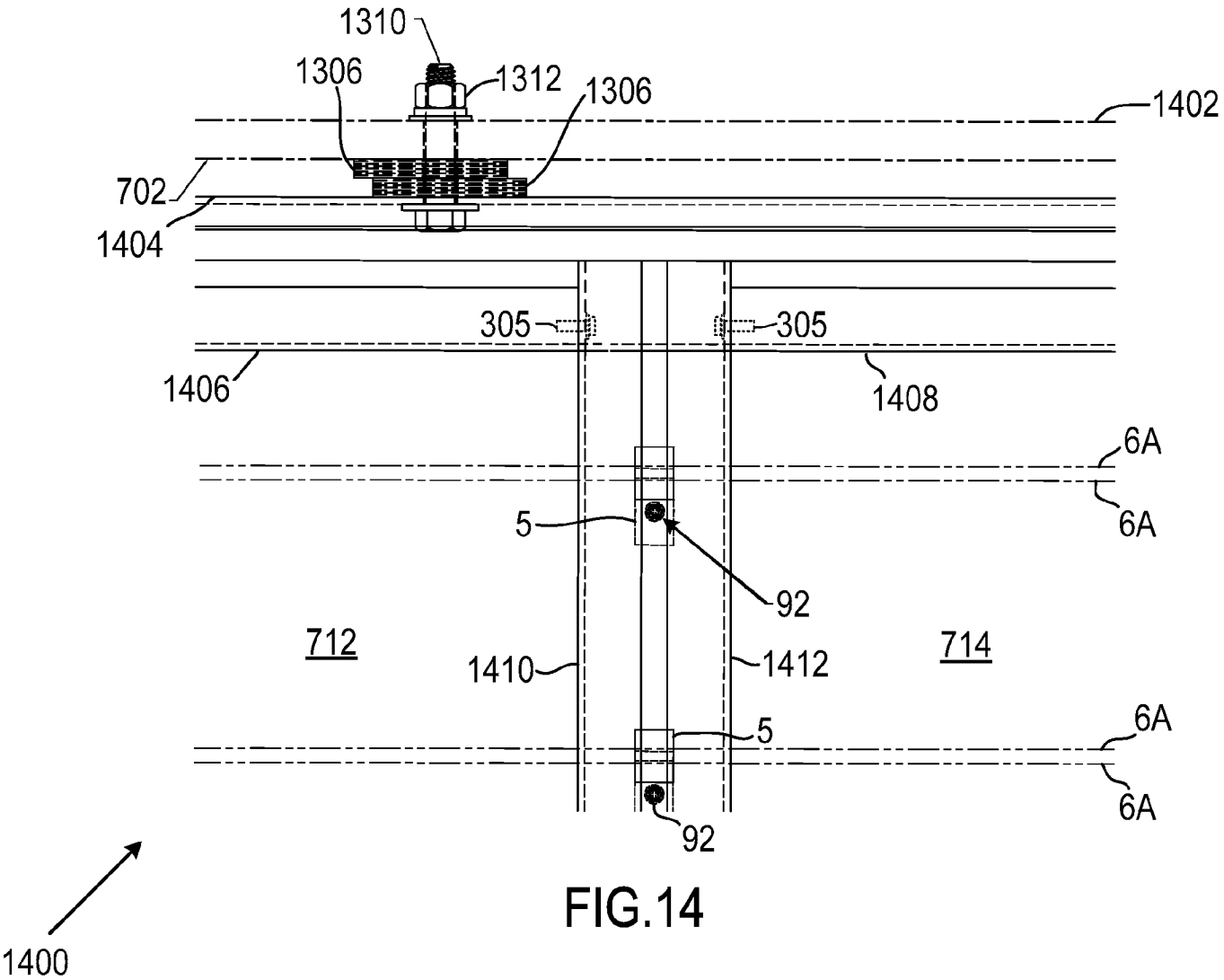
FIGS. 14, 15, 16, 17, 18, and 19 are large-scale views of portions of a deck system shown in FIG. 7.

Next, FIG. 14 is a large-scale plan view of a portion 1400 of the deck system 700 shown in FIG. 7. FIG. 14 shows that portion of the deck system 700 attached to the structure 702 using the fasteners 1310 and 1312. The shims 1306 are positioned between a box-frame-segment 1404 and an external line of the structure 702. The fasteners 1310 and 1312 and the shims 1306 can be positioned in other positions of the structure 702 and the box-frame-segment 1404. For example, the fastener 1310 can be positioned such that a center line running length-wise of the fastener 1310 is coaxially with an interface point at which joist segments 1410 and 1412 abut one another, or at another position.

A box-frame-segment 1404 can be configured like the extrusion 800 and can be attached to a joist spacer 1406 of the joist assembly 712, and to a joist spacer 1408 of the joist assembly 714. The extrusions 1406 and 1408 can be configured like the extrusion 850. The joist assembly 712 includes a joist segment 1410 configured like the extrusion 800. The joist assembly 714 includes a joist segment 1412 configured like the extrusion 825. The joist spacer 1406 and the joist segment 1410 attach to one another using one or more fasteners 902 installed into screw splines of joist segment 1410. The joist spacer 1408 and the joist segment 1412 attach to one another using one or more fasteners 902 installed into screw splines of the joist segment 1412.

FIG. 14 shows deck-clips 5 and deck-clip screws 92 positioned within the joist segment 1412. FIG. 14 also shows positions of edges 6A of the deck boards 6 attachable to the deck system 700.

Figure 15:
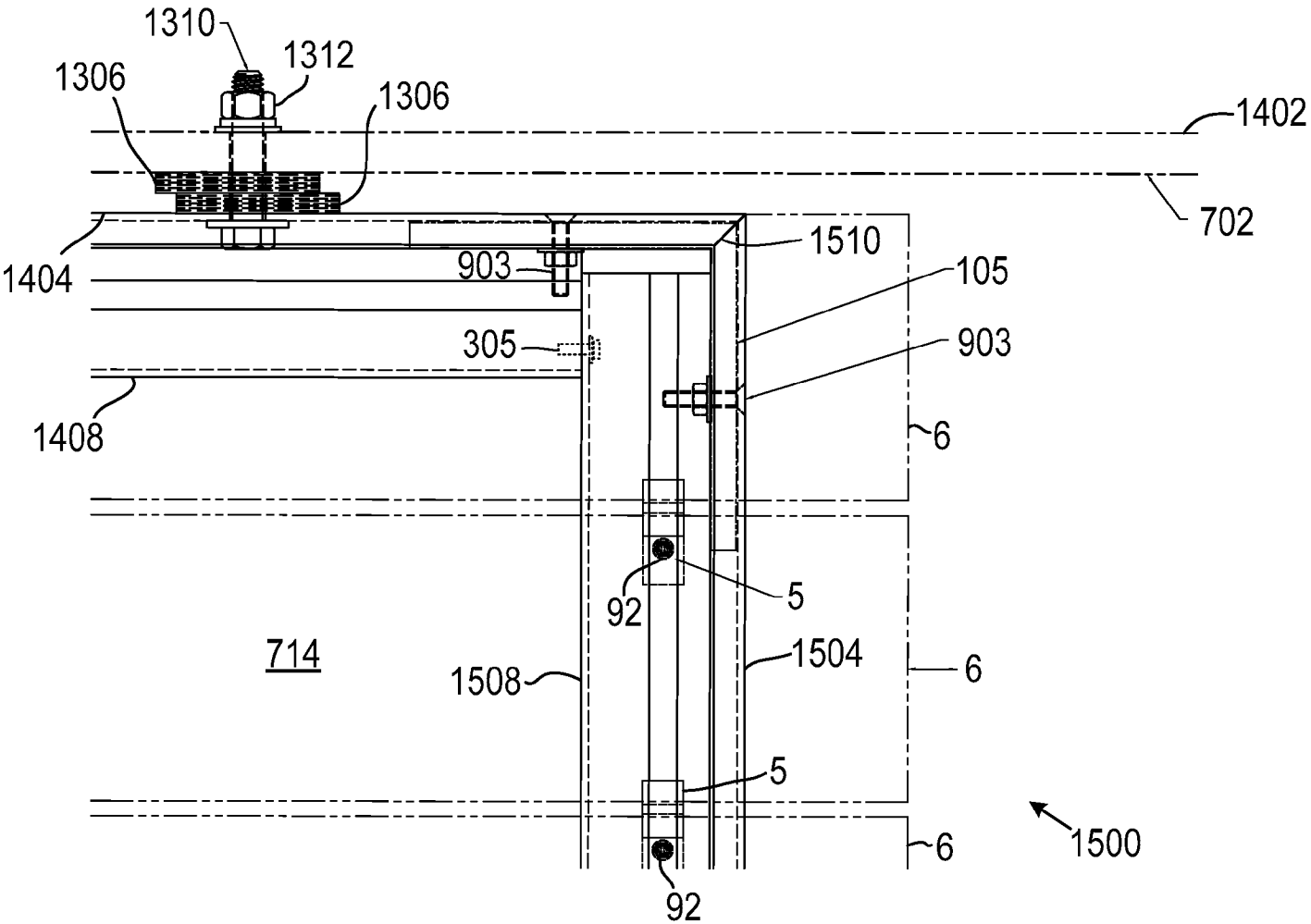

Next, FIG. 15 is a large-scale plan view of a portion 1500 of the deck system 700 shown in FIG. 7. FIG. 15 shows that portion of the deck system 700 attached to the structure 702 using the fasteners 1310 and 1312. The shims 1306 are positioned between a box-frame-segment 1404 of the box-frame 100 of the deck system 700 and an external line of the structure 702. The shims 1306 can include through-holes to allow the fastener 1310 to pass through the shims 1306. Alternatively, the shims 1306 can be positioned adjacent to the fastener 1310. The fastener 1312 can abut internal line 1402 of the structure 702.

The box-frame-segment 1404 can be configured like the extrusion 800 and can be attached to a joist spacer 1408 of the joist assembly 714. Portions of a box-frame-segments that abut one another can be mitered as shown at miter joint 1510. The joist spacer 1408 can be configured like the extrusion 850. The joist assembly 714 includes a joist segment 1508 configured like the extrusion 825 or the extrusion 850. The box-frame of the deck system 700 includes a box-frame-segment 1504 configured like the extrusion 800. The box-frame-segments 1404 and 1504 can attach to one another using angle clip 105, and angle clip 105 can attach to the box-frame-segments 1404 and 1504 using one or more fasteners 903 installed into screw splines of box-frame-segments 1404 and 1504. The deck-clips 5 and the deck-clip screws 92 can be positioned within the joist segment 1508. The joist spacer 1408 and the joist segment 1508 can be attached together using one or more fasteners 305. FIG. 15 also shows positions of the deck boards 6 attachable to the deck system 700.

Figure 16:
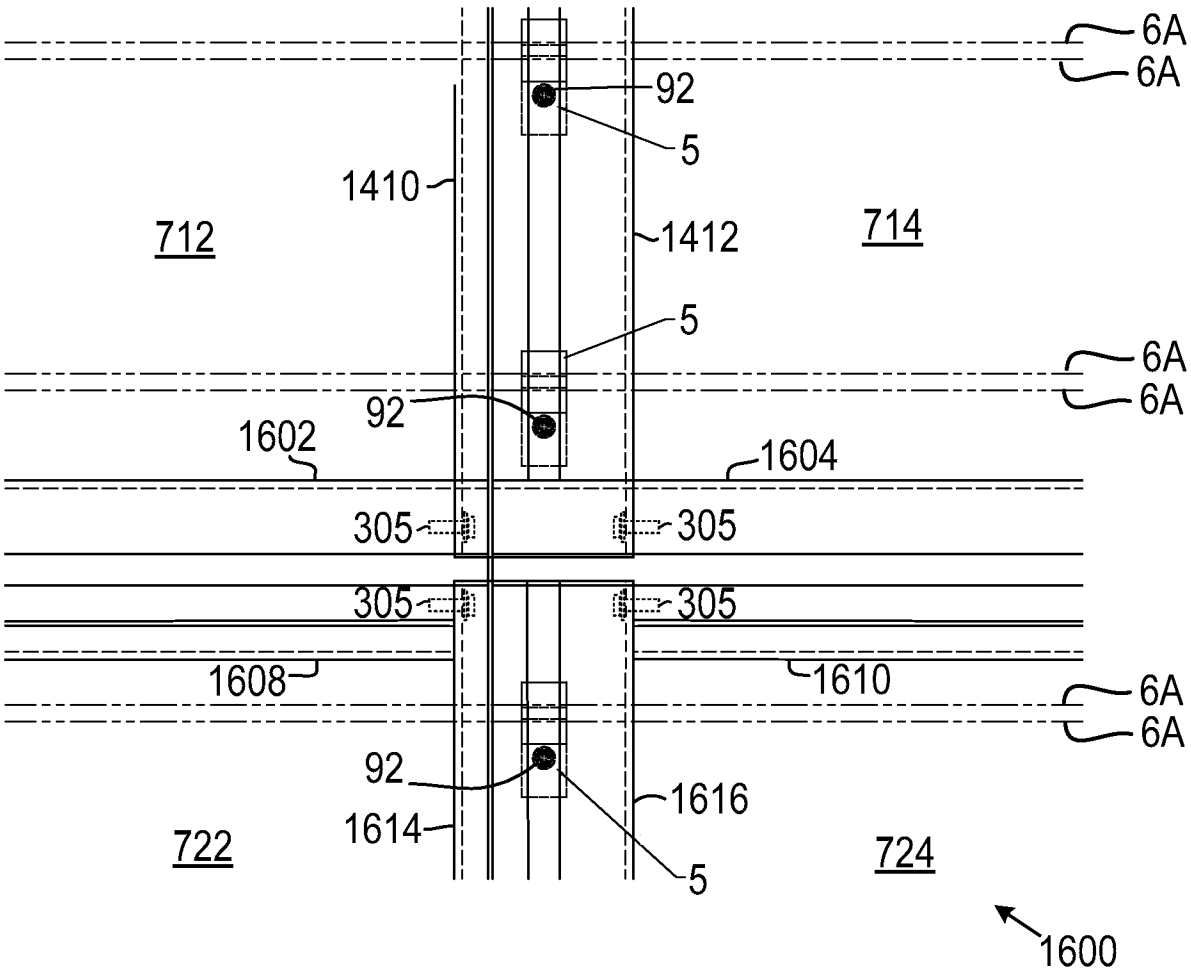

Next, FIG. 16 is a large-scale view of a portion 1600 of deck system 700 shown in FIG. 7. Portion 1600 includes extrusions of joist assemblies 712, 714, 722, and 724 shown in FIG. 7.

The joist assembly 712 includes joist segment 1410, and a joist spacer 1602 configured like the extrusion 850. The joist segments 1410 and 1602 can attach to one another using one or more fasteners 902.

The joist assembly 714 includes a joist spacer 1604 configured like the extrusion 850 and the joist segment 1412. The extrusions 1604 and 1412 can attach to one another using one or more fasteners 902. The joist assembly 714 can be the last joist assembly installed into deck system 700 during assembly and the first joist assembly removed from the deck system 700 during disassembly of the deck system 700.

The joist assembly 722 includes a joist spacer 1608 configured like the extrusion 850, and a joist segment 1614 configured like the extrusion 800. The joist spacer 1608 and the joist segment 1614 can attach to one another using one or more fasteners 902.

The joist assembly 724 includes a joist spacer 1610 configured like the extrusion 850, and a joist segment 1616 configured like the extrusion 850. The joist spacer 1610 and the joist segment 1616 can attach to one another using one or more fasteners 902. The joist assembly 724 can be the last joist assembly installed into the deck system 705 during assembly and the first joist assembly removed from the deck system 705 during disassembly of the deck system 705.

In accordance with an example embodiment, roll-lock tabs of the joist spacers 1602 and 1604 can be positioned within a roll-lock tab receiver of a box-frame-segment of the deck system 700, and roll-lock tabs of the joist spacers 1608 and 1610 can be positioned within a roll-lock tab receiver of a box-frame-segment of the deck system 705. Each of those box-frame-segments can be configured like the extrusion 800 and can be attached to one another using fasteners 902 or another type of fastener. The locking tabs of the box-frame-segments and the locking tab retainers of the joist spacers 1602, 1604, 1608, and 1610 are used for attachment of those joist spacers to the box-frame-segment.

In accordance with one or more example embodiments, such as embodiments discussed with respect to FIG. 23, the roll-lock tabs of the joist spacers 1602, 1604, 1608, and 1610 can be positioned with one of two roll-lock tab receivers within a box-frame-segment configured like the extrusion 875. The box-frame-segment configured like the extrusion 875 can be a box-frame-segment of a box-frame within the deck system 704 or 705. The locking tabs of the box-frame-segment and the locking tab retainers of the joist spacers 1602, 1604, 1608, and 1610 are used for attachment of those joist spacers.

Deck-clips 5 and deck-clip screws 92 can be positioned within joist segments 1412 and 1616. FIG. 16 also shows positions of edges 6A of deck boards 6 attachable to deck systems 704 or 705.

Figure 17:
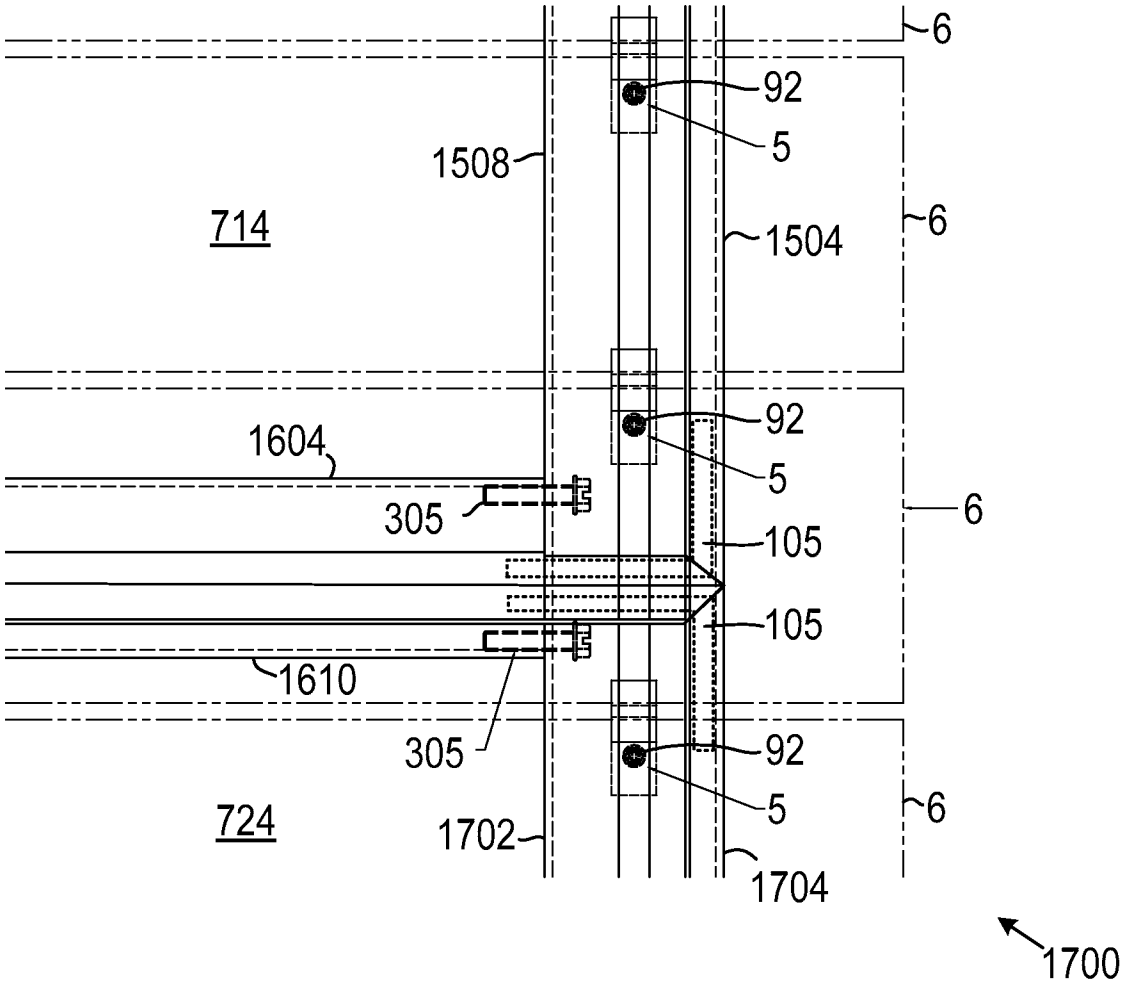

Next, FIG. 17 is a large-scale view of a portion 1700 of the deck system 700 shown in FIG. 7. Portion 1700 includes elements of the joist assemblies 714 and 724, and box-frame-segments 1504 and 1704, of the box-frames of deck systems 704 and 705, respectively. The box-frame-segment 1704, similar to box-frame 1504, can be configured like the extrusion 800.

The joist assembly 714 includes a joist spacer 1604 configured like the extrusion 850, and joist segment 1508 configured like the extrusion 825 or the extrusion 850. The joist spacer 1604 and the joist segment 1508 can attach to one another using one or more fasteners 902. The joist assembly 714 can be the last joist assembly installed into the deck system 704 during assembly and the first joist assembly removed from the deck system 704 during disassembly of the deck system 704.

The joist assembly 724 includes a joist spacer 1610 configured like the extrusion 850, and a joist segment 1702 configured like the extrusion 825 or the extrusion 850. The joist spacer 1610 and the joist segment 1702 can attach to one another using one or more fasteners 902. The joist assembly 724 can be the last joist assembly installed into the deck system 705 during assembly and the first joist assembly removed from the deck system 705 during disassembly of the deck system 705.

Angle clips 105 can be inserted into the box-frame-segments 1504 and 1704 for attaching to box-frame-segments configured like the extrusion 800. Alternatively, an angle clip 105 can be inserted into box-frame-segments 1504 and 1704 and into a box-frame-segment configured like the extrusion 875. The deck-clips 5 and the deck-clip screws 92 are positioned within the joist segments 1508 and 1702. FIG. 17 also shows positions of the deck boards 6 attachable to the deck system 700.

Figure 18:
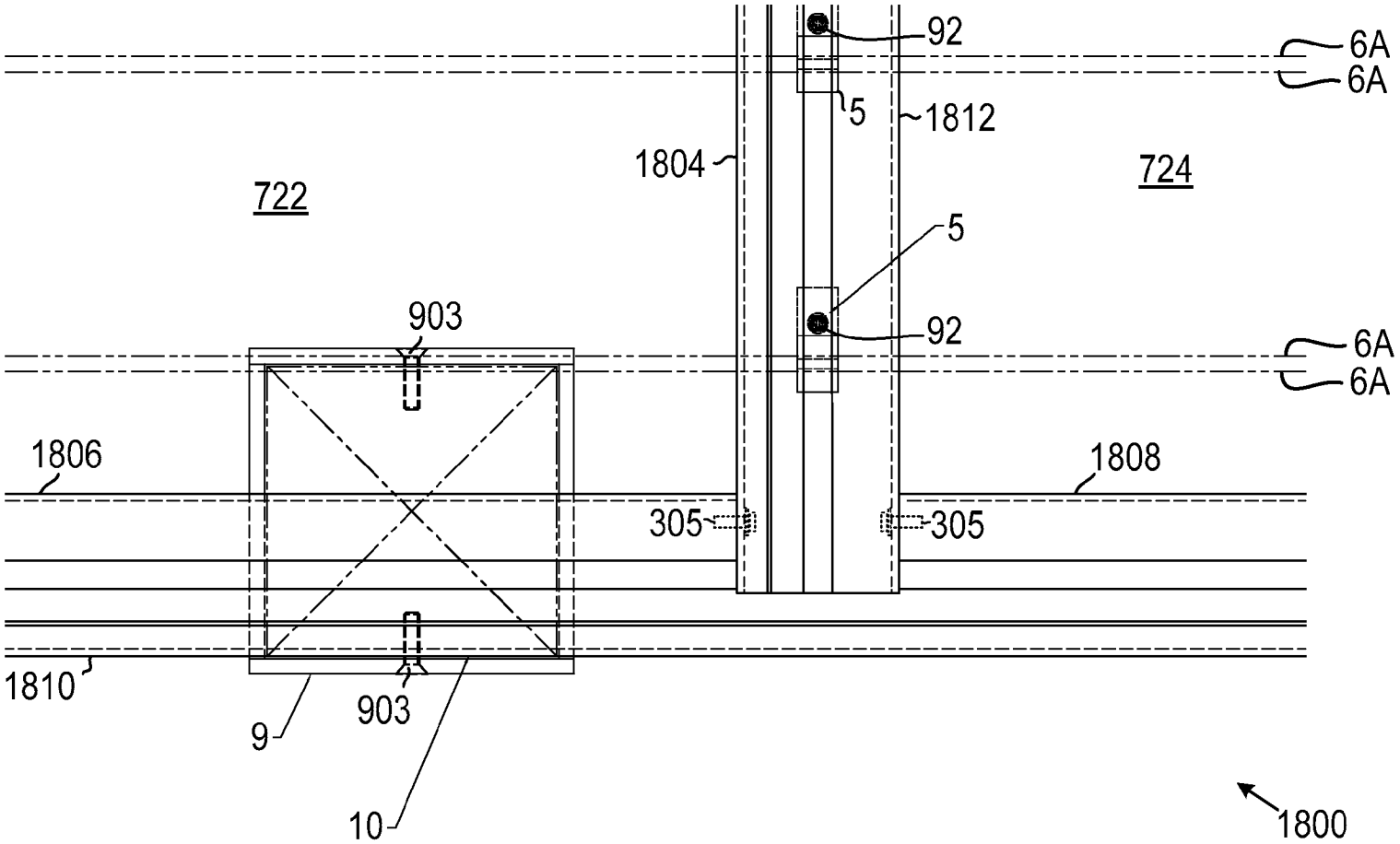

Next, FIG. 18 is a large-scale view of a portion 1800 of the deck system 700 shown in FIG. 7. Portion 1800 includes elements of the joist assemblies 722 and 724.

The joist assembly 722 includes a joist spacer 1806 configured like the extrusion 800 and a joist segment 1614 configured like the extrusion 800. The joist spacer 1806 and the joist segment 1614 can attach to one another using one or more fasteners 902.

The joist assembly 724 includes a joist spacer 1808 configured like the extrusion 850 and a joist segment 1616 configured like the extrusion 850. The joist spacer 1808 and the joist segment 1616 can attach to one another using one or more fasteners 902. The joist assembly 724 can be the last joist assembly installed into the deck system 705 during assembly and the first joist assembly removed from the deck system 705 during disassembly of the deck system 705.

In accordance with one or more example embodiment, roll-lock tabs of joist spacers 1806 and 1808 can be positioned within a roll-lock tab receiver of a box-frame-segment 1810 of the deck system 705. The box-frame-segment 1810 can be configured like the extrusion 800. The locking tab of the box-frame-segment 1810 and the locking tab retainers of joist spacers 1806 and 1808 are used for attachment of joist spacers 1806 and 1808 to the box-frame-segment 1810.

An intermediate-post bracket 9 attached to the post 10 using the fasteners 903 is shown in FIG. 18. The intermediate-post bracket 9 can be attached to the box-frame-segment 1810 using one or more fasteners 903 or another type of fastener. In an alternative embodiment, the intermediate-post bracket 9 shown in FIG. 18 can be replaced with an intermediate-post bracket 64 and the support ring 1012 to accommodate a railing post and railing attachable to the deck system 700. The deck-clips 5 and the deck-clip screws 92 are positioned within the joist segment 1616. FIG. 18 shows positions of edges 6A of the deck boards 6 attachable to the deck system 700.

Figure 19:
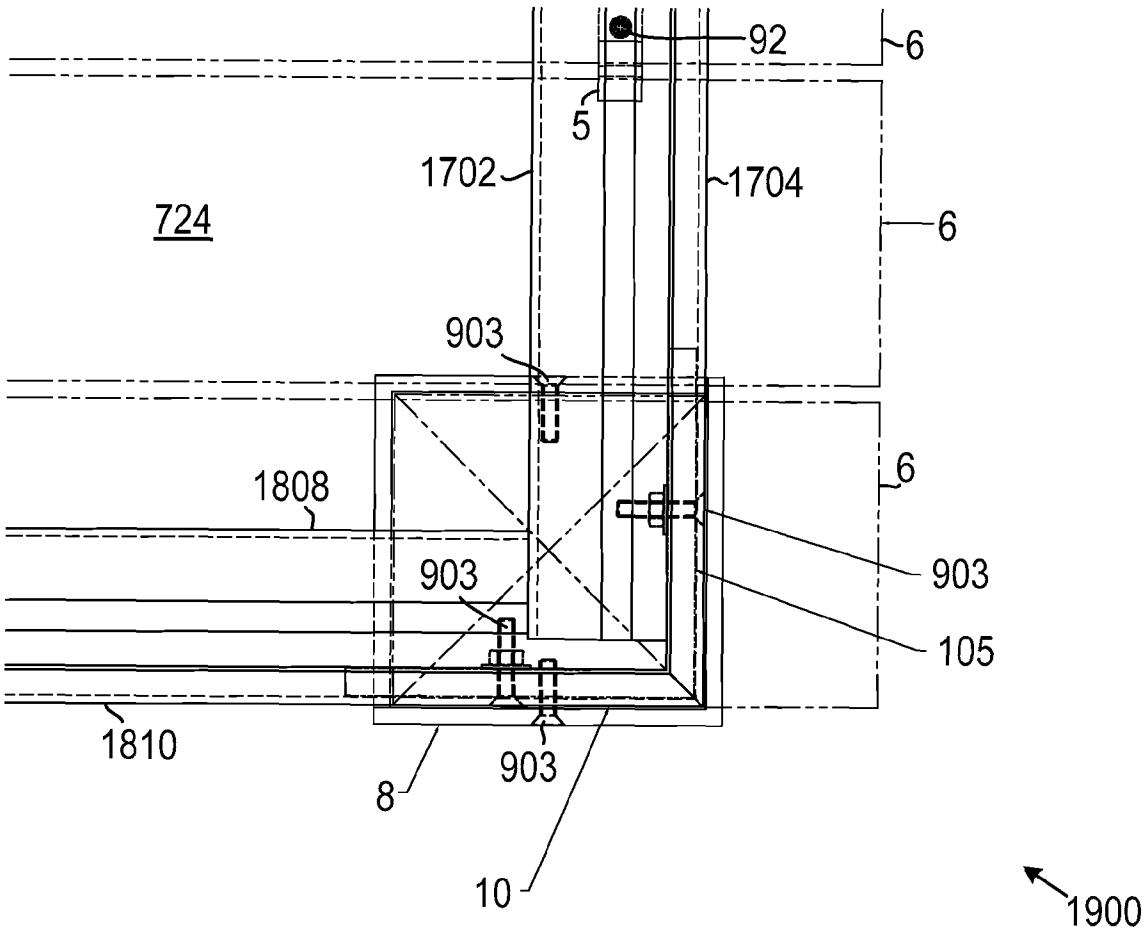

Next, FIG. 19 is a large-scale view of a portion 1900 of the deck system 700 shown in FIG. 7. Portion 1900 includes elements of the joist assembly 724 and the box-frame-segments 1704 and 1810 of box-frames of the deck system 705. The box-frame-segments 1704 and 1810 can be configured like the extrusion 800. The box-frame-segments 1704 and 1810 can attach to one another using angle clip 105, and angle clip 105 can attach to the box-frame-segments 1704 and 1810 using one or more fasteners 903 installed into screw splines of box-frame-segments 1704 and 1810.

The joist assembly 724 includes the joist spacer 1804 configured like the extrusion 850, and the joist segment 1702 configured like the extrusion 825 or the extrusion 850. The joist assembly 724 can be the last joist assembly installed into the deck system 705 during assembly and the first joist assembly removed from the deck system 705 during disassembly of the deck system 705.

A corner-post bracket 8 attached to the post 10 using the fasteners 903 is shown in FIG. 19. The corner-post bracket 8 can be attached to the box-frame-segments 1704 and 1810 using one or more fasteners 903 or another type of fastener. In an alternative embodiment, the corner-post bracket 9 shown in FIG. 19 can be replaced with a corner-post bracket 62 and support ring 1094 to accommodate a railing post and railing attachable to the deck system 700. A deck-clip 5 and deck-clip screw 92 are positioned within the extrusion 1702. FIG. 19 shows positions of deck boards 6 attachable to the deck system 700.

III. Assembly and Disassembly of Deck System

Figure 24:
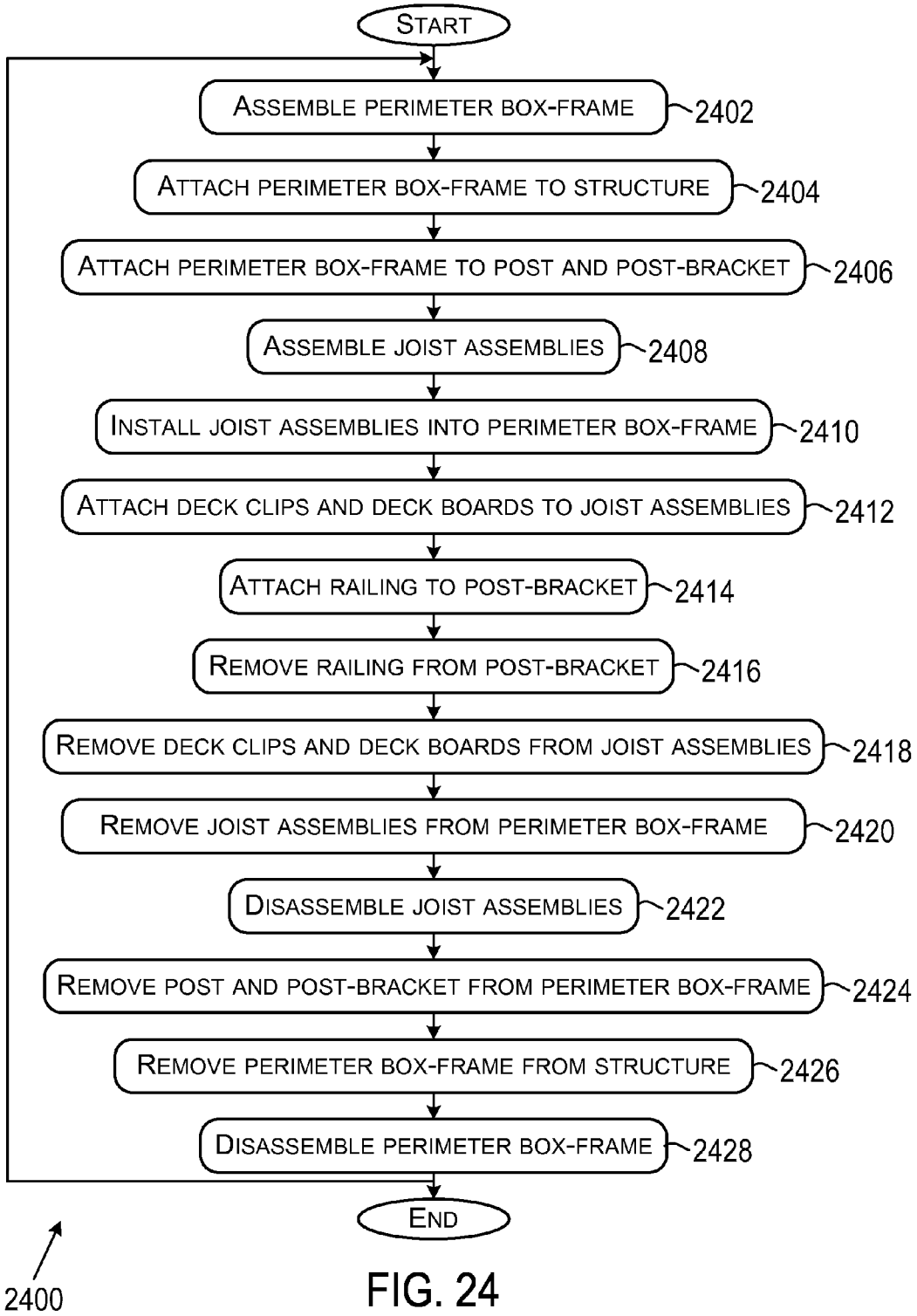
FIG. 24 is a flow chart showing steps for assembling and disassembling a deck system.

FIG. 24 is a flow chart showing example set of steps 2400 that can be carried out to assemble and disassemble a deck system in accordance with one or more example embodiments. One or more of the steps (shown in blocks numbered with even numbers between 2402 and 2428, inclusive) or portions of the steps of the set 2400 are not required for each and every example embodiment. The steps shown in the set 2400 can be carried out in various arrangements, and one or more of the steps can be repeated.

Block 2402 includes assembling perimeter box-frame. Assembling the box-frame can include inserting angle clips (e.g., corner angle clips) into box-frame-segments. Each angle clip can be inserted into two box-frame-segments to form a rectangular box-frame. Fasteners can be inserted into the angle clips and box-frame-segments to more securely attach two box-frame-segments together.

Next, block 2404 includes attaching perimeter box-frame to structure. Attaching the box-frame can include drilling holes within one or more box-frame-segments and into the structure. Shims can be placed between the structure and the box-frame to provide spacing, as necessary, between the structure and the deck system being attached to the structure. Fasteners 310 and 312 can be inserted into holes within the box-frame and the structure for attachment of the box-frame and the structure.

Next, block 2406 includes attaching the perimeter box-frame to post and post bracket. A support post can be positioned upon a footing, such as a concrete footing. A post bracket, such as corner-post bracket or an intermediate-post bracket, can be attached to the support post using fasteners, such as fasteners 903. The post bracket can be attached to a box-frame-segment of the box-frame using fasteners, such as fasteners 903.

Next, block 2408 includes assembling joist assemblies. In one respect, assembling the joist assemblies can include attaching two joist spacers to two joist segments. The joist spacers, for example, can be configured like the extrusion 850, or the box-frame-segment attachment 405, 465, or 489. The joist segments, for example, can be configured like the extrusion 800 and the extrusion 825, or the joist segments 433 and 1037, or the joist segments 707 and 355. The fasteners 305 can be used to attach a joist spacer to a joist segment.

If the quantity of joist assemblies of a set of joist assemblies 300 and 320 to be assembled for a deck system equals N (where N is greater than or equal to 2), then N−1 joist assemblies can be configured like the joist assembly 300, and one joist assembly can be configured like the joist assembly 320. The N−1 joist assemblies can be the first joist assemblies to be installed into the box-frame and the joist assembly 320 can be installed after each of the joist assemblies 300 is installed into the box-frame.

If the quantity of joist assemblies of a set of joist assemblies 173 and 501 to be assembled for a deck system equals N (where N is greater than or equal to 3), then N−2 joists can be configured like the joist assembly 501, and two three-piece joist assemblies can be configured like the joist assembly 173. The three-piece joist assemblies can be the first and last joist assemblies installed in the box-frame. Box-frame-segment covers 199 can be attached to the box-frame along with the three-piece joist assemblies, as shown in FIG. 39. The N−2 joist assemblies 501 can be installed into the box-frame after the first joist assembly 173 is installed and prior to installation of the last joist assembly 173.

Next, block 2410 includes installing joist assemblies into the perimeter box-frame. Installing the joist assemblies can include, starting at one side of the box-frame, installing each joist assembly configured like the joist assembly 300 until the remaining space in the interior of the box-frame and at the opposite side of the box-frame, and then installing the joist assembly configured like the joist assembly 320 into the remaining space. Installing each joist assembly until the installing the last joist assembly can include roll-lock tabs being positioned into roll-lock tab receivers at the attachment points of three box-frame-segments and two joist spacers and a joist segment of a joist assembly or at the attachment points of two box-frame-segments and a joist segment of a previously-installed joist assembly and two joist spacers and a joist segment of a joist assembly. Installing the last joist assembly can include roll-lock tabs being positioned into roll-lock tab receivers at the attachment points of three box-frame-segments and a joist segment of a previously-installed joist assembly, and two joist segments and two joist spacers of the joist assembly.

Next, block 2412 includes attaching deck-clips and deck boards to the joist assemblies. Attaching the deck-clips can include inserting the deck-clips 5 into the deck-clip slots 837 within a joist segment configured like the extrusion 825 or the extrusion 850, and securing the inserted deck-clip 5 using a deck-clip screw 92. A plurality of each deck board can be retained, at least in part, by deck board retaining surfaces 135 and 137 of a plurality of deck-clips. Additionally or alternatively, deck boards can be attached to the joist assemblies using the deck screws 2010.

Next, block 2414 includes attaching railing to post bracket. Attaching the railing can include attaching a railing post 60 within a corner-post bracket 64 or within an intermediate-post bracket 62 and within a support ring 1012 or 1094 using fasteners 903. A support bracket 1014 can be attached to a support post 10 and the railing post 60 using fasteners 903. Any of a variety of railing components can be attached to and between two railing posts 60.

Next, block 2410 includes removing the railing from the post bracket. Removing the railing from the post bracket can include removing any components attached to and between two railing posts, removing fasteners attaching the railing post 60 to post brackets, support ring, and support brackets and then removing the railing post from the brackets and from the deck system.

Next, block 2418 includes removing deck-clips and deck boards from the joist assemblies. Removing the deck-clips and deck boards can including removing any deck screws that attach the deck boards to the joist assemblies. Removing the deck boards can include sliding the each deck board away from the deck board retaining surfaces that are retaining the deck board. Removing the deck-clips can include removing the deck-clip screws 92 that retain the deck-clip to the joist assemblies.

Next, block 2420 includes removing joist assemblies from the perimeter box-frame. Removing the joist assemblies can include removing the joist assemblies in a reverse order in which the joist assemblies were installed into the box-frame. In other words, the joist assemblies can be removed using a last-in-first-out procedure.

Next, block 2422 includes disassembling joist assemblies. Disassembling the joist assemblies can include removing fasteners placed into a joist spacer and joist segment pair, and then separating the joist spacer from the joist segment.

Next, block 2424 includes removing post and post bracket from perimeter box-frame. Removing the box-frame from the post and post bracket can include removing the fasteners that attach the post and post bracket to a box-frame-segment. The post bracket can be removed from the post. In accordance with some example embodiments, the post can be removed from the footer.

Next, block 2426 includes removing perimeter box-frame from structure. Removing the box-frame can include removing fasteners 310 and 312 and shims used to attach the box-frame and the structure.

Next, block 2428 includes disassembling perimeter box-frame. Disassembling the box-frame can include removing any fasteners that secure two box-frame-segments. Disassembling the box-frame can include removing angle clips (e.g., corner angle clips) from the box-frame-segments.

IV. Conclusion

Example embodiments have been described above. Those skilled in the art will understand that changes and modifications can be made to the described embodiments without departing from the true scope and spirit of the present invention, which is defined by the claims. Any reference within a claim to an item in a figure is for ease of reference and does not necessarily limit the scope of the claim.

I claim:

1. A joist assembly comprising:

a joist including a first top horizontal element, a second top horizontal element, a first outer vertical element, a second outer vertical element, and a lower horizontal element extending from the first outer vertical element to the second outer vertical element, a first inner vertical element extending perpendicularly from the first top horizontal element towards the lower horizontal element, a second inner vertical element extending perpendicularly from the second top horizontal element towards the lower horizontal element, a third inner vertical element extending perpendicularly from the lower horizontal element towards the first inner vertical element, wherein the first inner vertical element is connected to the third inner vertical element, a fourth inner vertical element extending perpendicularly from the lower horizontal element towards the second inner vertical element, wherein the second inner vertical element is connected to the fourth inner vertical element, wherein a portion of the first outer vertical element extends from the first top horizontal element to the lower horizontal element, wherein a portion of the second outer vertical element extends from the second top horizontal element to the lower horizontal element, wherein the first top horizontal element and the second top horizontal element are separated from each other to form a first portion of a deck-clip slot, wherein the third inner vertical element is separated from the fourth inner vertical element by a distance to form a screw spline adjacent to deck-clip slot, wherein the first portion of the deck-clip slot comprises a narrow portion of the deck-clip slot, and wherein the first inner vertical element is recessed from an edge of the first top horizontal element and the second inner vertical element is recessed from an edge of the second top horizontal element to form a wider portion of the deck-clip slot.

2. The joist assembly of claim 1, further comprising:

at least one fastener.

3. The joist assembly of claim 1, further comprising:
an attachment element.

4. The joist assembly of claim 3, wherein the attachment element comprises a joist spacer or brace positioned between the joist and another joist.

5. The joist assembly of claim 4, further comprising:
a first angle clip; and
a second angle clip,
wherein the first outer vertical element comprises a first screw spline disposed below the lower horizontal element,
wherein the second outer vertical element comprises a second screw spline disposed below the lower horizontal element,
wherein the first angle clip is removably attached to the joist by a first fastener, and
wherein the second angle clip is removably attached to the joist by a second fastener.

6. The joist assembly of claim 5, further comprising:
a first tab;
a second tab;
a third tab; and
a fourth tab,
wherein the first tab, the second tab and the first inner vertical element define a first recessed area,
wherein the third tab, the fourth tab and the second inner vertical element define a second recessed area,
wherein the first angle clip is positioned within the first recessed area, and
wherein the second angle clip is positioned within the second recessed area.

7. The joist assembly of claim 5, further comprising:
a first attachment element including a first attachment hole,
a second attachment element including a second attachment hole,
a third fastener, and
a fourth fastener,
wherein the first angle clip is removably attached to the first attachment by the first fastener disposed in the first attachment hole, and
wherein the second angle clip is removably attached to the second attachment by the second fastener disposed in the second attachment hole.

8. The joist assembly of claim 3, wherein the attachment element comprises a joist spacer or brace positioned between the joist and another joist.

9. The joist assembly of claim 1, further comprising:
a first H-bar shim attached to the joist,
wherein the first H-bar shim includes a first vertical element, a second vertical element, and a horizontal element extending between the first vertical element and the second vertical element of the first H-bar shim.

10. The joist assembly of claim 9, further comprising:
a first fastener; and
a second fastener,
wherein the first vertical element of the first H-bar shim is attached to the first outer vertical element by the first fastener, and
wherein the second vertical element of the first H-bar shim is attached to the second outer vertical element by the second fastener.

11. The joist assembly of claim 9, further comprising:
a second H-bar shim attached to the joist,
wherein the second H-bar shim includes a first vertical element, a second vertical element, and a horizontal element extending between the first vertical element and the second vertical element of the second H-bar shim.

12. The joist assembly of claim 11, wherein a height of the first H-bar shim is equal to a height of the second H-bar shim.

13. The joist assembly of claim 11, wherein a height of the first H-bar shim is different than a height of the second H-bar shim.

14. The joist assembly of claim 1, wherein the joist comprises an aluminum extrusion.

* * * * *